US008475982B2

(12) United States Patent
Iwasaki et al.

(10) Patent No.: US 8,475,982 B2
(45) **Date of Patent: *Jul. 2, 2013**

(54) CHARGE-TRANSPORTING COMPOUND, ELECTROPHOTOGRAPHIC PHOTORECEPTOR, IMAGE-FORMING APPARATUS, AND PROCESS CARTRIDGE

(75) Inventors: Masahiro Iwasaki, Kanagawa (JP); Katsumi Nukada, Kanagawa (JP); Wataru Yamada, Kanagawa (JP); Kenji Yao, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1625 days.

This patent is subject to a terminal disclaimer.

(21) Appl. No.: 11/389,249

(22) Filed: Mar. 27, 2006

(65) Prior Publication Data

US 2006/0216619 A1 Sep. 28, 2006

(30) Foreign Application Priority Data

Mar. 28, 2005 (JP) ..... 2005-092880
Oct. 11, 2005 (JP) ..... 2005-296813
Jan. 5, 2006 (JP) ..... 2006-000848

(51) Int. Cl.
*G03G 5/047* (2006.01)

(52) U.S. Cl.
USPC ..... 430/58.75; 430/57.1; 430/73

(58) Field of Classification Search
USPC ..... 430/56.65, 56.75, 73, 58.75, 57.1
See application file for complete search history.

(56) References Cited

U.S. PATENT DOCUMENTS 6,203,954 B1 3/2001 Anayama
6,627,367 B2 9/2003 Tomiuchi et al.
2003/0043253 A1* 3/2003 Kitamura et al. ..... 347/233
2003/0118366 A1 6/2003 Nukada et al.
2003/0129451 A1 7/2003 Nukada et al.
2003/0194625 A1 10/2003 Tanaka et al.
2003/0232262 A1 12/2003 Yamada et al.

(Continued)

FOREIGN PATENT DOCUMENTS

CN 1467571 A 1/2004
JP 09073179 A * 3/1997

(Continued)

OTHER PUBLICATIONS

Advisory Action issued in related U.S. Appl. No. 11/302,213 dated Apr. 5, 2010.

(Continued)

*Primary Examiner* — Mark F Huff
*Assistant Examiner* — Rachel Zhang
(74) *Attorney, Agent, or Firm* — Oliff & Berridge, PLC

(57) ABSTRACT

An electrophotographic photoreceptor comprising: a conductive support; and a photosensitive layer, wherein the photosensitive layer comprises a functional layer that comprises at least one of a first compound represented by formula (I); and a second compound derived from the first compound:

(I)

wherein F represents a hole-transporting, n-valent organic group; R independently represents an organic group having from 1 to 18 carbon atoms; T represents a divalent group; m indicates 0 or 1; and n indicates an integer of from 1 to 4.

23 Claims, 16 Drawing Sheets

U.S. PATENT DOCUMENTS

| | | | | |
|---|---|---|---|---|
| 2004/0063014 | A1 | 4/2004 | Yoshimura et al. | |
| 2004/0101774 | A1 | 5/2004 | Yoshimura et al. | |
| 2004/0141779 | A1* | 7/2004 | Yanagida et al. | 399/350 |
| 2004/0185358 | A1* | 9/2004 | Kami | 430/58.7 |
| 2004/0197690 | A1 | 10/2004 | Yamada et al. | |
| 2005/0053855 | A1* | 3/2005 | Takegawa et al. | 430/66 |
| 2005/0175927 | A1 | 8/2005 | Kishioka et al. | |
| 2005/0185989 | A1* | 8/2005 | Kosuge et al. | 399/168 |
| 2005/0196193 | A1 | 9/2005 | Tamoto et al. | |
| 2006/0029870 | A1 | 2/2006 | Nukada et al. | |
| 2006/0292464 | A1* | 12/2006 | Yamada et al. | 430/56 |
| 2006/0292465 | A1* | 12/2006 | Yamada et al. | 430/56 |

FOREIGN PATENT DOCUMENTS

| | | |
|---|---|---|
| JP | A-11-38656 | 2/1999 |
| JP | B2 3264218 | 12/2001 |
| JP | A-2002-6527 | 1/2002 |
| JP | A-2002-82466 | 3/2002 |
| JP | A 2002-82469 | 3/2002 |
| JP | A-2003-186215 | 7/2003 |
| JP | A-2003-186234 | 7/2003 |
| JP | A-2005-70749 | 3/2005 |

OTHER PUBLICATIONS

Office Action issued in Japanese Patent Application No. 2006-000848 on Jun. 22, 2010 (with Translation).
May 6, 2011 Office Action issued in U.S. Appl. No. 11/302,213.
Office Action for U.S. Appl. No. 11/302,213; mailed Nov. 1, 2007.
Office Action for U.S. Appl. No. 11/302,213; mailed Sep. 18, 2008.
Office Action for U.S. Appl. No. 11/302,213; mailed Apr. 15, 2008.
Office Action for U.S. Appl. No. 11/302,213; mailed Apr. 2, 2009.
Office Action for U.S. Appl. No. 11/302,213; mailed Nov. 16, 2009.
Office Action for U.S. Appl. No. 11/236,811; mailed Apr. 7, 2008.
Jul. 22, 2011 Office Action issued in U.S. Appl. No. 11/302,213.

* cited by examiner

CHARGE-TRANSPORTING COMPOUND, ELECTROPHOTOGRAPHIC PHOTORECEPTOR, IMAGE-FORMING APPARATUS, AND PROCESS CARTRIDGE

BACKGROUND OF THE INVENTION

1. Field of the Invention

The present invention relates to a charge-transporting compound, an electrophotographic photoreceptor, an image-forming apparatus, and a process cartridge.

2. Description of the Related Art

A xerographic image-forming apparatus comprises an electrophotographic photoreceptor (hereinafter this may be referred to as "photoreceptor"), a charging device, an exposing device, a developing device and a transfer device, in which an image is formed through electrophotography with the devices.

With the recent technical development of the constitutive members and systems thereof, the xerographic image-forming apparatus that comprises a charging device, an exposing device, a developing device, a transfer device and a fixing device is being much improved for higher speed, better image quality and longer life. With that, the requirements for high-speed operability and high reliability of the respective subsystems of the apparatus are increasing more than before. In particular, the photoreceptor for image writing thereon and the cleaning member for cleaning the photoreceptor receive more stress than any other members owing to their mutual sliding to each other, and are often scratched, worn or cracked to cause image defects. Accordingly, the requirements for high-speed operability and high reliability of these devices are severer than those of any others.

In addition, the requirement for high quality image formation is also increasing. To satisfy the requirement, the particle size of toner is reduced, the particle size distribution thereof is unified and the sphericity thereof is increased. As one type of the toner that satisfies the quality level, a chemical toner is being much developed, which is produced in a solvent consisting essentially of water. As a result, toner images that are on a photographic image level have become obtained these days.

For preventing an electrophotographic photoreceptor from being scratched or worm there is known a method of coating it with a protective layer of high mechanical strength. For example, Japanese Patent No. 3,264,218 discloses a photoreceptor coated with a protective layer that has a crosslinked structure and has a carrier transportation ability. JP-A 2002-82469 discloses a photoreceptor coated with a protective layer that contains a phenolic resin.

However, even the photoreceptors of Japanese Patent No. 3,264,218 and JP-A 2002-82469 are not always satisfactory for forming high-quality images for a long period of time for the reasons mentioned below.

The photoreceptor of Japanese Patent No. 3,264,218 may be prevented from being scratched or worn on its surface owing to the increase in the mechanical strength thereof, but on the other hand, the surface of the photoreceptor is hardly polished and the discharged products adhering to the surface of the photoreceptor are difficult to remove since the surface layer of the photoreceptor is hard. Further, when a cleaning blade presses the adhering substances to the outermost surface of the photoreceptor, then the adhering substances become more difficult to remove. As a result, oxidation-degraded substances that may be formed on the surface of the photoreceptor owing to the charging stress applied thereto may more firmly adhere to the surface of the photoreceptor.

Depending on the type of the deposits and the degree of deposition on the surface of the photoreceptor, the adhering substances may lower the quality of the image formed on the photoreceptor, for example, causing white spots and density mottles in the image. As a result, the photoreceptor could not form an image of high quality.

Having investigated the photoreceptor of JP-A 2002-82469, we, the present inventors have found that the photoreceptor fails to stably form an image of high quality since its electric properties worsen depending on the condition for producing it.

SUMMARY OF THE INVENTION

The invention has been worked out in the light of the aforementioned problems with the related art technique. An aim of the invention is to provide an electrophotographic photoreceptor which is sufficiently excellent in electrical properties, abrasion resistance and anti-adhesion properties and can provide a high image quality and a prolonged life and a process cartridge and an image-forming apparatus comprising same. Another aim of the invention is to provide a charge-transporting compound which, when applied to an electrophotographic photoreceptor, can provide the electrophotographic photoreceptor with a high image quality and a prolonged life.

To solve the above-mentioned problems, the electrophotographic photoreceptor of the invention comprises a conductive support and a photosensitive layer provided on the conductive support, wherein the photosensitive layer comprises a functional layer that comprises at least one of a first compound represented by formula (I); and a second compound derived from the first compound:

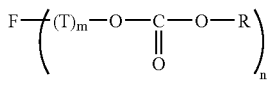

(I)

wherein F represents a hole-transporting, n-valent organic group; R independently represents an organic group having from 1 to 18 carbon atoms; T represents a divalent group; m indicates 0 or 1; and n indicates an integer of from 1 to 4.

In the electrophotographic photoreceptor of the invention, the photosensitive layer has a functional layer that contains a compound having a structure of formula (I) or a compound derived from that compound. Accordingly, the photoreceptor enables high-quality image formation and long-life operation. Though not always clear, we, the present inventors presume that these advantages may result from the reasons mentioned below.

In other words, the compound having a structure represented by the general formula (I) or the compound derived therefrom is excellent in solubility and thus can form a uniform film even when added more than necessary to a material such as resin with which it forms a film. Further, when used in combination with a crosslinkable resin, the aforementioned compound can react with the reactive group in the crosslinkable resin to form a rigid crosslinked structure. In this arrangement, the functional layer can sufficiently prevent the formation of charge trapping sites therein to exhibit excellent electrical properties. Further, the resulting extremely dense crosslinked structure allows enhancement of both mechanical strength and gas barrier properties against discharge product, etc., making it possible to attain both abrasion resistance and anti-adhesion properties to a high extent. As a result, an electrophotographic photoreceptor having a high image quality and a prolonged life can be realized. Moreover, the aforementioned compound can be stably present in the coating solution without any chemical change. Therefore, the aforementioned compound can difficultly cause precipitation or gelation in the coating solution, making it possible to form a functional layer having the aforementioned properties without any dispersion. This, too, is one of factors of the aforementioned effects.

The image-forming apparatus of the invention comprises the electrophotographic photoreceptor of the invention, a charging device that charges the electrophotographic photoreceptor, an exposing device that exposes the charged electrophotographic photoreceptor to light to form an electrostatic latent image thereon, developing device that develops the electrostatic latent image to form a toner image, and a transfer device that transfers the toner image onto a transfer medium.

The process cartridge of the invention comprises the electrophotographic photoreceptor of the invention, and at least one selected from a charging device that charges the electrophotographic photoreceptor, a developing device that develops an electrostatic latent image formed through exposing the charged electrophotographic photoreceptor to form a toner image, and a cleaning device that removes a toner that remains on the electrophotographic photoreceptor after transfer.

Comprising the electrophotographic photoreceptor as above, the image-forming apparatus and the process cartridge of the invention enable long-term formation of high-quality images.

The invention further provides a charge-transporting compound represented by the following general formula (I-A).

(I-A)

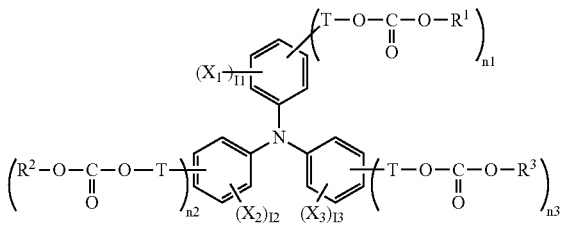

wherein $X_1$, $X_2$ and $X_3$ each independently represents a hydrogen atom, a halogen atom, an alkyl group having from 1 to 10 carbon atoms, an alkoxyl group having from 1 to 10 carbon atoms, a substituted or unsubstituted aryl group, an aralkyl group having from 7 to 10 carbon atoms, a substituted or unsubstituted styryl group, a substituted or unsubstituted butadiene group or a substituted or unsubstituted hydrazone group; l1, l2 and l3 each represents an integer of from 0 to 2; $R^1$, $R^2$ and $R^3$ each independently represents an organic group having from 1 to 18 carbon atoms; T represents a methylene group; and n1, n2 and n3 each represents 0 or 1, and n1, n2 and n3 satisfies the relationship $(n1+n2+n3) \geqq 1$.

In accordance with the charge-transporting compound of the invention, organic electronic devices such as electrophotographic photoreceptor, organic electroluminescence element, memory element and wavelength conversion element can be provided with a higher stability and a prolonged life. In some detail, the organic electroluminescence element needs to suppress morphology change of the functional layer (film) constituting the element due to Joule heat from the standpoint of stabilization and prolongation of life. By incorporating the compound of the invention in the functional layer, the functional layer can be provided with excellent electrical properties while assuring sufficient strength of functional layer or enhancing the strength of functional layer. Referring to the electrophotographic photoreceptor, the functional layer constituting the photosensitive layer, particularly the surface protective layer can be formed by the compound of the invention to satisfy the requirements both for electrical properties and mechanical strength to a high extent, making it possible to provide the photosensitive layer with both a high image quality and a prolonged life. Thus, the charge-transporting compound of the invention can be fairly used as a material of organic electronic device which requires a high mechanical strength.

The inventors presume the reason why the aforementioned effect can be exerted by the invention as follows. In other words, the compound represented by the general formula (I-A) can satisfy all the requirements for solubility in organic solvent, compatibility with various binder resins and electrical properties to a high extent. In the case where a thermoplastic resin is used as a binder resin in the formation of the functional layer, the binder resin and the charge-transporting compound can be fairly dispersed in the coating solution, making it easy to form a uniform coat layer. In this manner, excellent electrical properties can be given while preventing defective film formation due to phase separation, making it possible to sufficiently prevent the charge-transporting layer having the compound of the invention molecularly dispersed in a polyester resin or polycarbonate resin from undergoing crystal precipitation and deterioration of electrical properties due to concentration. Thus, the resulting organic electronic device can be provided with a higher stability and a prolonged life. Further, the compound represented by the general formula (I-A) has a carboxylic group connected to a triarylamine skeleton via methylene group and thus can easily release the carboxylic group from the side chains at room temperature under weak acid conditions. With these properties, the aforementioned compound can undergo decarboxylation under relatively mild conditions when the functional layer is formed by the coating solution. In particular, when used in combination with a curable resin having a high polarity advantageous to provide a desired mechanical strength such as phenolic resin, the aforementioned compound can be fairly compatibilized with the curable resin. Further, the aforementioned compound can be sufficiently bonded to polar groups which can form carrier traps. Then, a cured film that satisfy both the requirements for mechanical strength and electrical properties to a high extent can be formed. The resulting organic electronic device can be provided with a higher stability and a prolonged life. In the invention, as the acidifying compound there may be used a phenol, hydrochloric acid, acetic acid, sulfonic acid, toluenesulfonic acid, phosphoric acid, silica gel, Lewis acid, acidic ion exchange resin or the like. Thus, the acidifying compound of the invention is not specifically limited.

The aforementioned limitation of T in the compound represented by the general formula (I-A) to methylene group is based on the inventors' knowledge that the cured film formed of the compound of the general formula (I-A) wherein T is a methylene group in combination with an acidic phenolic resin can be provided with a desired mechanical strength to best advantage. Even when T is a group having a large number of carbon atoms such as ethylene group and propylene group or when T is absent, the functional layer can be formed. However, it is thought that when the number of carbon atoms in T is 2 or more, the resulting compound of the general formula (I-A) has a remarkably low reactivity. Therefore, in order to sufficiently assure mechanical strength, it is necessary that the acidity be raised or the temperature be raised, making it likely that troubles such as deterioration of electrical proportion and occurrence of image quality defects can occur. In the case where T is absent, that is, there is a phenyl carbonate structure having an oxygen atom directly connected to an aromatic ring, the carbonate group is stabilized, making it difficult to provide a high mechanical strength under weak acid conditions and causing the deterioration of charge-transporting properties. Accordingly, the charge-transporting compound of the invention is advantageous also in that organic electronic devices can be produced in a good yield.

BRIEF DESCRIPTION OF THE DRAWINGS

Preferred embodiments of the present invention will be described in detail based on the following figure, wherein.

DETAILED DESCRIPTION OF THE INVENTION

Figure 1:
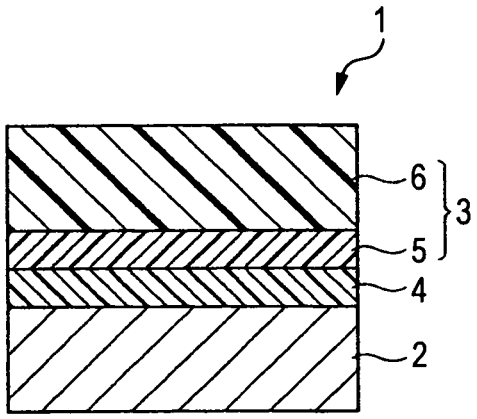
FIG. 1 is a schematic cross-sectional view showing one preferred embodiment of the electrophotographic photoreceptor of the invention.

Preferred embodiments of the invention are described in detail with reference to the drawings attached hereto. In the description of the drawings, the same or the corresponding elements are indicated by the same reference numeral and redundant explanations are omitted.

<Electrophotographic Photoreceptor>

The electrophotographic photoreceptor of the invention is characterized in that it has a layer (functional layer) that contains a compound having a structure of formula (I) or a compound derived from that compound. Preferably, the outermost layer of the electrophotographic photoreceptor contains a compound having a structure of formula (I) or a compound derived from that compound.

Also preferably, in the electrophotographic photoreceptor of the invention, the compound having the structure of formula (I) has a structure of the following formula (II):

(II)

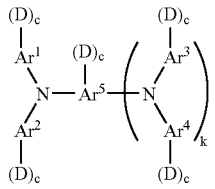

wherein $Ar^1$ to $Ar^4$ may be the same or different, each representing a substituted or unsubstituted aryl group; $Ar^5$ represents a substituted or unsubstituted aryl or arylene group; c independently indicates 0 or 1; k indicates 0 or 1; D represents a monovalent organic group of the following formula (III); and the total of c is from 1 to 4:

(III)

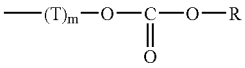

wherein R independently represents an organic group having from 1 to 18 carbon atoms; T represents a divalent group; and m indicates an integer of 0 or 1.

The electrophotographic photoreceptor of the preferred embodiments as above satisfies the requirements of electric properties, mechanical strength and cleaning capability all on a higher level.

In the electrophotographic photoreceptor of the invention, the photosensitive layer preferably has a functional layer containing a compound represented by the general formula (I-A) or a compound derived therefrom:

(I-A)

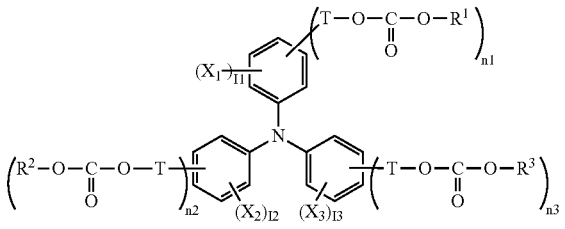

wherein $X_1$, $X_2$ and $X_3$ each independently represents a hydrogen atom, a halogen atom, an alkyl group having from 1 to 10 carbon atoms, an alkoxyl group having from 1 to 10 carbon atoms, a substituted or unsubstituted aryl group, an aralkyl group having from 7 to 10 carbon atoms, a substituted or unsubstituted styryl group, a substituted or unsubstituted butadiene group or a substituted or unsubstituted hydrazone group; l1, l2 and l3 each represents an integer of from 0 to 2; $R^1$, $R^2$ and $R^3$ each independently represents an organic group having from 1 to 18 carbon atoms; T represents a methylene group; and n1, n2 and n3 each represents 0 or 1, and n1, n2 and n3 satisfies the relationship $(n1+n2+n3) \geqq 1$.

In this arrangement, high image quality and prolonged life can be realized to a higher extent. The reason is not necessarily definite but is presumed as follows. In other words, the aforementioned compound has a carboxylic group connected to a triarylamine skeleton via methylene group. In this arrangement, the carboxylic group can be easily separated from the side chains even at room temperature under weak acid conditions. With these properties, the aforementioned compound can undergo decarboxylation under relatively mild conditions when the functional layer is formed by the coating solution. In particular, when used in combination with a curable resin having a high polarity advantageous to provide a desired mechanical strength such as phenolic resin, the aforementioned compound can be fairly compatibilized with the curable resin while suppressing undesirable side reactions to undergo sufficient reaction. Further, the aforementioned compound can be sufficiently bonded to polar groups which can form carrier traps. In other words, the aforementioned functional layer comprises a compound represented by the general formula (I-A) or a compound derived therefrom incorporated therein and thus forms a layer having further improvement in electrical properties and mechanical strength. The resulting electrophotographic photoreceptor can be provided with a high image quality and a prolonged life to a higher extent.

In the electrophotographic photoreceptor of the invention, the functional layer preferably is provided on the side of the photosensitive layer farthest from the conductive support and has a crosslinked structure. In general, in the case where an outermost layer of photosensitive layer is provided, it is often practiced to use an alcohol-based or ketone-based solvent so that the underlying photosensitive layer cannot be attacked as much as possible. However, the related art charge-transporting material can be insufficiently dissolved in these solvents and thus can difficultly form a good crosslinked film. On the contrary, in accordance with the invention, the charge-transporting compound according to the invention can be fairly dissolved in alcohol-based or ketone-based solvents and thus can form a coating solution excellent in film-forming properties, making it assured that an outermost layer excellent in electrical properties and mechanical strength can be formed while suppressing the effect on the underlying layer. In this arrangement, the resulting electrophotographic photoreceptor can be provided with a high image quality and a prolonged life to a higher extent.

In the electrophotographic photoreceptor of the invention, preferably, the functional layer is on the side of the photosensitive layer remotest from the conductive support and has a crosslinked structure.

Also preferably, the functional layer contains a crosslinkable resin.

Also preferably, the crosslinkable resin is at least one selected from a group consisting of phenolic resin, melamine resin, benzoguanamine resin, siloxane resin and urethane resin.

More preferably, in the electrophotographic photoreceptor of the invention, the functional layer contains a material containing a fluorine element or a silicon element.

Also preferably, the functional layer contains at least one or more antioxidants.

Also preferably, the functional layer contains at least one or more types of fine particles.

Also preferably, the functional layer has an oxygen transmission coefficient at 25° C. of $4\times10^{12}$ fm/s·Pa or less.

Preferred embodiments of the electrophotographic photoreceptor of the invention are described below.

FIG. 1 is a schematic cross-sectional view showing one preferred embodiment of the electrophotographic photoreceptor of the invention. As in FIG. 1, the electrophotographic photoreceptor 1 comprises a conductive support 2, an undercoat layer 4, and a photosensitive layer 3 comprising a carrier generation layer 5 and a carrier transport layer 6. In the electrophotographic photoreceptor 1 of FIG. 1, the carrier transport layer 6 is the layer that contains a compound having a structure of formula (I) or a compound derived from that compound.

FIGS. 2 to 5 are schematic cross-sectional views showing other preferred embodiments of the electrophotographic photoreceptor of the invention.

Figure 2:
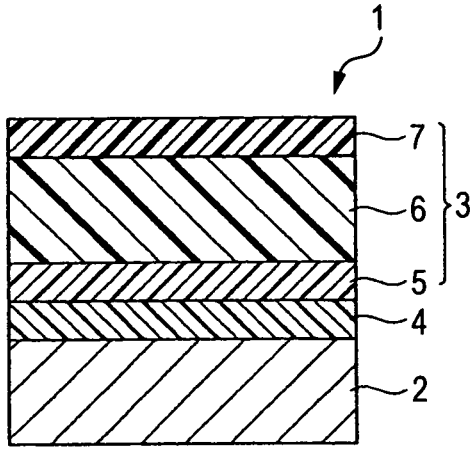
FIG. 2 is a schematic cross-sectional view showing another preferred embodiment of the electrophotographic photoreceptor of the invention.
Figure 3:
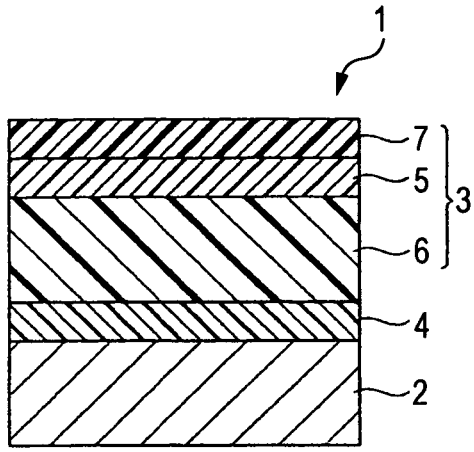
FIG. 3 is a schematic cross-sectional view showing still another preferred embodiment of the electrophotographic photoreceptor of the invention.

The electrophotographic photoreceptor 1 of FIG. 2 has a structure comprising an undercoat layer 4, a carrier generation layer 5, a carrier transport layer 6 and a protective layer 7 laminated in that order on a conductive support 2. The electrophotographic photoreceptor 1 of FIG. 3 has a structure comprising an undercoat layer 4, a carrier transport layer 6, a carrier generation layer 5 and a protective layer 7 laminated in that order on a conductive support 2. In the electrophotographic photoreceptors of FIG. 2 and FIG. 3, the protective layer 7 is the layer that contains a compound having a structure of formula (I) or a compound derived from that compound.

Figure 4:
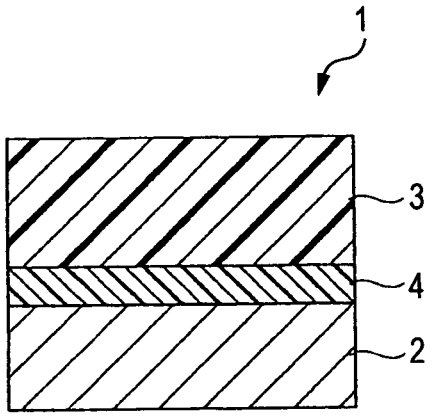
FIG. 4 is a schematic cross-sectional view showing still another preferred embodiment of the electrophotographic photoreceptor of the invention.

The electrophotographic photoreceptor 1 of FIG. 4 is so designed that an undercoat layer 4 is provided on a conductive support 2 and a single-layered photosensitive layer 3 is provided thereon, in which the photosensitive layer 3 contains both a carrier generation material and a carrier transport material therein. In the electrophotographic photoreceptor 1 of FIG. 4, the photosensitive layer 3 is the layer that contains a compound having a structure of formula (I) or a compound derived from that compound.

Figure 5:
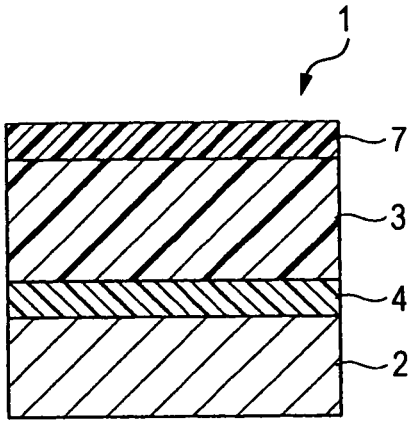
FIG. 5 is a schematic cross-sectional view showing still another preferred embodiment of the electrophotographic photoreceptor of the invention.

The electrophotographic photoreceptor 1 of FIG. 5 is so designed that an undercoat layer 4, a single-layered photosensitive layer 3 and a protective layer 7 are laminated in that order on a conductive support 2. In this, the protective layer 7 is the layer that contains a compound having a structure of formula (I) or a compound derived from that compound.

As in the above, the photosensitive layer of the electrophotographic photoreceptor of the invention may be any of a single-layered photosensitive layer that contains both a carrier generation material and a carrier transport material therein or a function-separated photosensitive layer that comprises separate layers of a carrier generation material-containing layer (carrier generation layer) and a carrier transport material-containing layer (carrier transport layer). In the function-separated photosensitive layer, the carrier generation layer and the carrier transport layer may be laminated in any order and any of the two may be the upper layer. The function-separated photosensitive layer realizes better functions since the respective layers may exclusively exhibit their own functions for function separation between the two.

With reference to one typical embodiment of the electrophotographic photoreceptor 1 of FIG. 2, the constitutive elements of the device are described in detail hereinunder.

The conductive support 2 may be, for example, a metal plate, a metal drum or a metal belt formed of a metal such as aluminium, copper, zinc, stainless, chromium, nickel, molybdenum, vanadium, indium, gold or platinum, or their alloy.

For the conductive support 2, also usable herein are paper, plastic films or belts coated, deposited or laminated with a conductive compound such as conductive polymer or indium oxide or with a metal such as aluminium, palladium or gold or their alloy.

Preferably, the surface of the conductive support 2 is roughened to have a centerline average height, Ra of from 0.04 μm to 0.5 μm for preventing interference fringes that may occur in irradiation with laser light. If the surface Ra of the conductive support 2 is smaller than 0.04 μm, then it is near to a mirror face condition and its interference-preventing effect will be insufficient. On the other hand, if Ra is larger than 0.5 μm, then even though a film is formed thereon, the image quality may be poor. When non-interference light is used as a light source, the surface-roughening treatment for interference fringe prevention is not always necessary and defects to be caused by the surface roughness of the conductive support 2 may be prevented. Accordingly, this is suitable for life prolongation.

For roughening the surface of the support, for example, employable is a wet-honing method of jetting an abrasive suspension in water to a support; a centerless grinding method of pressing a support against a rotating grindstone for continuously grinding it; or a method of anodic oxidation.

A different mode of surface roughening may also be employed herein. This is as follows: The surface of the conductive support 2 is not directly roughened. A dispersion of a conductive or semiconductive powder in a resin is applied to it so as to from a layer on the surface of the support. The fine particles in the layer may roughen the surface of the thus-coated support. This is also preferably employed herein.

The anodic oxidation comprises processing the aluminium surface of a support in an electrolytic solution in which the aluminium acts as an anode for anodic oxidation to form an oxide film on the aluminium surface. The electrolytic solution includes sulfuric acid solution and oxalic acid solution. However, the porous oxide film, if not further processed after anodic oxidation, is chemically active and is readily polluted, and in addition, its environment-dependent resistance fluctuation is great. Accordingly, the oxide film formed through anodic oxidation is further processed for hydration with pressure steam or in boiling water (optionally a metal salt of nickel or the like may be added to it) to attain volume expansion for sealing up the fine pores of the film, whereby the oxide film is converted into a more stable hydrate oxide film.

Preferably, the thickness of the oxide film in anodic oxidation is from 0.3 to 15 μm. If it is smaller than 0.3 μm, then the barrier property of the film against injection is poor and its effect may be unsatisfactory. On the other hand, if it is larger than 15 μm, then it may cause residual potential increase in repeated use.

The conductive support 2 may be processed with an aqueous acid solution or may be processed for boehmite treatment. The treatment with an acid solution comprising phosphoric acid, chromic acid and hydrofluoric acid may be effected as follows: The acid solution is prepared. The blend ratio of phosphoric acid, chromic acid and hydrofluoric acid to form the acid solution is preferably as follows: Phosphoric acid is from 10 to 11% by weight, chromic acid is from 3 to 5% by weight, and hydrofluoric acid is from 0.5 to 2% by weight. The overall acid concentration of these is preferably from 13.5 to 18% by weight. The processing temperature is preferably from 42 to 48° C. At a higher temperature, a thicker film may be formed more rapidly. Preferably, the thickness of the film is from 0.3 to 15 μm. If it is smaller than 0.3 μm, then its barrier property against injection is poor and its effect may be insufficient. On the other hand, if it is larger than 15 μm, then it may cause residual potential increase in repeated use.

The boehmite treatment may be attained by dipping the support in pure water at 90 to 100° C. for 5 to 60 minutes, or by contacting the support with heated steam at 90 to 120° C. for 5 to 60 minutes. Preferably, the thickness of the film is from 0.1 to 5 μm. This may be further processed for anodic oxidation with an electrolytic solution of low film dissolution ability, such as a solution of adipic acid, boric acid, borate, phosphate, phthalate, maleate, benzoate, tartrate or citrate.

The undercoat layer 4 is formed on the conductive support 2. The undercoat layer 4 contains an organic metal compound and/or a binder resin.

The organic metal compound includes organozirconium compounds such as zirconium chelate compounds, zirconium alkoxide compounds, zirconium coupling agents; organotitanium compounds such as titanium chelate compounds, titanium alkoxide compounds, titanium coupling agents; organoaluminium compounds such as aluminium chelate compounds, aluminium coupling agents; as well as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminium silicon alkoxide compounds, aluminium titanium alkoxide compounds, aluminium zirconium alkoxide compounds.

As the organic metal compound, especially preferred are organozirconium compounds, organotitanium compounds and organoaluminium compounds since their residual potential is low and they enable good electrophotographic properties.

The binder resin may be any known one, including, for example, polyvinyl alcohol, polyvinyl methyl ether, poly-N-vinylimidazole, polyethylene oxide, ethyl cellulose, methyl cellulose, ethylene-acrylic acid copolymer, polyamide, polyimide, casein, gelatin, polyethylene, polyester, phenolic resin, vinyl chloride-vinyl acetate copolymer, epoxy resin, polyvinylpyrrolidone, polyvinylpyridine, polyurethane, polyglutamic acid, polyacrylic acid. When two or more of these are combined for use herein, their blend ratio may be suitably determined.

The undercoat layer 4 may contain a silane-coupling agent such as vinyltrichlorosilane, vinyltrimethoxysilane, vinyltriethoxysilane, vinyl-tris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, β-3,4-epoxycyclohexyltrimethoxysilane.

For residual potential reduction and for environmental stability, an electron transport pigment may be mixed/dispersed in the undercoat layer 4. The electron transport pigment includes organic pigments such as perylene pigments, bisbenzimidazoleperylene pigments, polycyclic quinone pigments, indigo pigments and quinacridone pigments described in JP-A 47-30330; other organic pigments such as bisazo pigments and phthalocyanine pigments that have an electron-attracting substituent such as a cyano group, a nitro group, a nitroso group or a halogen atom; and inorganic pigments such as zinc oxide, titanium oxide.

Of those, preferred for use herein are perylene pigments, bisbenzimidazoleperylene pigments, polycyclic quinone pigments, zinc oxide and titanium oxide, as their electron mobility is high.

The pigment surface may be processed with a coupling agent or a binder resin such as those mentioned hereinabove for the purpose of controlling the dispersibility and the carrier transportability of the pigment.

If too much, the electron transport pigment may lower the strength of the undercoat layer 4 and may cause film defects. Therefore, the content of the pigment is preferably at most 95% by weight, more preferably at most 90% by weight based on the total solid content of the undercoat layer 4.

Preferably, various organic compound powder or inorganic compound powder is added to the undercoat layer 4 for the purpose of improving the electric properties and the light-scatterability of the layer. In particular, inorganic pigments, for example, white pigments such as titanium oxide, zinc oxide, zinc flower, zinc sulfide, lead white or lithopone, or body pigments such as alumina, calcium carbonate or barium sulfate, as well as polytetrafluoroethylene resin particles, benzoguanamine resin particles and styrene particles are effective.

Preferably, the particle size of the additive powder is from 0.01 to 2 μm. The additive powder is optionally added to the layer, if desired. Its amount is preferably from 10 to 90% by weight, more preferably from 30 to 80% by weight based on the total solid content of the undercoat layer 4.

The undercoat layer 4 is formed, using an undercoat layer-forming solution that contains the above-mentioned constitutive materials. The organic solvent to be used for the undercoat layer-forming solution may be any one that can dissolve the organic metal compound and the binder resin not causing gellation or aggregation when an electron transport pigment is mixed and/or dispersed in the solution.

The organic solvent may be any ordinary one, including, for example, methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene. One or more of these may be used herein either singly or as combined.

For mixing and/or dispersing the constitutive materials, any ordinary method may be employed, using, for example, a ball mill, a roll mill, a sand mill, an attritor, a shaking ball mill, a colloid mill or an ultrasonic paint shaker. Mixing and/or dispersing them may be effected in an organic solvent.

The coating method for forming the undercoat layer 4 may be any ordinary one, including, for example, a blade coating method, a wire bar coating method, a spraying method, a dipping method, a bead coating method, an air knife coating method, a curtain coating method.

Drying the layer may be effected at a temperature at which the solvent may be evaporated away to form a film. In particular, the conductive support 2 processed with an acid solution or processed for boehmite treatment may have an insufficient ability to cover the defects of the substrate, it is desirable that the undercoat layer 4 is formed on the support of the type.

Preferably, the thickness of the undercoat layer 4 is from 0.01 to 30 μm, more preferably from 0.05 to 30 μm, even more preferably from 0.1 to 30 μm, still more preferably from 0.2 to 25 μm.

The carrier generation layer 5 contains a carrier generation material and optionally a binder resin.

The carrier generation material may be any known one, including, for example, organic pigments, e.g., azo pigments such as bisazo pigments, trisazo pigments, condensed cyclic aromatic pigments such as dibromoanthanthrone pigments, as well as perylene pigments, pyrrolopyrole pigments, phthalocyanine pigments; and inorganic pigments such as trigonal system selenium, zinc oxide. In particular, when a light source having an exposure wavelength of from 380 to 500 nm is used, the carrier generation material is preferably any of metal or non-metal phthalocyanine pigments, trigonal system selenium, or dibromoanthanthrone. Above all, more preferred are hydroxygallium phthalocyanine as in JP-A 5-263007, 5-279591; chlorogallium phthalocyanine as in JP-A 5-98181; dichlorotin phthalocyanine as in JP-A 5-140472, 5-140473; and titanyl phthalocyanine as in JP-A4-189873, 5-43813.

The material may be selected from organic photoconductive polymers such as poly-N-vinylcarbazole, polyvinylanthracene, polyvinylpyrene and polysilane.

The binder resin is preferably an insulating resin, including, for example, polyvinylbutyral resins, polyarylate resins (e.g., bisphenol A/phthalic acid polycondensates), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, polyvinylpyrrolidone resins, to which, however, the invention is not limited. One or more such binder resins may be used herein either singly or as combined.

The carrier generation layer 5 may be formed in a mode of vapor deposition with a carrier generation material or in a mode of coating with a carrier generation layer-forming coating liquid that contains a carrier generation material and a binder resin. When the carrier generation layer 5 is formed by the use of such a carrier generation layer-forming coating liquid, then the blend ratio (by weight) of the carrier generation material to the binder resin is preferably from 10/1 to 1/10.

For dispersing the constitutive materials in the carrier generation layer-forming coating liquid, employable is any ordinary method such as a ball mill dispersion method, an attritor dispersion method, or a sand mill dispersion method. In this method, it is indispensable that the crystal form of the pigment does not change through the dispersion treatment. Preferably, the dispersed particles have a particle size of at most 0.5 μm, more preferably at most 0.3 μm, even more preferably at most 0.15 μm for more effective results.

Any ordinary organic solvent may be used for the dispersion, including, for example, methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene. One or more of these may be used herein either singly or as combined.

For forming the carrier generation layer 5 by the use of such a carrier generation layer-forming coating liquid, any ordinary coating method may be employed, including, for example, a blade coating method, a wire bar coating method, a spraying method, a dipping method, a bead coating method, an air knife coating method, a curtain coating method.

Preferably, the thickness of the carrier generation layer 5 is from 0.1 to 5 μm, more preferably from 0.2 to 2.0 μm.

The carrier transport layer 6 contains a carrier transport material and a binder resin, or contains carrier transport polymer material.

The carrier transport material includes electron-transporting compounds such as quinone compounds, e.g., p-benzoquinone, chloranil, bromanil, anthraquinone, tetracyanoquinodimethane compounds, fluorenone compounds e.g., 2,4,7-trinitrofluorenone, xanthone compounds, benzophenone compounds, cyanovinyl compounds, ethylene compounds; and hole-transporting compounds such as triarylamine compounds, benzidine compounds, arylalkane compounds, aryl-substituted ethylene compounds, stilbene compounds, anthracene compounds, hydrazone compounds. However, the invention is not limited to these. One or more such carrier transport materials may be used herein either singly or as combined.

In view of its mobility, the carrier transport material is preferably a compound of the following formula (IV-1), (IV-2) or (IV-3):

(IV-1)

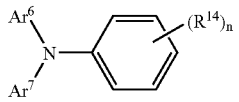

wherein $R^{14}$ represents a hydrogen atom or a methyl group; n indicates 1 or 2; $Ar^6$ and $Ar^7$ each independently represent a substituted or unsubstituted aryl group, $—C_6H_4—C(R^{18})=C(R^{19})(R^{20})$ or $—C_6H_4—CH=CH—CH=C(Ar)_2$, and the substituent for these is a halogen atom, an alkyl group having from 1 to 5 carbon atoms, an alkoxy group having from 1 to 5 carbon atoms, or a substituted amino group substituted with an alkyl group having from 1 to 3 carbon atoms; $R^{18}$, $R^{19}$ and $R^{20}$ each independently represent a hydrogen atom, a substituted or unsubstituted alkyl group, or a substituted or unsubstituted aryl group; and Ar represents a substituted or unsubstituted aryl group.

(IV-2)

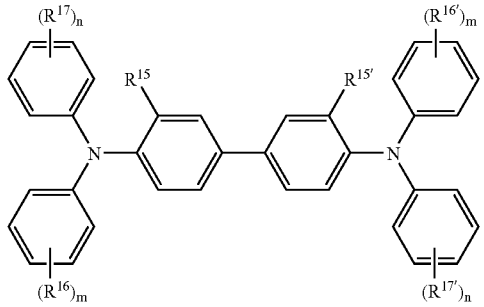

wherein $R^{15}$ and $R^{15'}$ each independently represent a hydrogen atom, a halogen atom, an alkyl group having from 1 to 5 carbon atoms, or an alkoxy group having from 1 to 5 carbon atoms; $R^{16}$, $R^{16'}$, $R^{17}$ and $R^{17'}$ each independently represent a halogen atom, an alkyl group having from 1 to 5 carbon atoms, an alkoxy group having from 1 to 5 carbon atoms, an amino group substituted with an alkyl group having 1 or 2 carbon atoms, a substituted or unsubstituted aryl group, $—C_6H_4—C(R^{18})=C(R^{19})R^{20})$ or $—C_6H_4—CH=CH—CH=C(Ar)_2$; $R^{18}$, $R^{19}$ and $R^{20}$ each independently represent a hydrogen atom, a substituted or unsubstituted alkyl group, or a substituted or unsubstituted aryl group; Ar represents a substituted or unsubstituted aryl group; and m and n each independently indicate an integer of from 0 to 2.

(IV-3)

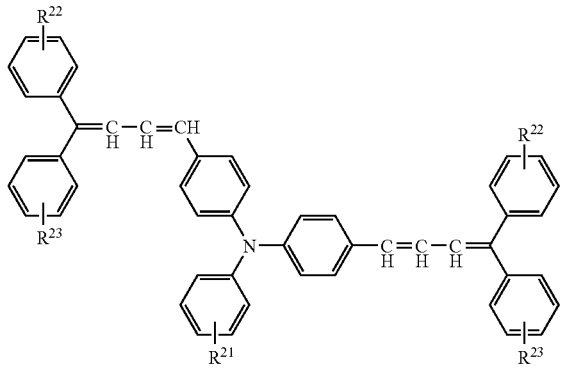

wherein $R^{21}$ represents a hydrogen atom, an alkyl group having from 1 to 5 carbon atoms, an alkoxy group having from 1 to 5 carbon atoms, a substituted or unsubstituted aryl group, or $—CH=CH—CH=C(Ar)_2$; Ar represents a substituted or unsubstituted aryl group; $R^{22}$ and $R^{23}$ each independently represent a hydrogen atom, a halogen atom, an alkyl group having from 1 to 5 carbon atoms, an alkoxy group having from 1 to 5 carbon atoms, an amino group substituted with an alkyl group having 1 or 2 carbon atoms, or a substituted or unsubstituted aryl group.

The binder resin for use in the carrier transport layer 6 includes polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, and polyester-type carrier transport polymer materials as in JP-A 8-176293 and 8-208820. One or more such binder resins may be used herein either singly or as combined. Preferably, the blend ratio (by weight) of the carrier transport material to the binder resin is from 10/1 to 1/5.

In this embodiment, a carrier transport polymer material may be used alone. The carrier transport polymer material may be any known one having a capability of carrier transportation, such as poly-N-vinylcarbazole and polysilane. In particular, materials as in JP-A 8-176293 and 8-208820 are especially preferred for use herein as having a high capability of carrier transportation.

The carrier transport polymer material may be used by itself for the constitutive material of the carrier transport layer 6, but may be combined with a binder resin such as that mentioned hereinabove for forming a film for the layer.

The carrier transport layer 6 may be formed by the use of the carrier transport layer-forming coating liquid that contains the above-mentioned constitutive material.

The solvent for the carrier transport layer-forming coating liquid may be any ordinary organic solvent, including, for example, aromatic hydrocarbons such as benzene, toluene, xylene, chlorobenzene; ketones such as acetone, 2-butanone; halogenated aliphatic hydrocarbons such as methylene chloride, chloroform, ethylene chloride; cyclic or linear ethers such as tetrahydrofuran, ethyl ether. One or more such solvents may be used herein either singly or as combined.

For the coating with the carrier transport layer-forming coating liquid, employable is any ordinary method such as a blade coating method, a wire bar coating method, a spraying method, a dipping method, a bead coating method, an air knife coating method or a curtain coating method.

Preferably, the thickness of the carrier transport layer 6 is from 5 to 50 μm, more preferably from 10 to 30 μm.

Additives such as antioxidant, light stabilizer and heat stabilizer may be added to the photosensitive layer 3 for the purpose of preventing the photoreceptor from being deteriorated by ozone or oxidizing gas generated in an image-forming apparatus or by light or heat applied thereto.

The antioxidant includes, for example, hindered phenols, hindered amines, paraphenylenediamine, arylalkanes, hydroquinone, spirochroman, spiroindanone and their derivatives, organic sulfur compounds and organic phosphorus compounds. The light stabilizer includes, for example, derivatives of benzophenone, benzotriazole, dithiocarbamate, tetramethylpiperidine.

The photosensitive layer 3 may contain at least one electron-accepting substance for the purpose of increasing the sensitivity, reducing the residual potential and reducing the fatigue thereof in repeated use.

The electron-accepting substance includes, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid. Of those, especially preferred are fluorenone compounds, quinone compounds, and benzene derivatives having an electron-attracting substituent such as Cl, CN or $NO_2$.

In the electrophotographic photoreceptor of this embodiment, the protective layer 7 contains at least one of a compound having a structure of formula (I) or a compound derived from that compound.

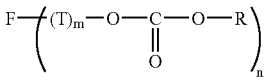

(I)

wherein F represents a hole-transporting, n-valent organic group; R independently represents an organic group having from 1 to 18 carbon atoms; T represents a divalent group; m indicates 0 or 1; and n indicates an integer of from 1 to 4. In the present embodiment, T is preferably a methylene group.

Of the compound having a structure of formula (I), more preferred is a compound having a structure of the following formula (II):

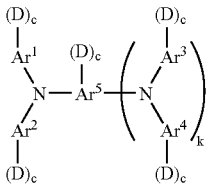

(II)

wherein $Ar^1$ to $Ar^4$ may be the same or different, each representing a substituted or unsubstituted aryl group; $Ar^5$ represents a substituted or unsubstituted aryl or arylene group; c independently indicates 0 or 1; k indicates 0 or 1; D represents a monovalent organic group of the following formula (III); and the total of c is from 1 to 4:

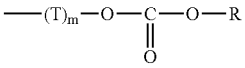

(III)

wherein R independently represents an organic group having from 1 to 18 carbon atoms; T represents a divalent group; and m indicates an integer of 0 or 1. In the present embodiment, T is preferably a methylene group.

Concretely, the substituted or unsubstituted aryl group for $Ar^1$ to $Ar^4$ in formula (II) is preferably an aryl group of the following formulae (1) to (7):

TABLE 1

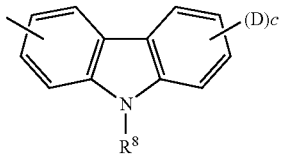

(1)

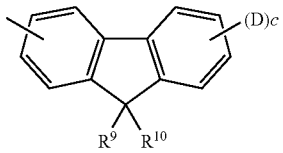

(2)

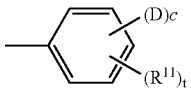

(3)

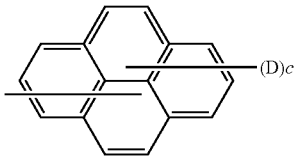

(4)

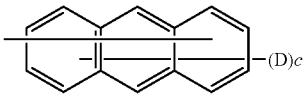

(5)

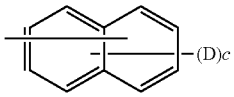

(6)

—Ar—(Z')s—Ar—(D)c (7)

In formulae (1) to (7), $R^8$ represents a hydrogen atom, an alkyl group having from 1 to 4 carbon atoms, an alkyl group having from 1 to 4 carbon atoms, an alkoxy group having from 1 to 4 carbon atoms, a phenyl group substituted by any of these or an unsubstituted phenyl group, or an aralkyl group having from 7 to 10 carbon atoms; $R^9$ to $R^{11}$ each independently represent a hydrogen atom, an alkyl group having from 1 to 4 carbon atoms, an alkoxy group having from 1 to 4 carbon atoms, an alkoxy group having from 1 to 4 carbon atoms, a phenyl group substituted by any of these or an unsubstituted phenyl group, an aralkyl group having from 7 to 10 carbon atoms, or a halogen atom; Ar represents a substituted or unsubstituted arylene group; D represents a structure of formula (III); c and s each indicate 0 or 1; and t indicates an integer of from 1 to 3.

Ar in the aryl group of formula (7) is preferably an arylene group of the following formula (8) or (9):

TABLE 2

| | |
|---|---|
| 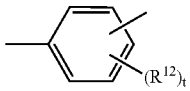 | (8) |
| 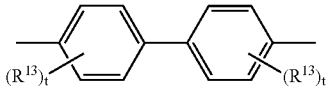 | (9) |

In formulae (8) and (9), $R^{12}$ and $R^{13}$ each independently represent a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, or a halogen atom; and t indicates an integer of from 1 to 3.

Z' in the aryl group of formula (7) is preferably a divalent group of the following formulae (10) to (17):

TABLE 3

| | |
|---|---|
| $—(CH_2)_q—$ | (10) |
| $—(CH_2CH_2O)_r—$ | (11) |
| 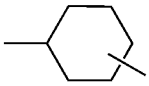 | (12) |
| 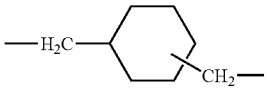 | (13) |
| 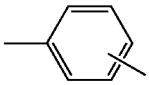 | (14) |
| 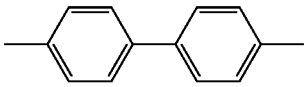 | (15) |
| 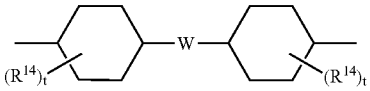 | (16) |
| 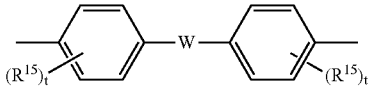 | (17) |

In formulae (10) to (17), $R^{14}$ and $R^{15}$ each independently represent a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, or a halogen atom; W represents a divalent group; q and r each indicate an integer of from 1 to 10; and t indicates an integer of from 1 to 3.

In formulae (16) and (17), W represents a divalent group of the following formulae (18) to (26). In formula (25), u indicates an integer of from 0 to 3.

TABLE 4

| | |
|---|---|
| $—CH_2—$ | (18) |
| $—C(CH_3)_2—$ | (19) |
| —O— | (20) |
| —S— | (21) |
| $—C(CF_3)_2—$ | (22) |
| $—Si(CH_3)_2—$ | (23) |
| 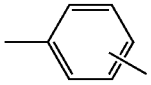 | (24) |
| 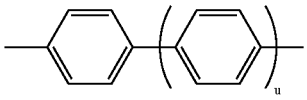 | (25) |
| 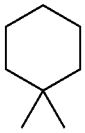 | (26) |

The concrete structure of $Ar^5$ in formula (II) is described. When k=0, then it corresponds to the concrete structure of $Ar^1$ to $Ar^4$ where m=1; and when k=1, then it corresponds to the concrete structure of $Ar^1$ to $Ar^4$ where m=0.

More concretely, the compound of formula (I) includes the following compounds (I-1) to (I-46). In the following Tables, Me or the bond with no substituent indicates a methyl group, and Et indicates an ethyl group.

TABLE 5

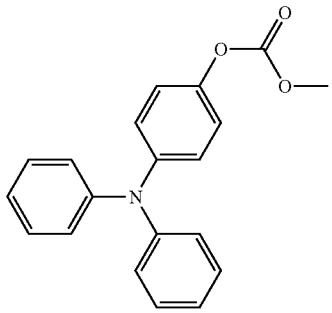

(I-1)

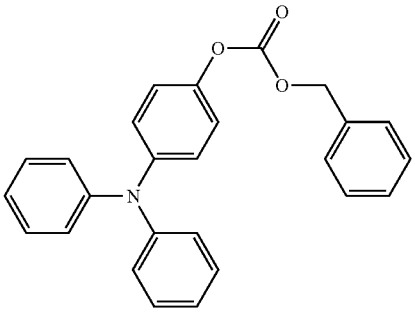

(I-2)

TABLE 5-continued
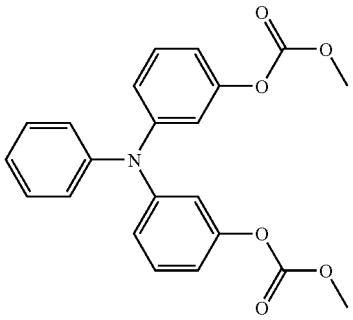
(I-3)
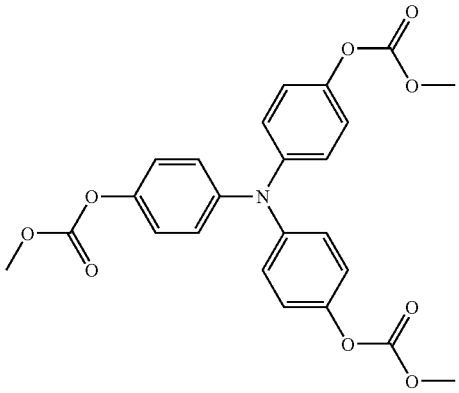
(I-4)
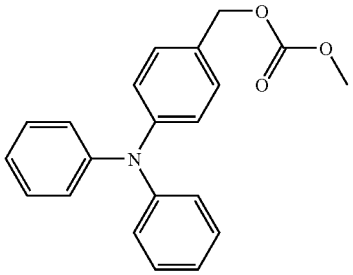
(I-5)
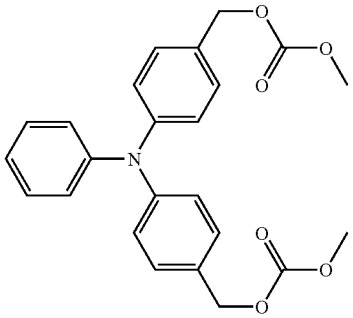
(I-6)
TABLE 5-continued
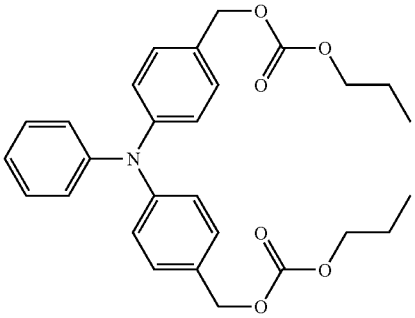
(I-7)
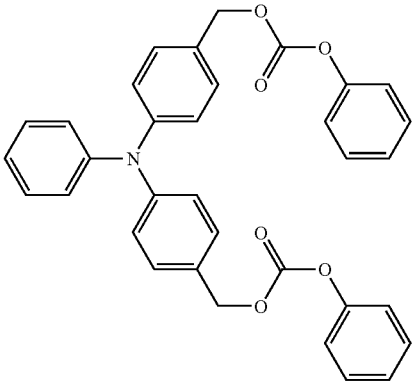
(I-8)
TABLE 6
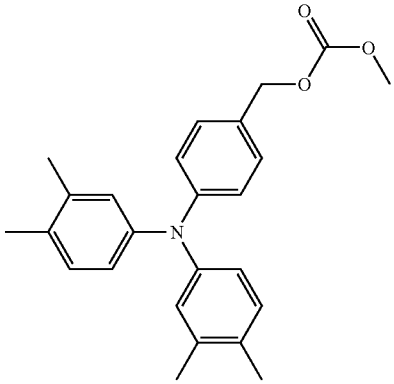
(I-9)

TABLE 6-continued
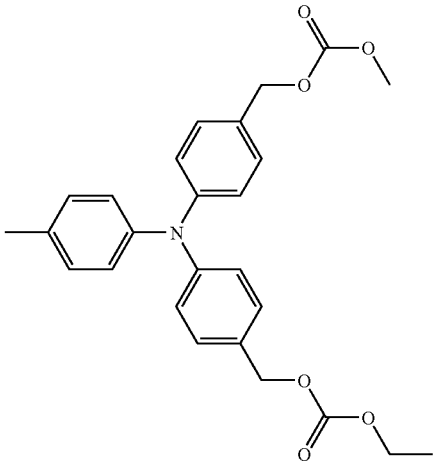
(I-10)
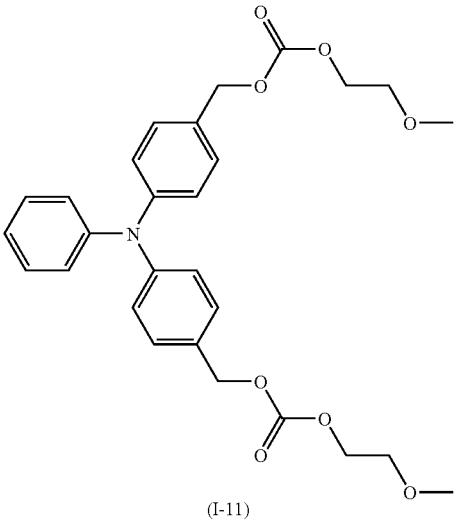
(I-11)
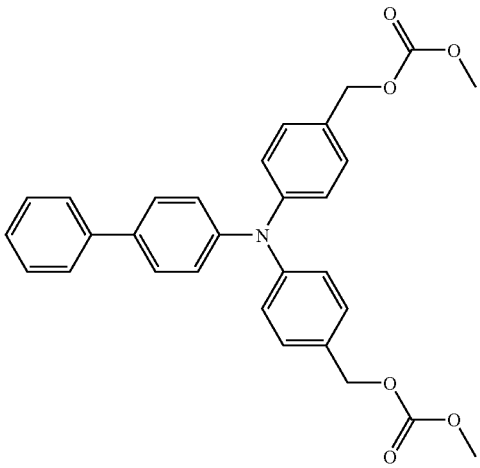
(I-12)
TABLE 6-continued
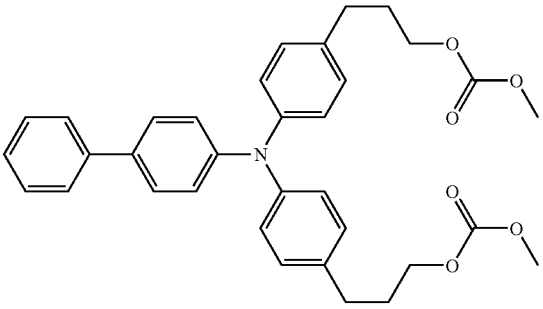
(I-13)
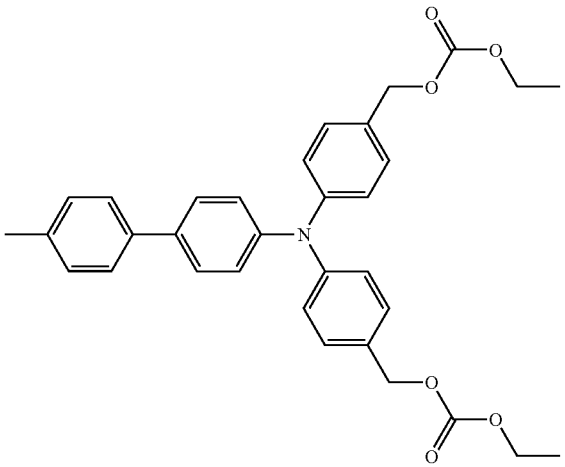
(I-14)

TABLE 7
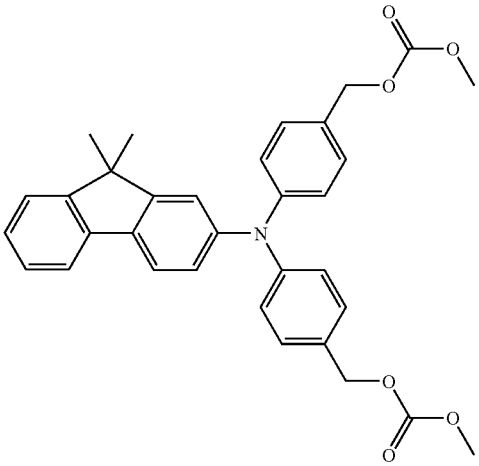
(I-15)
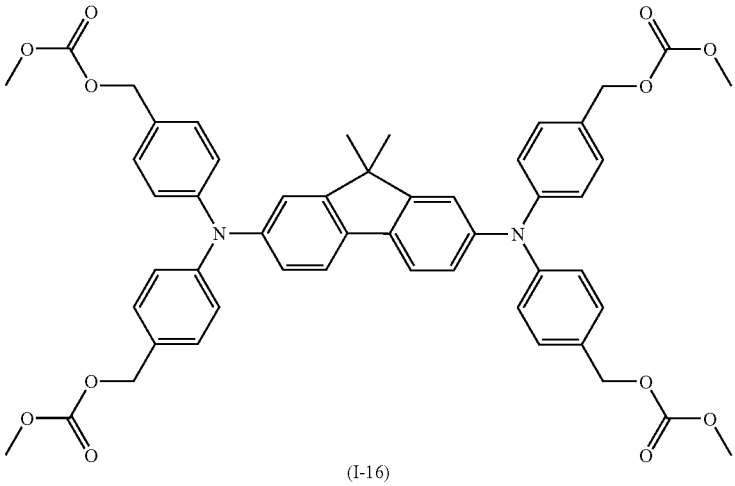
(I-16)
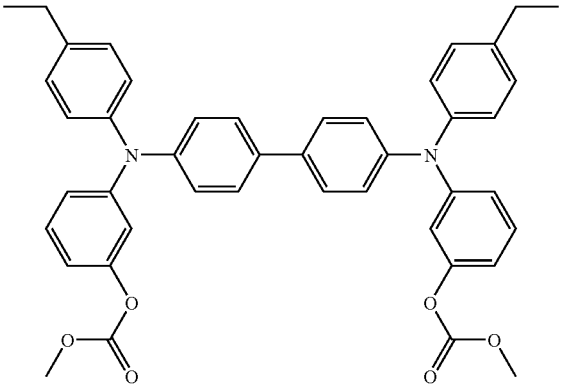
(I-17)

TABLE 7-continued
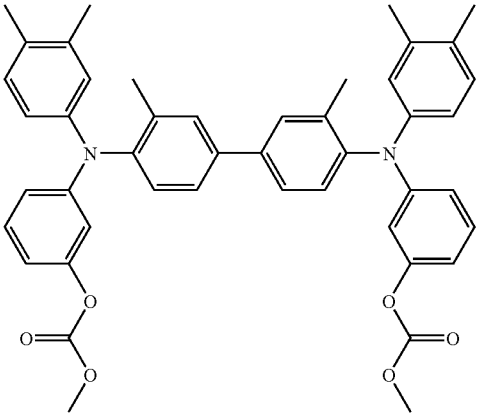
(I-18)
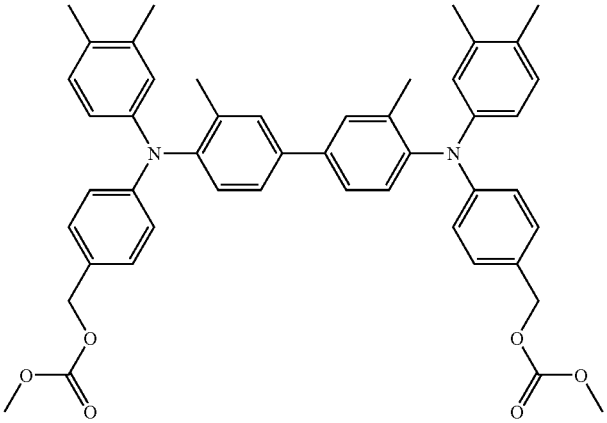
(I-19)
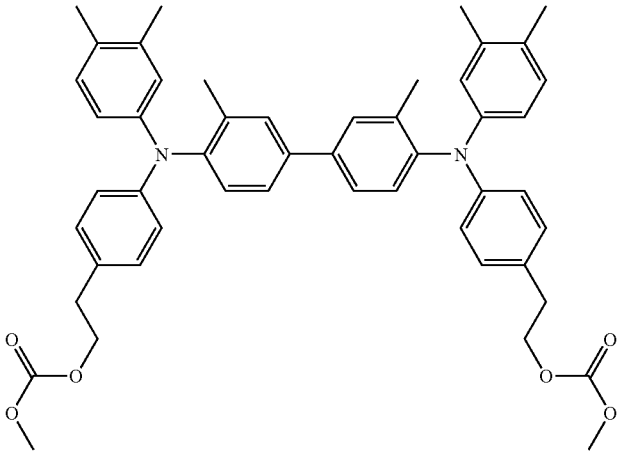
(I-20)

TABLE 8
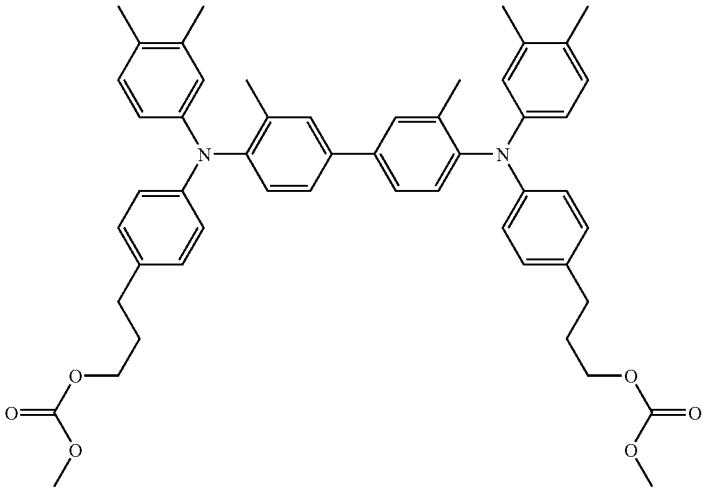
(I-21)
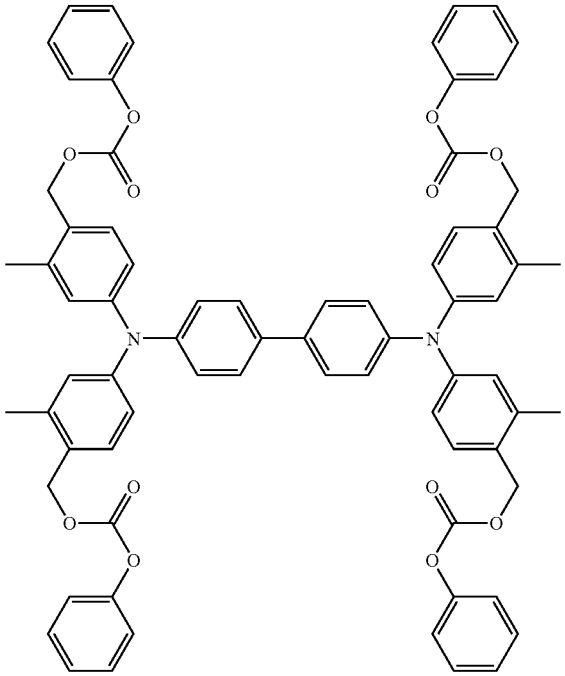
(I-22)

TABLE 8-continued
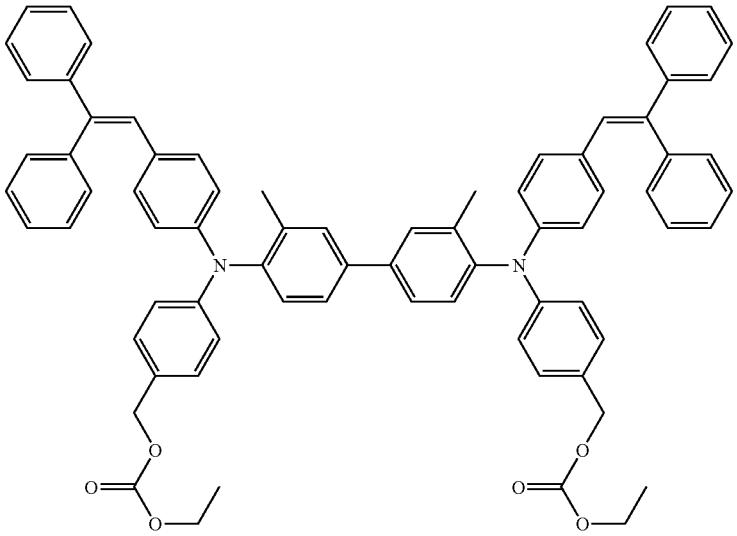
(I-23)
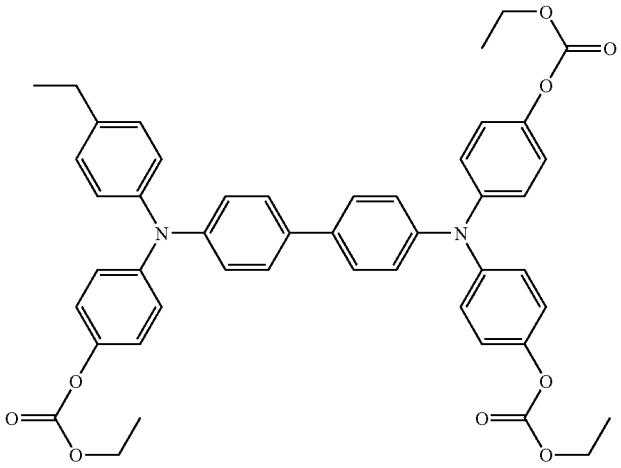
(I-24)
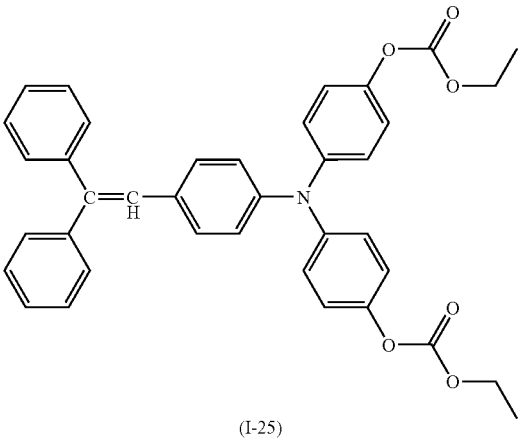
(I-25)

TABLE 8-continued
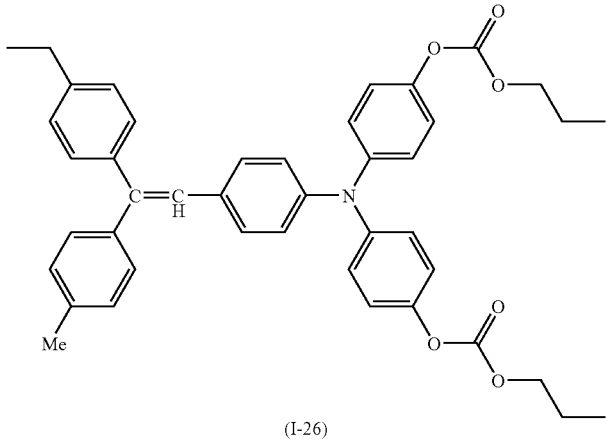
(I-26)
TABLE 9
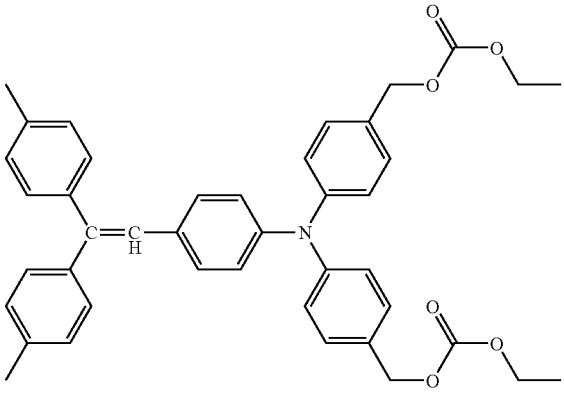
(I-27)
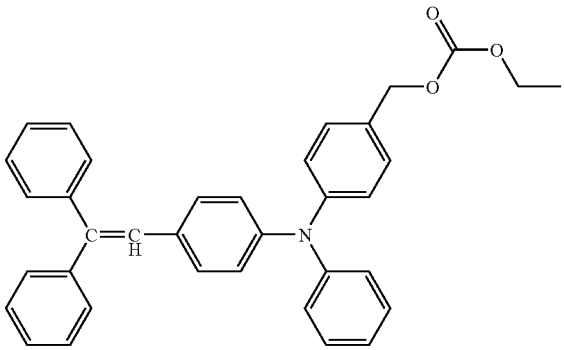
(I-28)
TABLE 9-continued
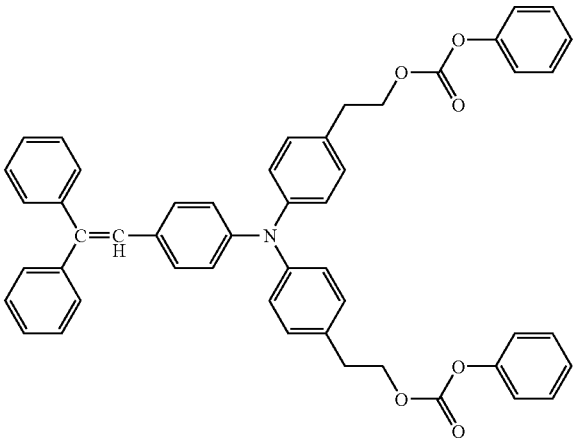
(I-29)
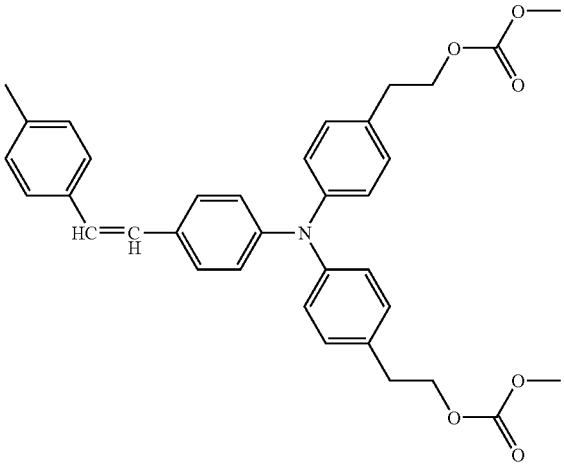
(I-30)

TABLE 9-continued
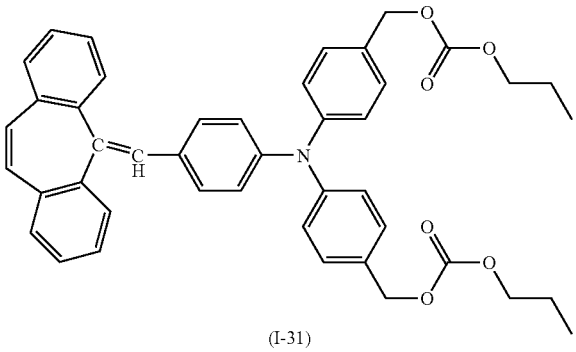
(I-31)
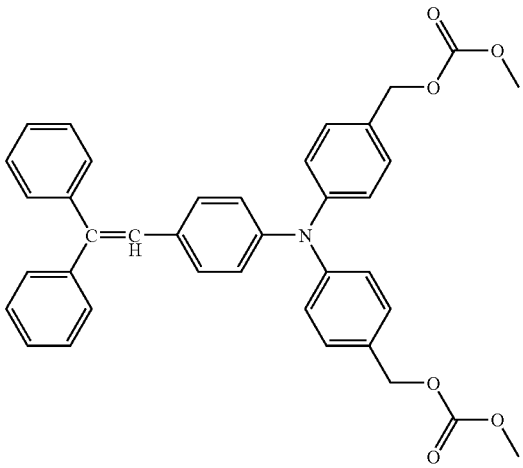
(I-32)
TABLE 10
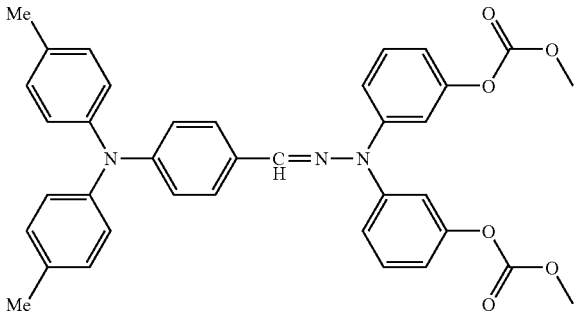
(I-33)
TABLE 10-continued
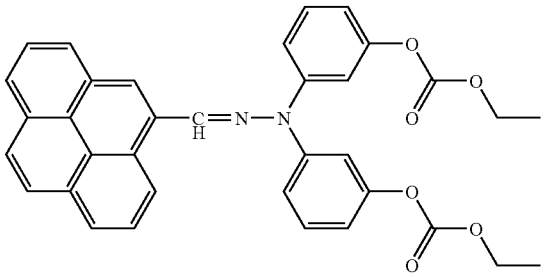
(I-34)
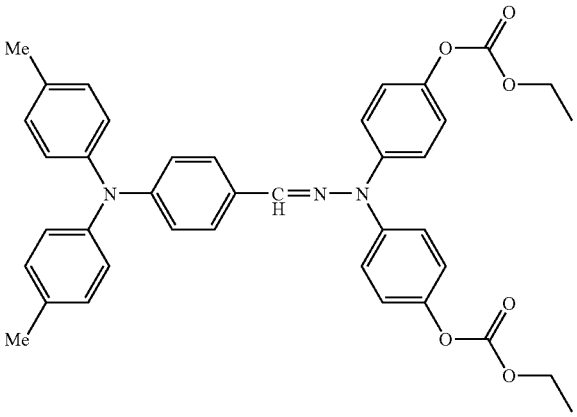
(I-35)
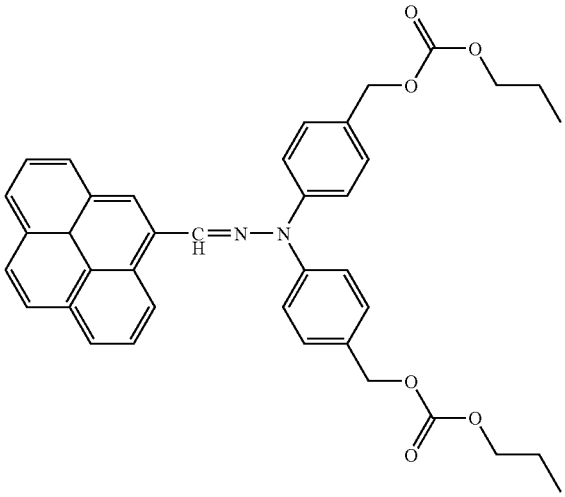
(I-36)

TABLE 10-continued
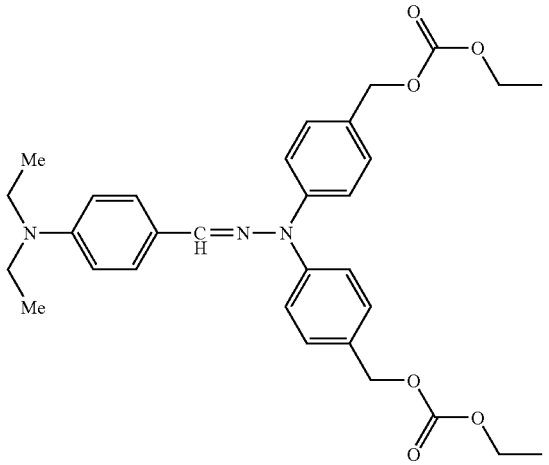
(I-37)
TABLE 11
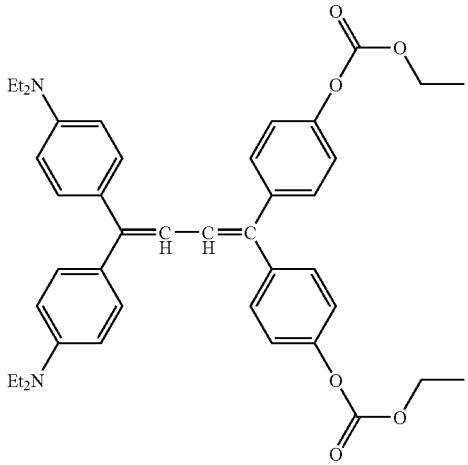
(I-39)
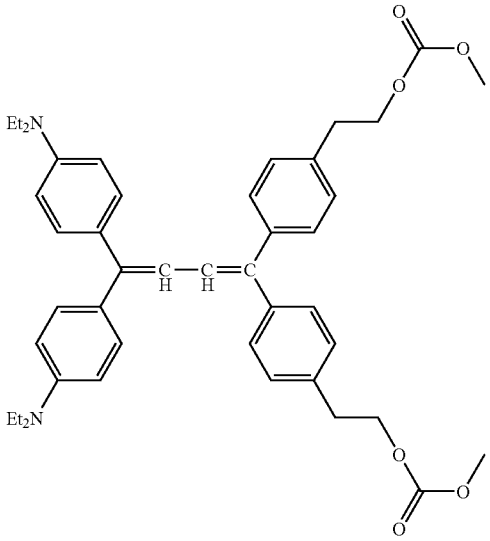
(I-40)

TABLE 11-continued
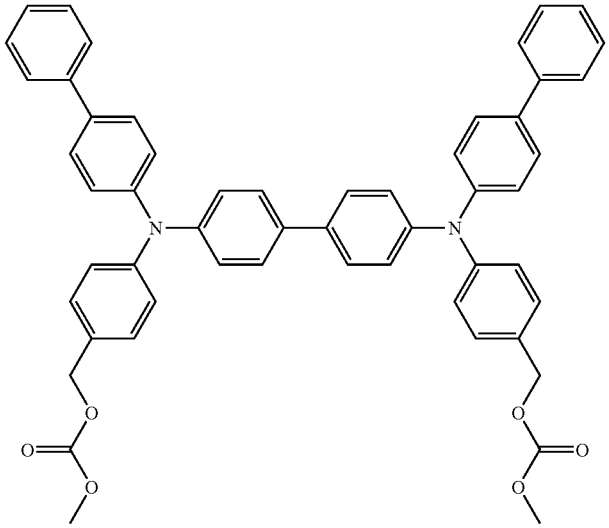
(I-41)
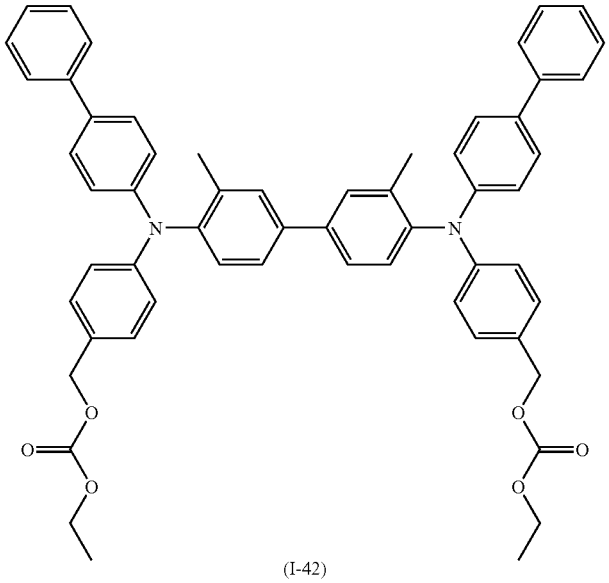
(I-42)

TABLE 11-continued
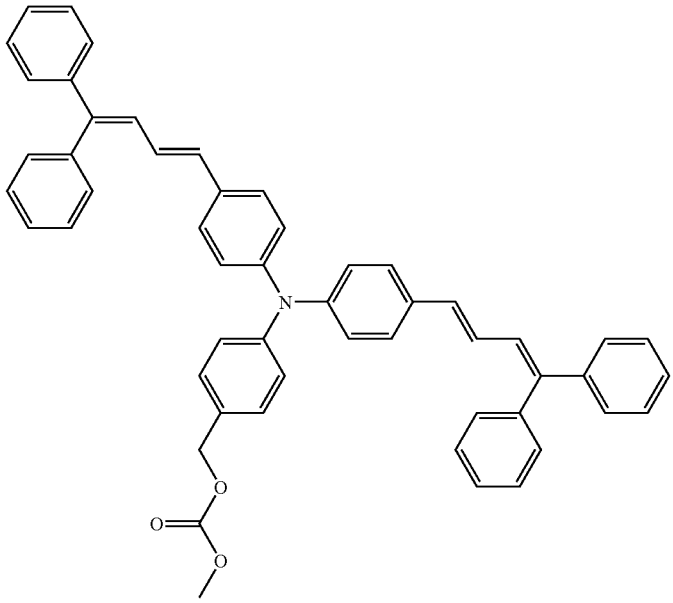
(I-43)
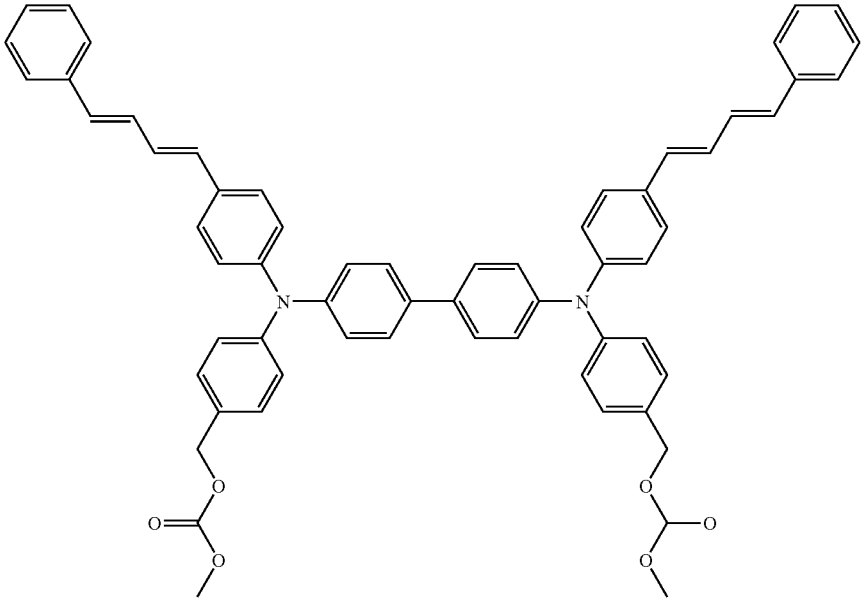
(I-44)

TABLE 12

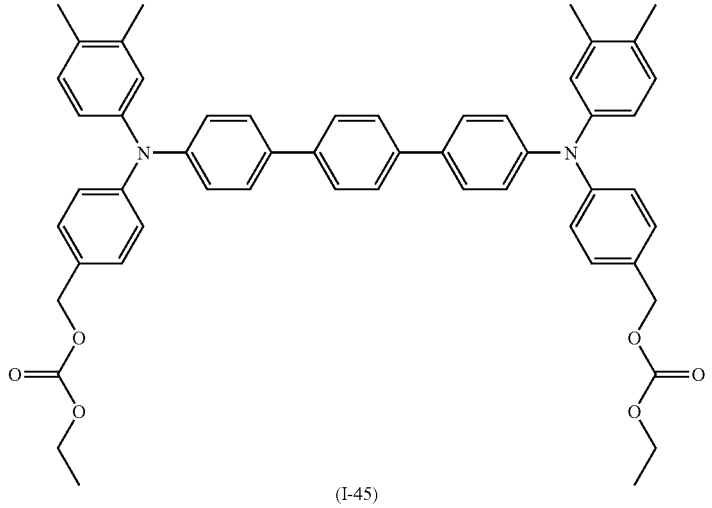

(I-45)

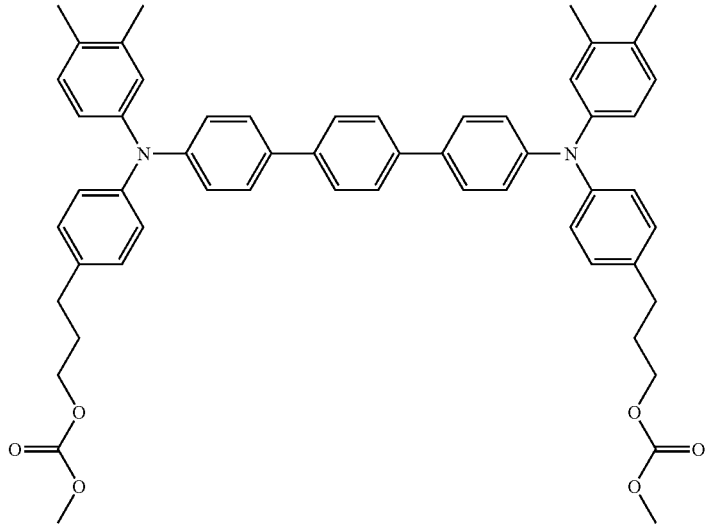

(I-46)

In the present embodiment, the protective layer 7 preferably comprises one or more of charge-transporting compounds of the general formula represented by the following general formula (I-A) or compounds derived therefrom among the compounds having a structure represented by the general formula (I).

(I-A)

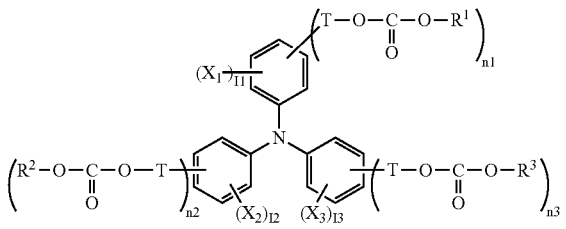

wherein $X_1$, $X_2$ and $X_3$ each independently represents a hydrogen atom, a halogen atom, an alkyl group having from 1 to 10 carbon atoms, an alkoxyl group having from 1 to 10 carbon atoms, a substituted or unsubstituted aryl group, an aralkyl group having from 7 to 10 carbon atoms, a substituted or unsubstituted styryl group, a substituted or unsubstituted butadiene group or a substituted or unsubstituted hydrazone group; l1, l2 and l3 each represents an integer of from 0 to 2; $R^1$, $R^2$ and $R^3$ each independently represents an organic group having from 1 to 18 carbon atoms; T represents a methylene group; and n1, n2 and n3 each represents 0 or 1, and n1, n2 and n3 satisfies the relationship $(n1+n2+n3) \geqq 1$.

In the charge-transporting compound of the invention, the sum of n1, n2 and n3 in the general formula (I-A) is preferably 2 or more. In this arrangement, when used in combination with a curable resin, the charge-transporting compound of the invention can easily form a rigider film, making it possible to provide the resulting organic electronic devices with a longer life. In particular, when the charge-transporting compound of the invention is applied to the protective layer of electrophotographic photoreceptor, it can be further assured that an electrophotographic photoreceptor having a high image quality and a prolonged life can be realized.

In the general formula (I-A), $R_1$, $R_2$ and $R_3$ each are preferably an organic group represented by —$CH_2$—$R_4$ (in which $R_4$ represents a hydrogen atom, halogen atom or an organic group having from 1 to 17 carbon atoms).

The aforementioned charge-transporting compound can satisfy both the requirements for pot life of coating solution and high reactivity during the formation of functional layer, making it possible to form a functional layer excellent in electrical properties and mechanical strength while sufficiently assuring the productivity of organic electronic devices, particularly electrophotographic photoreceptor.

The charge-transporting compound of the general formula (I-A) wherein $R_1$, $R_2$ and $R_3$ each are a phenyl group is often unstable at room temperature and thus tends to be difficultly handled.

Examples of the compound represented by the general formula (I-A) include exemplary compounds 1 to 225 set forth in Tables 13 to 24 below, but the charge-transporting compound of the invention is not limited thereto.

TABLE 13

| Compound | X1 | X2 | X3 | l1 | l2 | l3 | T | R1 | R2 | R3 | n1 | n2 | n3 |
|---|---|---|---|---|---|---|---|---|---|---|---|---|---|
| 1 | — | — | — | 0 | 0 | 0 | 4-p, —$CH_2$— | —$CH_3$ | — | — | 1 | 0 | 0 |
| 2 | — | — | — | 0 | 0 | 0 | 4-p, —$CH_2$— | —$CH_2CH_3$ | — | — | 1 | 0 | 0 |
| 3 | — | — | — | 0 | 0 | 0 | 4-p, —$CH_2$— | —$CH_2CH_2CH_3$ | — | — | 1 | 0 | 0 |
| 4 | — | — | — | 0 | 0 | 0 | 4-p, —$CH_2$— | —$(CH_2)_4CH_3$ | — | — | 1 | 0 | 0 |
| 5 | — | — | — | 0 | 0 | 0 | 4-p, —$CH_2$— | —$CH_2CH(CH_3)_2$ | — | — | 1 | 0 | 0 |
| 6 | — | — | — | 0 | 0 | 0 | 4-p, —$CH_2$— | —$CH_2CH_2OCH_3$ | — | — | 1 | 0 | 0 |
| 7 | — | — | — | 0 | 0 | 0 | 4-p, —$CH_2$— | —$CH_2CH_2Cl$ | — | — | 1 | 0 | 0 |
| 8 | — | — | — | 0 | 0 | 0 | 4-p, —$CH_2$— | —Ph | — | — | 1 | 0 | 0 |
| 9 | — | — | — | 0 | 0 | 0 | 4-p, —$CH_2$— | —Bzl | — | — | 1 | 0 | 0 |
| 10 | — | 4-p, —$CH_3$ | — | 0 | 1 | 0 | 4-p, —$CH_2$— | —$CH_3$ | — | — | 1 | 0 | 0 |
| 11 | — | 4-p, —$CH_3$ | — | 0 | 1 | 0 | 4-p, —$CH_2$— | —$CH_2CH_3$ | — | — | 1 | 0 | 0 |
| 12 | — | 4-p, —$CH_3$ | — | 0 | 1 | 0 | 4-p, —$CH_2$— | —$CH_2CH_2CH_3$ | — | — | 1 | 0 | 0 |
| 13 | — | 4-p, —$CH_3$ | — | 0 | 1 | 0 | 4-p, —$CH_2$— | —$(CH_2)_4CH_3$ | — | — | 1 | 0 | 0 |
| 14 | — | 4-p, —$CH_3$ | — | 0 | 1 | 0 | 4-p, —$CH_2$— | —$CH_2CH(CH_3)_2$ | — | — | 1 | 0 | 0 |
| 15 | — | 4-p, —$CH_3$ | — | 0 | 1 | 0 | 4-p, —$CH_2$— | —$CH_2CH_2OCH_3$ | — | — | 1 | 0 | 0 |
| 16 | — | 4-p, —$CH_3$ | — | 0 | 1 | 0 | 4-p, —$CH_2$— | —$CH_2CH_2Cl$ | — | — | 1 | 0 | 0 |
| 17 | — | 4-p, —$CH_3$ | — | 0 | 1 | 0 | 4-p, —$CH_2$— | —Ph | — | — | 1 | 0 | 0 |
| 18 | — | 4-p, —$CH_3$ | — | 0 | 1 | 0 | 4-p, —$CH_2$— | —Bzl | — | — | 1 | 0 | 0 |
| 19 | — | 3-p, —$CH_3$ | — | 0 | 1 | 0 | 4-p, —$CH_2$— | —$CH_3$ | — | — | 1 | 0 | 0 |
| 20 | — | 3-p, —$CH_3$ | — | 0 | 1 | 0 | 4-p, —$CH_2$— | —$CH_2CH_3$ | — | — | 1 | 0 | 0 |
| 21 | — | 3-p, —$CH_3$ | — | 0 | 1 | 0 | 4-p, —$CH_2$— | —$CH_2CH_2CH_3$ | — | — | 1 | 0 | 0 |
| 22 | — | 3-p, —$CH_3$ | — | 0 | 1 | 0 | 4-p, —$CH_2$— | —$(CH_2)_4CH_3$ | — | — | 1 | 0 | 0 |
| 23 | — | 3-p, —$CH_3$ | — | 0 | 1 | 0 | 4-p, —$CH_2$— | —$CH_2CH(CH_3)_2$ | — | — | 1 | 0 | 0 |
| 24 | — | 3-p, —$CH_3$ | — | 0 | 1 | 0 | 4-p, —$CH_2$— | —$CH_2CH_2OCH_3$ | — | — | 1 | 0 | 0 |
| 25 | — | 3-p, —$CH_3$ | — | 0 | 1 | 0 | 4-p, —$CH_2$— | —$CH_2CH_2Cl$ | — | — | 1 | 0 | 0 |
| 26 | — | 3-p, —$CH_3$ | — | 0 | 1 | 0 | 4-p, —$CH_2$— | —Ph | — | — | 1 | 0 | 0 |
| 27 | — | 3-p, —$CH_3$ | — | 0 | 1 | 0 | 4-p, —$CH_2$— | —Bzl | — | — | 1 | 0 | 0 |
| 28 | — | 4-p, —$OCH_3$ | — | 0 | 1 | 0 | 4-p, —$CH_2$— | —$CH_3$ | — | — | 1 | 0 | 0 |
| 29 | — | 4-p, —$OCH_3$ | — | 0 | 1 | 0 | 4-p, —$CH_2$— | —$CH_2CH_3$ | — | — | 1 | 0 | 0 |

3-p: 3-position,
4-p: 4-position,

—Ph: 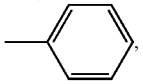 ,

—Bzl: —$CH_2$— 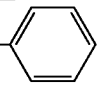

TABLE 14

| Compound | X1 | X2 | X3 | l1 | l2 | l3 | T | R1 | R2 | R3 | n1 | n2 | n3 |
|---|---|---|---|---|---|---|---|---|---|---|---|---|---|
| 30 | — | 4-p, —$OCH_3$ | — | 0 | 1 | 0 | 4-p, —$CH_2$— | —$CH_2CH_2CH_3$ | — | — | 1 | 0 | 0 |
| 31 | — | 4-p, —$OCH_3$ | — | 0 | 1 | 0 | 4-p, —$CH_2$— | —$(CH_2)_4CH_3$ | — | — | 1 | 0 | 0 |
| 32 | — | 4-p, —$OCH_3$ | — | 0 | 1 | 0 | 4-p, —$CH_2$— | —$CH_2CH(CH_3)_2$ | — | — | 1 | 0 | 0 |
| 33 | — | 4-p, —$OCH_3$ | — | 0 | 1 | 0 | 4-p, —$CH_2$— | —$CH_2CH_2OCH_3$ | — | — | 1 | 0 | 0 |
| 34 | — | 4-p, —$OCH_3$ | — | 0 | 1 | 0 | 4-p, —$CH_2$— | —$CH_2CH_2Cl$ | — | — | 1 | 0 | 0 |
| 35 | — | 4-p, —$OCH_3$ | — | 0 | 1 | 0 | 4-p, —$CH_2$— | —Ph | — | — | 1 | 0 | 0 |
| 36 | — | 4-p, —$OCH_3$ | — | 0 | 1 | 0 | 4-p, —$CH_2$— | —Bzl | — | — | 1 | 0 | 0 |
| 37 | — | 4-p, —$CH_2CH_3$ | — | 0 | 1 | 0 | 4-p, —$CH_2$— | —$CH_3$ | — | — | 1 | 0 | 0 |
| 38 | — | 4-p, —$CH_2CH_3$ | — | 0 | 1 | 0 | 4-p, —$CH_2$— | —$CH_2CH_3$ | — | — | 1 | 0 | 0 |
| 39 | — | 4-p, —$CH_2CH_3$ | — | 0 | 1 | 0 | 4-p, —$CH_2$— | —$CH_2CH_2CH_3$ | — | — | 1 | 0 | 0 |
| 40 | — | 4-p, —$CH_2CH_3$ | — | 0 | 1 | 0 | 4-p, —$CH_2$— | —$(CH_2)_4CH_3$ | — | — | 1 | 0 | 0 |
| 41 | — | 4-p, —$CH_2CH_3$ | — | 0 | 1 | 0 | 4-p, —$CH_2$— | —$CH_2CH(CH_3)_2$ | — | — | 1 | 0 | 0 |
| 42 | — | 4-p, —$CH_2CH_3$ | — | 0 | 1 | 0 | 4-p, —$CH_2$— | —$CH_2CH_2OCH_3$ | — | — | 1 | 0 | 0 |
| 43 | — | 4-p, —$CH_2CH_3$ | — | 0 | 1 | 0 | 4-p, —$CH_2$— | —$CH_2CH_2Cl$ | — | — | 1 | 0 | 0 |
| 44 | — | 4-p, —$CH_2CH_3$ | — | 0 | 1 | 0 | 4-p, —$CH_2$— | —Ph | — | — | 1 | 0 | 0 |
| 45 | — | 4-p, —$CH_2CH_3$ | — | 0 | 1 | 0 | 4-p, —$CH_2$— | —Bzl | — | — | 1 | 0 | 0 |
| 46 | — | 4-p, —Ph | — | 0 | 1 | 0 | 4-p, —$CH_2$— | —$CH_3$ | — | — | 1 | 0 | 0 |

TABLE 14-continued

| Compound | X1 | X2 | X3 | l1 | l2 | l3 | T | R1 | R2 | R3 | n1 | n2 | n3 |
|---|---|---|---|---|---|---|---|---|---|---|---|---|---|
| 47 | — | 4-p, —Ph | — | 0 | 1 | 0 | 4-p, —$CH_2$— | —$CH_2CH_3$ | — | — | 1 | 0 | 0 |
| 48 | — | 4-p, —Ph | — | 0 | 1 | 0 | 4-p, —$CH_2$— | —$CH_2CH_2CH_3$ | — | — | 1 | 0 | 0 |
| 49 | — | 4-p, —Ph | — | 0 | 1 | 0 | 4-p, —$CH_2$— | —$(CH_2)_4CH_3$ | — | — | 1 | 0 | 0 |
| 50 | — | 4-p, —Ph | — | 0 | 1 | 0 | 4-p, —$CH_2$— | —$CH_2CH(CH_3)_2$ | — | — | 1 | 0 | 0 |
| 51 | — | 4-p, —Ph | — | 0 | 1 | 0 | 4-p, —$CH_2$— | —$CH_2CH_2OCH_3$ | — | — | 1 | 0 | 0 |
| 52 | — | 4-p, —Ph | — | 0 | 1 | 0 | 4-p, —$CH_2$— | —$CH_2CH_2Cl$ | — | — | 1 | 0 | 0 |

4-p: 4-position,

—Ph: 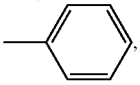 ,

—Bzl: —$CH_2$— 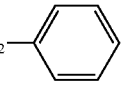

TABLE 15

| Compound | X1 | X2 | X3 | l1 | l2 | l3 | T | R1 | R2 | R3 | n1 | n2 | n3 |
|---|---|---|---|---|---|---|---|---|---|---|---|---|---|
| 53 | — | 4-p, —Ph | — | 0 | 1 | 0 | 4-p, —$CH_2$— | —Ph | — | — | 1 | 0 | 0 |
| 54 | — | 4-p, —Ph | — | 0 | 1 | 0 | 4-p, —$CH_2$— | —Bzl | — | — | 1 | 0 | 0 |
| 55 | — | 4-p, —CH═CH—Ph | — | 0 | 1 | 0 | 4-p, —$CH_2$— | —$CH_3$ | — | — | 1 | 0 | 0 |
| 56 | — | 4-p, —CH═CH—Ph | — | 0 | 1 | 0 | 4-p, —$CH_2$— | —$CH_2CH_3$ | — | — | 1 | 0 | 0 |
| 57 | — | 4-p, —CH═CH—Ph | — | 0 | 1 | 0 | 4-p, —$CH_2$— | —$CH_2CH_2CH_3$ | — | — | 1 | 0 | 0 |
| 58 | — | 4-p, —CH═CH—Ph | — | 0 | 1 | 0 | 4-p, —$CH_2$— | —$(CH_2)_4CH_3$ | — | — | 1 | 0 | 0 |
| 59 | — | 4-p, —CH═CH—Ph | — | 0 | 1 | 0 | 4-p, —$CH_2$— | —$CH_2CH(CH_3)_2$ | — | — | 1 | 0 | 0 |
| 60 | — | 4-p, —CH═CH—Ph | — | 0 | 1 | 0 | 4-p, —$CH_2$— | —$CH_2CH_2OCH_3$ | — | — | 1 | 0 | 0 |
| 61 | — | 4-p, —CH═CH—Ph | — | 0 | 1 | 0 | 4-p, —$CH_2$— | —$CH_2CH_2Cl$ | — | — | 1 | 0 | 0 |
| 62 | — | 4-p, —CH═CH—Ph | — | 0 | 1 | 0 | 4-p, —$CH_2$— | —Ph | — | — | 1 | 0 | 0 |
| 63 | — | 4-p, —CH═CH—Ph | — | 0 | 1 | 0 | 4-p, —$CH_2$— | —Bzl | — | — | 1 | 0 | 0 |
| 64 | — | 4-p, —CH═C$(Ph)_2$ | — | 0 | 1 | 0 | 4-p, —$CH_2$— | —$CH_3$ | — | — | 1 | 0 | 0 |
| 65 | — | 4-p, —CH═C$(Ph)_2$ | — | 0 | 1 | 0 | 4-p, —$CH_2$— | —$CH_2CH_3$ | — | — | 1 | 0 | 0 |
| 66 | — | 4-p, —CH═C$(Ph)_2$ | — | 0 | 1 | 0 | 4-p, —$CH_2$— | —$CH_2CH_2CH_3$ | — | — | 1 | 0 | 0 |

4-p: 4-position,

—Ph: 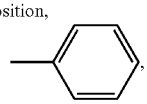 ,

—Bzl: —$CH_2$— 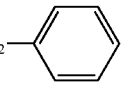

TABLE 16

| Compound | x1 | X2 | X3 | l1 | l2 | l3 | T | R1 | R2 | R3 | n1 | n2 | n3 |
|---|---|---|---|---|---|---|---|---|---|---|---|---|---|
| 67 | — | 4-p, —CH═C$(Ph)_2$ | — | 0 | 1 | 0 | 4-p, —$CH_2$— | —$(CH_2)_4CH_3$ | — | — | 1 | 0 | 0 |
| 68 | — | 4-p, —CH═C$(Ph)_2$ | — | 0 | 1 | 0 | 4-p, —$CH_2$— | —$CH_2CH(CH_3)_2$ | — | — | 1 | 0 | 0 |
| 69 | — | 4-p, —CH═C$(Ph)_2$ | — | 0 | 1 | 0 | 4-p, —$CH_2$— | —$CH_2CH_2OCH_3$ | — | — | 1 | 0 | 0 |
| 70 | — | 4-p, —CH═C$(Ph)_2$ | — | 0 | 1 | 0 | 4-p, —$CH_2$— | —$CH_2CH_2Cl$ | — | — | 1 | 0 | 0 |
| 71 | — | 4-p, —CH═C$(Ph)_2$ | — | 0 | 1 | 0 | 4-p, —$CH_2$— | —Ph | — | — | 1 | 0 | 0 |
| 72 | — | 4-p, —CH═C$(Ph)_2$ | — | 0 | 1 | 0 | 4-p, —$CH_2$— | —Bzl | — | — | 1 | 0 | 0 |
| 73 | — | 4-p, —$CH_3$ | 4-p, —$CH_3$ | 0 | 1 | 1 | 4-p, —$CH_2$— | —$CH_3$ | — | — | 1 | 0 | 0 |
| 74 | — | 4-p, —$CH_3$ | 4-p, —$CH_3$ | 0 | 1 | 1 | 4-p, —$CH_2$— | —$CH_2CH_3$ | — | — | 1 | 0 | 0 |
| 75 | — | 4-p, —$CH_3$ | 4-p, —$CH_3$ | 0 | 1 | 1 | 4-p, —$CH_2$— | —$CH_2CH_2CH_3$ | — | — | 1 | 0 | 0 |
| 76 | — | 4-p, —$CH_3$ | 4-p, —$CH_3$ | 0 | 1 | 1 | 4-p, —$CH_2$— | —$(CH_2)_4CH_3$ | — | — | 1 | 0 | 0 |
| 77 | — | 4-p, —$CH_3$ | 4-p, —$CH_3$ | 0 | 1 | 1 | 4-p, —$CH_2$— | —$CH_2CH(CH_3)_2$ | — | — | 1 | 0 | 0 |
| 78 | — | 4-p, —$CH_3$ | 4-p, —$CH_3$ | 0 | 1 | 1 | 4-p, —$CH_2$— | —$CH_2CH_2OCH_3$ | — | — | 1 | 0 | 0 |

TABLE 16-continued

| Compound | x1 | X2 | X3 | l1 | l2 | l3 | T | R1 | R2 | R3 | n1 | n2 | n3 |
|---|---|---|---|---|---|---|---|---|---|---|---|---|---|
| 79 | — | 4-p, —$CH_3$ | 4-p, —$CH_3$ | 0 | 1 | 1 | 4-p, —$CH_2$— | —$CH_2CH_2Cl$ | — | — | 1 | 0 | 0 |
| 80 | — | 4-p, —$CH_3$ | 4-p, —$CH_3$ | 0 | 1 | 1 | 4-p, —$CH_2$— | —Ph | — | — | 1 | 0 | 0 |
| 81 | — | 4-p, —$CH_3$ | 4-p, —$CH_3$ | 0 | 1 | 1 | 4-p, —$CH_2$— | —Bzl | — | — | 1 | 0 | 0 |
| 82 | — | 4-p, —$OCH_3$ | 4-p, —$OCH_3$ | 0 | 1 | 1 | 4-p, —$CH_2$— | —$CH_3$ | — | — | 1 | 0 | 0 |
| 83 | — | 4-p, —$OCH_3$ | 4-p, —$OCH_3$ | 0 | 1 | 1 | 4-p, —$CH_2$— | —$CH_2CH_3$ | — | — | 1 | 0 | 0 |
| 84 | — | 4-p, —$OCH_3$ | 4-p, —$OCH_3$ | 0 | 1 | 1 | 4-p, —$CH_2$— | —$CH_2CH_2CH_3$ | — | — | 1 | 0 | 0 |

4-p: 4-position,

—Ph: 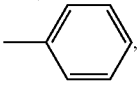 ,

—Bzl: 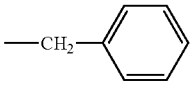

TABLE 17

| Compound | X1 | X2 | X3 | l1 | l2 | l3 | T | R1 | R2 | R3 | n1 | n2 | n3 |
|---|---|---|---|---|---|---|---|---|---|---|---|---|---|
| 85 | — | 4-p, —$OCH_3$ | 4-p, —$OCH_3$ | 0 | 1 | 1 | 4-p, —$CH_2$— | —$(CH_2)_4CH_3$ | — | — | 1 | 0 | 0 |
| 86 | — | 4-p, —$OCH_3$ | 4-p, —$OCH_3$ | 0 | 1 | 1 | 4-p, —$CH_2$— | —$CH_2CH(CH_3)_2$ | — | — | 1 | 0 | 0 |
| 87 | — | 4-p, —$OCH_3$ | 4-p, —$OCH_3$ | 0 | 1 | 1 | 4-p, —$CH_2$— | —$CH_2CH_2OCH_3$ | — | — | 1 | 0 | 0 |
| 88 | — | 4-p, —$OCH_3$ | 4-p, —$OCH_3$ | 0 | 1 | 1 | 4-p, —$CH_2$— | —$CH_2CH_2Cl$ | — | — | 1 | 0 | 0 |
| 89 | — | 4-p, —$OCH_3$ | 4-p, —$OCH_3$ | 0 | 1 | 1 | 4-p, —$CH_2$— | —Ph | — | — | 1 | 0 | 0 |
| 90 | — | 4-p, —$OCH_3$ | 4-p, —$OCH_3$ | 0 | 1 | 1 | 4-p, —$CH_2$— | —Bzl | — | — | 1 | 0 | 0 |
| 91 | — | 4-p, —$OCH_3$ | 4-p, —CH═CH—Ph | 0 | 1 | 1 | 4-p, —$CH_2$— | —$CH_3$ | — | — | 1 | 0 | 0 |
| 92 | — | 4-p, —$OCH_3$ | 4-p, —CH═CH—Ph | 0 | 1 | 1 | 4-p, —$CH_2$— | —$CH_2CH_3$ | — | — | 1 | 0 | 0 |
| 93 | — | 4-p, —$OCH_3$ | 4-p, —CH═CH—Ph | 0 | 1 | 1 | 4-p, —$CH_2$— | —$CH_2CH_2CH_3$ | — | — | 1 | 0 | 0 |
| 94 | — | 4-p, —$OCH_3$ | 4-p, —CH═CH—Ph | 0 | 1 | 1 | 4-p, —$CH_2$— | —$(CH_2)_4CH_3$ | — | — | 1 | 0 | 0 |
| 95 | — | 4-p, —$OCH_3$ | 4-p, —CH═CH—Ph | 0 | 1 | 1 | 4-p, —$CH_2$— | —$CH_2CH(CH_3)_2$ | — | — | 1 | 0 | 0 |
| 96 | — | 4-p, —$OCH_3$ | 4-p, —CH═CH—Ph | 0 | 1 | 1 | 4-p, —$CH_2$— | —$CH_2CH_2OCH_3$ | — | — | 1 | 0 | 0 |
| 97 | — | 4-p, —$OCH_3$ | 4-p, —CH═CH—Ph | 0 | 1 | 1 | 4-p, —$CH_2$— | —$CH_2CH_2Cl$ | — | — | 1 | 0 | 0 |
| 98 | — | 4-p, —$OCH_3$ | 4-p, —CH═CH—Ph | 0 | 1 | 1 | 4-p, —$CH_2$— | —Ph | — | — | 1 | 0 | 0 |
| 99 | — | 4-p, —$OCH_3$ | 4-p, —CH═CH—Ph | 0 | 1 | 1 | 4-p, —$CH_2$— | —Bzl | — | — | 1 | 0 | 0 |
| 100 | — | 4-p, —CH═CH—CH═CH—Ph | 4-p, —CH═CH—CH═CH—Ph | 0 | 1 | 1 | 4-p, —$CH_2$— | —$CH_3$ | — | — | 1 | 0 | 0 |
| 101 | — | 4-p, —CH═CH—CH═CH—Ph | 4-p, —CH═CH—CH═CH—Ph | 0 | 1 | 1 | 4-p, —$CH_2$— | —$CH_2CH_3$ | — | — | 1 | 0 | 0 |
| 102 | — | 4-p, —CH═CH—CH═CH—Ph | 4-p, —CH═CH—CH═CH—Ph | 0 | 1 | 1 | 4-p, —$CH_2$— | —$CH_2CH_2CH_3$ | — | — | 1 | 0 | 0 |
| 103 | — | 4-p, —CH═CH—CH═CH—Ph | 4-p, —CH═CH—CH═CH—Ph | 0 | 1 | 1 | 4-p, —$CH_2$— | —$(CH_2)_4CH_3$ | — | — | 1 | 0 | 0 |
| 104 | — | 4-p, —CH═CH—CH═CH—Ph | 4-p, —CH═CH—CH═CH—Ph | 0 | 1 | 1 | 4-p, —$CH_2$— | —$CH_2CH(CH_3)_2$ | — | — | 1 | 0 | 0 |
| 105 | — | 4-p, —CH═CH—CH═CH—Ph | 4-p, —CH═CH—CH═CH—Ph | 0 | 1 | 1 | 4-p, —$CH_2$— | —$CH_2CH_2OCH_3$ | — | — | 1 | 0 | 0 |

4-p: 4-position,

—Ph: 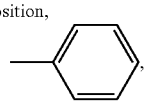 ,

—Bzl: 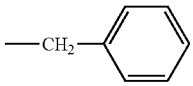

TABLE 18

| Compound | X1 | X2 | X3 | l1 | l2 | l3 | T | R1 | R2 | R3 | n1 | n2 | n3 |
|---|---|---|---|---|---|---|---|---|---|---|---|---|---|
| 106 | — | 4-p, —CH═CH—CH═CH—Ph | 4-p, —CH═CH—CH═CH—Ph | 0 | 1 | 1 | 4-p, —$CH_2$— | —$CH_2CH_2Cl$ | — | — | 1 | 0 | 0 |
| 107 | — | 4-p, —CH═CH—CH═CH—Ph | 4-p, —CH═CH—CH═CH—Ph | 0 | 1 | 1 | 4-p, —$CH_2$— | —Ph | — | — | 1 | 0 | 0 |
| 108 | — | 4-p, —CH═CH—CH═CH—Ph | 4-p, —CH═CH—CH═CH—Ph | 0 | 1 | 1 | 4-p, —$CH_2$— | —Bzl | — | — | 1 | 0 | 0 |
| 109 | — | 3,4-p, —$CH_3$ | 3,4-p, —$CH_3$ | 0 | 2 | 2 | 4-p, —$CH_2$— | —$CH_3$ | — | — | 1 | 0 | 0 |
| 110 | — | 3,4-p, —$CH_3$ | 3,4-p, —$CH_3$ | 0 | 2 | 2 | 4-p, —$CH_2$— | —$CH_2CH_3$ | — | — | 1 | 0 | 0 |
| 111 | — | 3,4-p, —$CH_3$ | 3,4-p, —$CH_3$ | 0 | 2 | 2 | 4-p, —$CH_2$— | —$CH_2CH_2CH_3$ | — | — | 1 | 0 | 0 |
| 112 | — | 3,4-p, —$CH_3$ | 3,4-p, —$CH_3$ | 0 | 2 | 2 | 4-p, —$CH_2$— | —$(CH_2)_4CH_3$ | — | — | 1 | 0 | 0 |
| 113 | — | 3,4-p, —$CH_3$ | 3,4-p, —$CH_3$ | 0 | 2 | 2 | 4-p, —$CH_2$— | —$CH_2CH(CH_3)_2$ | — | — | 1 | 0 | 0 |
| 114 | — | 3,4-p, —$CH_3$ | 3,4-p, —$CH_3$ | 0 | 2 | 2 | 4-p, —$CH_2$— | —$CH_2CH_2OCH_3$ | — | — | 1 | 0 | 0 |
| 115 | — | 3,4-p, —$CH_3$ | 3,4-p, —$CH_3$ | 0 | 2 | 2 | 4-p, —$CH_2$— | —$CH_2CH_2Cl$ | — | — | 1 | 0 | 0 |
| 116 | — | 3,4-p, —$CH_3$ | 3,4-p, —$CH_3$ | 0 | 2 | 2 | 4-p, —$CH_2$— | —Ph | — | — | 1 | 0 | 0 |
| 117 | — | 3,4-p, —$CH_3$ | 3,4-p, —$CH_3$ | 0 | 2 | 2 | 4-p, —$CH_2$— | —Bzl | — | — | 1 | 0 | 0 |
| 118 | — | — | — | 0 | 0 | 0 | 4-p, —$CH_2$— | —$CH_3$ | —$CH_3$ | — | 1 | 1 | 0 |
| 119 | — | — | — | 0 | 0 | 0 | 4-p, —$CH_2$— | —$CH_2CH_3$ | —$CH_2CH_3$ | — | 1 | 1 | 0 |
| 120 | — | — | — | 0 | 0 | 0 | 4-p, —$CH_2$— | —$CH_2CH_2CH_3$ | —$CH_2CH_2CH_3$ | — | 1 | 1 | 0 |
| 121 | — | — | — | 0 | 0 | 0 | 4-p, —$CH_2$— | —$(CH_2)_4CH_3$ | —$(CH_2)_4CH_3$ | — | 1 | 1 | 0 |
| 122 | — | — | — | 0 | 0 | 0 | 4-p, —$CH_2$— | —$CH_2CH(CH_3)_2$ | —$CH_2CH(CH_3)_2$ | — | 1 | 1 | 0 |
| 123 | — | — | — | 0 | 0 | 0 | 4-p, —$CH_2$— | —$CH_2CH_2OCH_3$ | —$CH_2CH_2OCH_3$ | — | 1 | 1 | 0 |
| 124 | — | — | — | 0 | 0 | 0 | 4-p, —$CH_2$— | —$CH_2CH_2Cl$ | —$CH_2CH_2Cl$ | — | 1 | 1 | 0 |
| 125 | — | — | — | 0 | 0 | 0 | 4-p, —$CH_2$— | —Ph | —Ph | — | 1 | 1 | 0 |
| 126 | — | — | — | 0 | 0 | 0 | 4-p, —$CH_2$— | —Bzl | —Bzl | — | 1 | 1 | 0 |
| 127 | — | — | 4-p, —$CH_3$ | 0 | 0 | 1 | 4-p, —$CH_2$— | —$CH_3$ | —$CH_3$ | — | 1 | 1 | 0 |
| 128 | — | — | 4-p, —$CH_3$ | 0 | 0 | 1 | 4-p, —$CH_2$— | —$CH_2CH_3$ | —$CH_2CH_3$ | — | 1 | 1 | 0 |
| 129 | — | — | 4-p, —$CH_3$ | 0 | 0 | 1 | 4-p, —$CH_2$— | —$CH_2CH_2CH_3$ | —$CH_2CH_2CH_3$ | — | 1 | 1 | 0 |
| 130 | — | — | 4-p, —$CH_3$ | 0 | 0 | 1 | 4-p, —$CH_2$— | —$(CH_2)_4CH_3$ | —$(CH_2)_4CH_3$ | — | 1 | 1 | 0 |
| 131 | — | — | 4-p, —$CH_3$ | 0 | 0 | 1 | 4-p, —$CH_2$— | —$CH_2CH(CH_3)_2$ | —$CH_2CH(CH_3)_2$ | — | 1 | 1 | 0 |
| 132 | — | — | 4-p, —$CH_3$ | 0 | 0 | 1 | 4-p, —$CH_2$— | —$CH_2CH_2OCH_3$ | —$CH_2CH_2OCH_3$ | — | 1 | 1 | 0 |
| 133 | — | — | 4-p, —$CH_3$ | 0 | 0 | 1 | 4-p, —$CH_2$— | —$CH_2CH_2Cl$ | —$CH_2CH_2Cl$ | — | 1 | 1 | 0 |

4-p: 4-position,
3,4-p: 3,4-position,

—Ph: 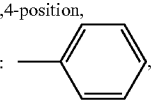 ,

—Bzl: 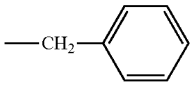

TABLE 19

| Compound | X1 | X2 | X3 | l1 | l2 | l3 | T | R1 | R2 | R3 | n1 | n2 | n3 |
|---|---|---|---|---|---|---|---|---|---|---|---|---|---|
| 134 | — | — | 4-p, —$CH_3$ | 0 | 0 | 1 | 4-p, —$CH_2$— | —Ph | —Ph | — | 1 | 1 | 0 |
| 135 | — | — | 4-p, —$CH_3$ | 0 | 0 | 1 | 4-p, —$CH_2$— | —Bzl | —Bzl | — | 1 | 1 | 0 |
| 136 | — | — | 4-p, —$OCH_3$ | 0 | 0 | 1 | 4-p, —$CH_2$— | —$CH_3$ | —$CH_3$ | — | 1 | 1 | 0 |
| 137 | — | — | 4-p, —$OCH_3$ | 0 | 0 | 1 | 4-p, —$CH_2$— | —$CH_2CH_3$ | —$CH_2CH_3$ | — | 1 | 1 | 0 |
| 138 | — | — | 4-p, —$OCH_3$ | 0 | 0 | 1 | 4-p, —$CH_2$— | —$CH_2CH_2CH_3$ | —$CH_2CH_2CH_3$ | — | 1 | 1 | 0 |
| 139 | — | — | 4-p, —$OCH_3$ | 0 | 0 | 1 | 4-p, —$CH_2$— | —$(CH_2)_4CH_3$ | —$(CH_2)_4CH_3$ | — | 1 | 1 | 0 |
| 140 | — | — | 4-p, —$OCH_3$ | 0 | 0 | 1 | 4-p, —$CH_2$— | —$CH_2CH(CH_3)_2$ | —$CH_2CH(CH_3)_2$ | — | 1 | 1 | 0 |
| 141 | — | — | 4-p, —$OCH_3$ | 0 | 0 | 1 | 4-p, —$CH_2$— | —$CH_2CH_2OCH_3$ | —$CH_2CH_2OCH_3$ | — | 1 | 1 | 0 |
| 142 | — | — | 4-p, —$OCH_3$ | 0 | 0 | 1 | 4-p, —$CH_2$— | —$CH_2CH_2Cl$ | —$CH_2CH_2Cl$ | — | 1 | 1 | 0 |
| 143 | — | — | 4-p, —$OCH_3$ | 0 | 0 | 1 | 4-p, —$CH_2$— | —Ph | —Ph | — | 1 | 1 | 0 |
| 144 | — | — | 4-p, —$OCH_3$ | 0 | 0 | 1 | 4-p, —$CH_2$— | —Bzl | —Bzl | — | 1 | 1 | 0 |
| 145 | — | — | 4-p, —Ph | 0 | 0 | 1 | 4-p, —$CH_2$— | —$CH_3$ | —$CH_3$ | — | 1 | 1 | 0 |
| 146 | — | — | 4-p, —Ph | 0 | 0 | 1 | 4-p, —$CH_2$— | —$CH_2CH_3$ | —$CH_2CH_3$ | — | 1 | 1 | 0 |
| 147 | — | — | 4-p, —Ph | 0 | 0 | 1 | 4-p, —$CH_2$— | —$CH_2CH_2CH_3$ | —$CH_2CH_2CH_3$ | — | 1 | 1 | 0 |
| 148 | — | — | 4-p, —Ph | 0 | 0 | 1 | 4-p, —$CH_2$— | —$(CH_2)_4CH_3$ | —$(CH_2)_4CH_3$ | — | 1 | 1 | 0 |
| 149 | — | — | 4-p, —Ph | 0 | 0 | 1 | 4-p, —$CH_2$— | —$CH_2CH(CH_3)_2$ | —$CH_2CH(CH_3)_2$ | — | 1 | 1 | 0 |
| 150 | — | — | 4-p, —Ph | 0 | 0 | 1 | 4-p, —$CH_2$— | —$CH_2CH_2OCH_3$ | —$CH_2CH_2OCH_3$ | — | 1 | 1 | 0 |
| 151 | — | — | 4-p, —Ph | 0 | 0 | 1 | 4-p, —$CH_2$— | —$CH_2CH_2Cl$ | —$CH_2CH_2Cl$ | — | 1 | 1 | 0 |
| 152 | — | — | 4-p, —Ph | 0 | 0 | 1 | 4-p, —$CH_2$— | —Ph | —Ph | — | 1 | 1 | 0 |
| 153 | — | — | 4-p, —Ph | 0 | 0 | 1 | 4-p, —$CH_2$— | —Bzl | —Bzl | — | 1 | 1 | 0 |
| 154 | — | — | 4-p, —CH═CH—Ph | 0 | 0 | 1 | 4-p, —$CH_2$— | —$CH_3$ | —$CH_3$ | — | 1 | 1 | 0 |

4-p: 4-position,

—Ph: 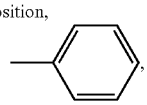 ,

—Bzl: —$CH_2$— 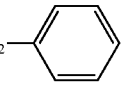

30

TABLE 20

| Compound | X1 | X2 | X3 | l1 | l2 | l3 | T | R1 | R2 | R3 | n1 | n2 | n3 |
|---|---|---|---|---|---|---|---|---|---|---|---|---|---|
| 155 | — | — | 4-p, —CH═CH—Ph | 0 | 0 | 1 | 4-p, —$CH_2$— | —$CH_2CH_3$ | —$CH_2CH_3$ | — | 1 | 1 | 0 |
| 156 | — | — | 4-p, —CH═CH—Ph | 0 | 0 | 1 | 4-p, —$CH_2$— | —$CH_2CH_2CH_3$ | —$CH_2CH_2CH_3$ | — | 1 | 1 | 0 |
| 157 | — | — | 4-p, —CH═CH—Ph | 0 | 0 | 1 | 4-p, —$CH_2$— | —$(CH_2)_4CH_3$ | —$(CH_2)_4CH_3$ | — | 1 | 1 | 0 |
| 158 | — | — | 4-p, —CH═CH—Ph | 0 | 0 | 1 | 4-p, —$CH_2$— | —$CH_2CH(CH_3)_2$ | —$CH_2CH(CH_3)_2$ | — | 1 | 1 | 0 |
| 159 | — | — | 4-p, —CH═CH—Ph | 0 | 0 | 1 | 4-p, —$CH_2$— | —$CH_2CH_2OCH_3$ | —$CH_2CH_2OCH_3$ | — | 1 | 1 | 0 |
| 160 | — | — | 4-p, —CH═CH—Ph | 0 | 0 | 1 | 4-p, —$CH_2$— | —$CH_2CH_2Cl$ | —$CH_2CH_2Cl$ | — | 1 | 1 | 0 |
| 161 | — | — | 4-p, —CH═CH—Ph | 0 | 0 | 1 | 4-p, —$CH_2$— | —Ph | —Ph | — | 1 | 1 | 0 |
| 162 | — | — | 4-p, —CH═CH—Ph | 0 | 0 | 1 | 4-p, —$CH_2$— | —Bzl | —Bzl | — | 1 | 1 | 0 |
| 163 | — | — | 4-p, —CH═CH—CH═CH—Ph | 0 | 0 | 1 | 4-p, —$CH_2$— | —$CH_3$ | —$CH_3$ | — | 1 | 1 | 0 |
| 164 | — | — | 4-p, —CH═CH—CH═CH—Ph | 0 | 0 | 1 | 4-p, —$CH_2$— | —$CH_2CH_3$ | —$CH_2CH_3$ | — | 1 | 1 | 0 |
| 165 | — | — | 4-p, —CH═CH—CH═CH—Ph | 0 | 0 | 1 | 4-p, —$CH_2$— | —$CH_2CH_2CH_3$ | —$CH_2CH_2CH_3$ | — | 1 | 1 | 0 |
| 166 | — | — | 4-p, —CH═CH—CH═CH—Ph | 0 | 0 | 1 | 4-p, —$CH_2$— | —$(CH_2)_4CH_3$ | —$(CH_2)_4CH_3$ | — | 1 | 1 | 0 |
| 167 | — | — | 4-p, —CH═CH—CH═CH—Ph | 0 | 0 | 1 | 4-p, —$CH_2$— | —$CH_2CH(CH_3)_2$ | —$CH_2CH(CH_3)_2$ | — | 1 | 1 | 0 |
| 168 | — | — | 4-p, —CH═CH—CH═CH—Ph | 0 | 0 | 1 | 4-p, —$CH_2$— | —$CH_2CH_2OCH_3$ | —$CH_2CH_2OCH_3$ | — | 1 | 1 | 0 |
| 169 | — | — | 4-p, —CH═CH—CH═CH—Ph | 0 | 0 | 1 | 4-p, —$CH_2$— | —$CH_2CH_2Cl$ | —$CH_2CH_2Cl$ | — | 1 | 1 | 0 |
| 170 | — | — | 4-p, —CH═CH—CH═CH—Ph | 0 | 0 | 1 | 4-p, —$CH_2$— | —Ph | —Ph | — | 1 | 1 | 0 |
| 171 | — | — | 4-p, —CH═CH—CH═CH—Ph | 0 | 0 | 1 | 4-p, —$CH_2$— | —Bzl | —Bzl | | 1 | 1 | 0 |

4-p: 4-position,

—Ph: 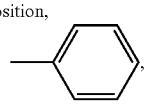 ,

—Bzl: —$CH_2$— 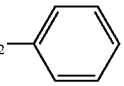

TABLE 21

| Compound | X1 | X2 | X3 | l1 | l2 | l3 | T | R1 | R2 | R3 | n1 | n2 | n3 |
|---|---|---|---|---|---|---|---|---|---|---|---|---|---|
| 172 | — | — | 4-p, —CH═C(Ph)$_2$ | 0 | 0 | 1 | 4-p, —$CH_2$— | —$CH_3$ | —$CH_3$ | — | 1 | 1 | 0 |
| 173 | — | — | 4-p, —CH═C(Ph)$_2$ | 0 | 0 | 1 | 4-p, —$CH_2$— | —$CH_2CH_3$ | —$CH_2CH_3$ | — | 1 | 1 | 0 |

TABLE 21-continued

| Compound | X1 | X2 | X3 | l1 | l2 | l3 | T | R1 | R2 | R3 | n1 | n2 | n3 |
|---|---|---|---|---|---|---|---|---|---|---|---|---|---|
| 174 | — | — | 4-p, —CH═C(Ph)$_2$ | 0 | 0 | 1 | 4-p, —CH$_2$— | —CH$_2$CH$_2$CH$_3$ | —CH$_2$CH$_2$CH$_3$ | — | 1 | 1 | 0 |
| 175 | — | — | 4-p, —CH═C(Ph)$_2$ | 0 | 0 | 1 | 4-p, —CH$_2$— | —(CH$_2$)$_4$CH$_3$ | —(CH$_2$)$_4$CH$_3$ | — | 1 | 1 | 0 |
| 176 | — | — | 4-p, —CH═C(Ph)$_2$ | 0 | 0 | 1 | 4-p, —CH$_2$— | —CH$_2$CH(CH$_3$)$_2$ | —CH$_2$CH(CH$_3$)$_2$ | — | 1 | 1 | 0 |
| 177 | — | — | 4-p, —CH═C(Ph)$_2$ | 0 | 0 | 1 | 4-p, —CH$_2$— | —CH$_2$CH$_2$OCH$_3$ | —CH$_2$CH$_2$OCH$_3$ | — | 1 | 1 | 0 |
| 178 | — | — | 4-p, —CH═C(Ph)$_2$ | 0 | 0 | 1 | 4-p, —CH$_2$— | —CH$_2$CH$_2$Cl | —CH$_2$CH$_2$Cl | — | 1 | 1 | 0 |
| 179 | — | — | 4-p, —CH═C(Ph)$_2$ | 0 | 0 | 1 | 4-p, —CH$_2$— | —Ph | —Ph | — | 1 | 1 | 0 |
| 180 | — | — | 4-p, —CH═C(Ph)$_2$ | 0 | 0 | 1 | 4-p, —CH$_2$— | —Bzl | —Bzl | — | 1 | 1 | 0 |
| 181 | — | — | 4-p, —CH═N—N(Ph)CH$_2$CH$_3$ | 0 | 0 | 1 | 4-p, —CH$_2$— | —CH$_3$ | —CH$_3$ | — | 1 | 1 | 0 |
| 182 | — | — | 4-p, —CH═N—N(Ph)CH$_2$CH$_3$ | 0 | 0 | 1 | 4-p, —CH$_2$— | —CH$_2$CH$_3$ | —CH$_2$CH$_3$ | — | 1 | 1 | 0 |

4-p: 4-position,

—Ph: 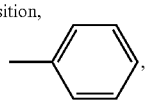 ,

—Bzl: —CH$_2$— 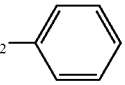

TABLE 22

| Compound | X1 | X2 | X3 | l1 | l2 | l3 | T | R1 | R2 | R3 | n1 | n2 | n3 |
|---|---|---|---|---|---|---|---|---|---|---|---|---|---|
| 183 | — | — | 4-p, —CH═N—N(Ph)CH$_2$CH$_3$ | 0 | 0 | 1 | 4-p, —CH$_2$— | —CH$_2$CH$_2$CH$_3$ | —CH$_2$CH$_2$CH$_3$ | — | 1 | 1 | 0 |
| 184 | — | — | 4-p, —CH═N—N(Ph)CH$_2$CH$_3$ | 0 | 0 | 1 | 4-p, —CH$_2$— | —(CH$_2$)$_4$CH$_3$ | —(CH$_2$)$_4$CH$_3$ | — | 1 | 1 | 0 |
| 185 | — | — | 4-p, —CH═N—N(Ph)CH$_2$CH$_3$ | 0 | 0 | 1 | 4-p, —CH$_2$— | —CH$_2$CH(CH$_3$)$_2$ | —CH$_2$CH(CH$_3$)$_2$ | — | 1 | 1 | 0 |
| 186 | — | — | 4-p, —CH═N—N(Ph)CH$_2$CH$_3$ | 0 | 0 | 1 | 4-p, —CH$_2$— | —CH$_2$CH$_2$OCH$_3$ | —CH$_2$CH$_2$OCH$_3$ | — | 1 | 1 | 0 |
| 187 | — | — | 4-p, —CH═N—N(Ph)CH$_2$CH$_3$ | 0 | 0 | 1 | 4-p, —CH$_2$— | —CH$_2$CH$_2$Cl | —CH$_2$CH$_2$Cl | — | 1 | 1 | 0 |
| 188 | — | — | 4-p, —CH═N—N(Ph)CH$_2$CH$_3$ | 0 | 0 | 1 | 4-p, —CH$_2$— | —Ph | —Ph | — | 1 | 1 | 0 |
| 189 | — | — | 4-p, —CH═N—N(Ph)CH$_2$CH$_3$ | 0 | 0 | 1 | 4-p, —CH$_2$— | —Bzl | —Bzl | — | 1 | 1 | 0 |
| 190 | — | — | 4-p, —CH═N—N(Ph)$_2$ | 0 | 0 | 1 | 4-p, —CH$_2$— | —CH$_3$ | —CH$_3$ | — | 1 | 1 | 0 |
| 191 | — | — | 4-p, —CH═N—N(Ph)$_2$ | 0 | 0 | 1 | 4-p, —CH$_2$— | —CH$_2$CH$_3$ | —CH$_2$CH$_3$ | — | 1 | 1 | 0 |
| 192 | — | — | 4-p, —CH═N—N(Ph)$_2$ | 0 | 0 | 1 | 4-p, —CH$_2$— | —CH$_2$CH$_2$CH$_3$ | —CH$_2$CH$_2$CH$_3$ | — | 1 | 1 | 0 |
| 193 | — | — | 4-p, —CH═N—N(Ph)$_2$ | 0 | 0 | 1 | 4-p, —CH$_2$— | —(CH$_2$)$_4$CH$_3$ | —(CH$_2$)$_4$CH$_3$ | — | 1 | 1 | 0 |
| 194 | — | — | 4-p, —CH═N—N(Ph)$_2$ | 0 | 0 | 1 | 4-p, —CH$_2$— | —CH$_2$CH(CH$_3$)$_2$ | —CH$_2$CH(CH$_3$)$_2$ | — | 1 | 1 | 0 |
| 195 | — | — | 4-p, —CH═N—N(Ph)$_2$ | 0 | 0 | 1 | 4-p, —CH$_2$— | —CH$_2$CH$_2$OCH$_3$ | —CH$_2$CH$_2$OCH$_3$ | — | 1 | 1 | 0 |

4-p: 4-position,

—Ph: 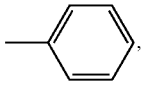 ,

—Bzl: —CH$_2$— 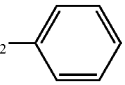

TABLE 23

| Compound | X1 | X2 | X3 | l1 | l2 | l3 | T | R1 | R2 | R3 | n1 | n2 | n3 |
|---|---|---|---|---|---|---|---|---|---|---|---|---|---|
| 196 | — | — | 4-p, —CH═N—N(Ph)$_2$ | 0 | 0 | 1 | 4-p, —CH$_2$— | —CH$_2$CH$_2$Cl | —CH$_2$CH$_2$Cl | — | 1 | 1 | 0 |
| 197 | — | — | 4-p, —CH═N—N(Ph)$_2$ | 0 | 0 | 1 | 4-p, —CH$_2$— | —Ph | —Ph | — | 1 | 1 | 0 |
| 198 | — | — | 4-p, —CH═N—N(Ph)$_2$ | 0 | 0 | 1 | 4-p, —CH$_2$— | —Bzl | —Bzl | — | 1 | 1 | 0 |
| 199 | — | — | — | 0 | 0 | 0 | 4-p, —CH$_2$— | —CH$_3$ | —CH$_3$ | —CH$_3$ | 1 | 1 | 1 |
| 200 | — | — | — | 0 | 0 | 0 | 4-p, —CH$_2$— | —CH$_2$CH$_3$ | —CH$_2$CH$_3$ | —CH$_2$CH$_3$ | 1 | 1 | 1 |
| 201 | — | — | — | 0 | 0 | 0 | 4-p, —CH$_2$— | —CH$_2$CH$_2$CH$_3$ | —CH$_2$CH$_2$CH$_3$ | —CH$_2$CH$_2$CH$_3$ | 1 | 1 | 1 |
| 202 | — | — | — | 0 | 0 | 0 | 4-p, —CH$_2$— | —(CH$_2$)$_4$CH$_3$ | —(CH$_2$)$_4$CH$_3$ | —(CH$_2$)$_4$CH$_3$ | 1 | 1 | 1 |
| 203 | — | — | — | 0 | 0 | 0 | 4-p, —CH$_2$— | —CH$_2$CH(CH$_3$)$_2$ | —CH$_2$CH(CH$_3$)$_2$ | —CH$_2$CH(CH$_3$)$_2$ | 1 | 1 | 1 |
| 204 | — | — | — | 0 | 0 | 0 | 4-p, —CH$_2$— | —CH$_2$CH$_2$OCH$_3$ | —CH$_2$CH$_2$OCH$_3$ | —CH$_2$CH$_2$OCH$_3$ | 1 | 1 | 1 |

TABLE 23-continued

| Compound | X1 | X2 | X3 | l1 | l2 | l3 | T | R1 | R2 | R3 | n1 | n2 | n3 |
|---|---|---|---|---|---|---|---|---|---|---|---|---|---|
| 205 | — | — | — | 0 | 0 | 0 | 4-p, —$CH_2$— | —$CH_2CH_2Cl$ | —$CH_2CH_2Cl$ | —$CH_2CH_2Cl$ | 1 | 1 | 1 |
| 206 | — | — | — | 0 | 0 | 0 | 4-p, —$CH_2$— | —Ph | —Ph | —Ph | 1 | 1 | 1 |
| 207 | — | — | — | 0 | 0 | 0 | 4-p, —$CH_2$— | —Bzl | —Bzl | —Bzl | 1 | 1 | 1 |
| 208 | | 3-p, —$CH_3$ | 3-p, —$CH_3$ | 0 | 1 | 1 | 4-p, —$CH_2$— | —$CH_3$ | —$CH_3$ | —$CH_3$ | 1 | 1 | 1 |
| 209 | | 3-p, —$CH_3$ | 3-p, —$CH_3$ | 0 | 1 | 1 | 4-p, —$CH_2$— | —$CH_2CH_3$ | —$CH_2CH_3$ | —$CH_2CH_3$ | 1 | 1 | 1 |
| 210 | | 3-p, —$CH_3$ | 3-p, —$CH_3$ | 0 | 1 | 1 | 4-p, —$CH_2$— | —$CH_2CH_2CH_3$ | —$CH_2CH_2CH_3$ | —$CH_2CH_2CH_3$ | 1 | 1 | 1 |
| 211 | | 3-p, —$CH_3$ | 3-p, —$CH_3$ | 0 | 1 | 1 | 4-p, —$CH_2$— | —$(CH_2)_4CH_3$ | —$(CH_2)_4CH_3$ | —$(CH_2)_4CH_3$ | 1 | 1 | 1 |
| 212 | | 3-p, —$CH_3$ | 3-p, —$CH_3$ | 0 | 1 | 1 | 4-p, —$CH_2$— | —$CH_2CH(CH_3)_2$ | —$CH_2CH(CH_3)_2$ | —$CH_2CH(CH_3)_2$ | 1 | 1 | 1 |
| 213 | | 3-p, —$CH_3$ | 3-p, —$CH_3$ | 0 | 1 | 1 | 4-p, —$CH_2$— | —$CH_2CH_2OCH_3$ | —$CH_2CH_2OCH_3$ | —$CH_2CH_2OCH_3$ | 1 | 1 | 1 |
| 214 | | 3-p, —$CH_3$ | 3-p, —$CH_3$ | 0 | 1 | 1 | 4-p, —$CH_2$— | —$CH_2CH_2Cl$ | —$CH_2CH_2Cl$ | —$CH_2CH_2Cl$ | 1 | 1 | 1 |
| 215 | | 3-p, —$CH_3$ | 3-p, —$CH_3$ | 0 | 1 | 1 | 4-p, —$CH_2$— | —Ph | —Ph | —Ph | 1 | 1 | 1 |
| 216 | | 3-p, —$CH_3$ | 3-p, —$CH_3$ | 0 | 1 | 1 | 4-p, —$CH_2$— | —Bzl | —Bzl | —Bzl | 1 | 1 | 1 |
| 217 | 3-p, —$CH_3$ | 3-p, —$CH_3$ | 3-p, —$CH_3$ | 1 | 1 | 1 | 4-p, —$CH_2$— | —$CH_3$ | —$CH_3$ | —$CH_3$ | 1 | 1 | 1 |
| 218 | 3-p, —$CH_3$ | 3-p, —$CH_3$ | 3-p, —$CH_3$ | 1 | 1 | 1 | 4-p, —$CH_2$— | —$CH_2CH_3$ | —$CH_2CH_3$ | —$CH_2CH_3$ | 1 | 1 | 1 |

3-p: 3-position,
4-p: 4-position,

—Ph: 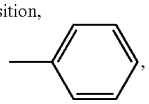 ,

—Bzl: —$CH_2$— 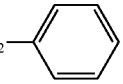

TABLE 24

| Compound | X1 | X2 | X3 | l1 | l2 | l3 | T | R1 | R2 | R3 | n1 | n2 | n3 |
|---|---|---|---|---|---|---|---|---|---|---|---|---|---|
| 219 | 3-p, —$CH_3$ | 3-p, —$CH_3$ | 3-p, —$CH_3$ | 1 | 1 | 1 | 4-p, —$CH_2$— | —$CH_2CH_2CH_3$ | —$CH_2CH_2CH_3$ | —$CH_2CH_2CH_3$ | 1 | 1 | 1 |
| 220 | 3-p, —$CH_3$ | 3-p, —$CH_3$ | 3-p, —$CH_3$ | 1 | 1 | 1 | 4-p, —$CH_2$— | —$(CH_2)_4CH_3$ | —$(CH_2)_4CH_3$ | —$(CH_2)_4CH_3$ | 1 | 1 | 1 |
| 221 | 3-p, —$CH_3$ | 3-p, —$CH_3$ | 3-p, —$CH_3$ | 1 | 1 | 1 | 4-p, —$CH_2$— | —$CH_2CH(CH_3)_2$ | —$CH_2CH(CH_3)_2$ | —$CH_2CH(CH_3)_2$ | 1 | 1 | 1 |
| 222 | 3-p, —$CH_3$ | 3-p, —$CH_3$ | 3-p, —$CH_3$ | 1 | 1 | 1 | 4-p, —$CH_2$— | —$CH_2CH_2OCH_3$ | —$CH_2CH_2OCH_3$ | —$CH_2CH_2OCH_3$ | 1 | 1 | 1 |
| 223 | 3-p, —$CH_3$ | 3-p, —$CH_3$ | 3-p, —$CH_3$ | 1 | 1 | 1 | 4-p, —$CH_2$— | —$CH_2CH_2Cl$ | —$CH_2CH_2Cl$ | —$CH_2CH_2Cl$ | 1 | 1 | 1 |
| 224 | 3-p, —$CH_3$ | 3-p, —$CH_3$ | 3-p, —$CH_3$ | 1 | 1 | 1 | 4-p, —$CH_2$— | —Ph | —Ph | —Ph | 1 | 1 | 1 |
| 225 | 3-p, —$CH_3$ | 3-p, —$CH_3$ | 3-p, —$CH_3$ | 1 | 1 | 1 | 4-p, —$CH_2$— | —Bzl | —Bzl | —Bzl | 1 | 1 | 1 |

3-p: 3-position,
4-p: 4-position,

—Ph: 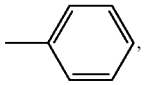 ,

—Bzl: —$CH_2$— 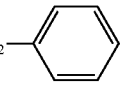

In Tables 13 to 24, Compound 1 is the same as the compound of the general formula (I-5), Compound 118 is the same as the compound of the general formula (I-6), Compound 120 is the same as the compound (I-7), Compound 125 is the same as the compound (I-8), Compound 109 is the same as the compound (I-9), Compound 128 is the same as the compound (I-10), Compound 123 is the same as the compound (I-11), Compound 145 is the same as the compound (I-12), Compound 65 is the same as the compound (I-28), and Compound 172 is the same as the compound (I-32).

In the charge-transporting compound of the invention, the sum of n1, n2 and n3 in the general formula (I-A) is preferably 2 or more. In this arrangement, when used in combination with a curable resin, the charge-transporting compound of the invention can easily form a rigider film. The resulting protective layer 7 exhibits a higher mechanical strength, making it possible to further enhance the image quality and prolong the life of the electrophotographic photoreceptor 1.

In the general formula (I-A), $R^1$, $R^2$ and $R^3$ each are preferably an organic group represented by $CH_2$—$R^4$ (in which $R^4$ represents a hydrogen atom, halogen atom or $C_1$-$C_{17}$ organic group). The aforementioned charge-transporting compound can satisfy both the requirements for pot life of coating solution and high reactivity during the formation of functional layer, making it possible to form a protective layer 7 excellent in electrical properties and mechanical strength while sufficiently assuring the productivity of the electrophotographic photoreceptor 1.

The charge-transporting compound of the general formula (I-A) wherein $R^1$, $R^2$ and $R^3$ each are a phenyl group is often unstable at room temperature and thus tends to be difficultly handled. For example, Compound 125, even in crystalline state, undergoes coloration with self-condensation at room temperature in 2 to 3 days until it cannot be dissolved in an organic solvent.

In the general formula (I-A), $R^1$, $R^2$ and $R^3$ each may be an organic group represented by —$(CH_2)_r$—O—$R^5$ (in which $R^5$ represents a $C_1$-$C_6$ hydrocarbon group and r represents an integer of from 1 to 12).

As a method for the synthesis of the compound having a structure represented by the general formula (I) there may be used a method which comprises reacting a compound having a hydroxyl group represented by the following general formula (I-a) with a halide represented by the following general formula (I-b) in an organic solvent in the presence of a basic catalyst as shown by the following scheme:

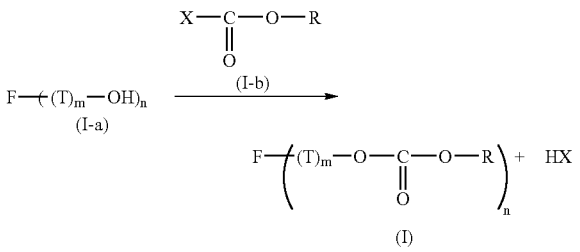

In the general formula (I-a), F represents a hole-transporting, n-valent organic group, T represents a divalent group, and m represents 0 or 1. In the general formula (I-b), X represents a halogen atom and R represents a $C_1$-$C_{18}$ organic group. In the general formula (I), F represents a hole-transporting, n-valent organic group, T represents a divalent group, m represents 0 or 1; R's each independently represent a $C_1$-$C_{18}$ organic group and n represents an integer of from 1 to 4.

The charge-transporting compound of the invention represented by the general formula (I-A) can be synthesized in the same manner as mentioned above. In this case, as the compound having a hydroxyl group represented by the general formula (I-a) there is used a compound of the general formula (I-a) wherein F has a triphenylamine skeleton, m is 1 and T is a methylene group.

The organic solvent for use herein is, for example, toluene, xylene, ethylbenzene, tetrahydrofuran, diethyl ether, dioxane, methylene chloride, 1,2-dichloroethane, chlorobenzene, N,N-dimethylformamide, or dimethylsulfoxide.

The base catalyst for use herein includes, for example, sodium hydroxide, potassium hydroxide, sodium methoxide, sodium tert-butoxide, potassium tert-butoxide, triethylamine, trimethylamine, pyridine, piperidine. Of those, more preferred are triethylamine and pyridine. The amount of the base catalyst to be used is preferably from 1 to 2 times by mol more preferably from 1.1 to 1.5 times by mol relative to the hydroxyl group of the compound of formula (I-a).

The reaction may be attained at any temperature not higher than the boiling point of the solvent used, but is more preferably at from room temperature to 50° C. for preventing side reaction.

The protective layer 7 may contain any of polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazole, polysilane, and polyester-type carrier transport polymer materials as in JP-A 8-176293 and 8-208820.

Of those mentioned above, preferred for use in this embodiment are thermosetting resins such as phenolic resins, thermosetting acrylic resins, thermosetting silicone resins, epoxy resins, melamine resins, urethane resins, polyimide resins and polybenzimidazole resins; and more preferred are phenolic resins, melamine resins, benzoguanamine resins, siloxane resins and urethane resins.

For the phenolic resins, usable are monomers of monomethylolphenols, dimethylolphenols or trimethylolphenols or their mixtures or oligomers, or mixtures of such monomers and oligomers, which are produced through reaction of resorcinol or bisphenol or other phenol structure-having compounds such as substituted phenols having one hydroxyl group, e.g., phenol, creso, xylenol, paraalphenol or paraphenryphenol, substituted phenols having two hydroxyl groups, e.g., catechol, resorcinol or hydroquinone, bisphenols or biphenols such as bisphenol A or bisphenol Z, with formaldehyde or paraformaldehyde, in the presence of an acid catalyst or an alkali catalyst. Of the compounds, those having from about 2 to 20 repetitive molecular structure units and therefore having a relatively large molecular weight are oligomers, and those smaller than such oligomers are monomers.

The acid catalyst includes, for example, sulfuric acid, paratoluenesulfonic acid, phenolsulfonic acid, phosphoric acid. The alkali catalyst includes, for example, alkali metal or alkaline earth metal hydroxides and oxides such as NaOH, KOH, $Ca(OH)_2$, $Mg(OH)_2$, $Ba(OH)_2$, CaO, MgO; amine catalysts; and acetates such as zinc acetate and sodium acetate. The amine catalysts include ammonia, hexamethylenetetramine, triethylamine, triethylamine, triethanolamine. When a basic catalyst is used, then the remaining catalyst may noticeably trap carriers and may therefore often worsen the electrophotographic properties of the photoreceptor. In such a case, therefore, the basic catalyst used is preferably inactivated or removed, for example, it is evaporated away under reduced pressure or is neutralized with an acid, or it is inactivated through contact with an adsorbent such as silica gel or with ion-exchange resin.

All types of melamine resins and benzoguanamine resins are usable herein, including, for example, methylol-type resins where free methylol groups remain as they are, full-ether-type resins where methylol groups are all alkyletherified, full-imino-type resins, and mixed-type resins having both methylol and imino groups. In view of the stability of coating liquids, preferred are ether-type resins.

For the urethane resins, herein usable are polyfunctional isocyanates or isocyanurates, as well as blocked isocyanates prepared by blocking them with alcohols or ketones. In view of the stability of coating liquids, preferred are blocked isocyanates or isocyanurates. The resin is mixed with a compound of formula (I), and the resulting mixture is applied and crosslinked under heat to form the protective layer.

For the silicone resins, herein usable are resins derived from compounds of a formula (IV) or (V) mentioned below.

One or more resins mentioned above may be used herein either singly or as combined. The blend ratio (by weight) of the compound of formula (I) to the resin is preferably from 10/1 to 1/5.

A compound of a formula (IV) may be added to the protective layer 7 for controlling various properties such as the strength and the film resistance of the layer.

$$Si(R^2)_{(4-c)}Q_c \quad (V)$$

wherein R2 represents a hydrogen atom, an alkyl group, or a substituted or unsubstituted aryl group; Q represents a hydrolyzable group; and c indicates an integer of from 1 to 4.

Examples of the compound of formula (IV) are silane coupling agents mentioned below. The silane coupling agents are tetrafunctional alkoxysilanes (c=4) such as tetramethoxysilane, tetraethoxysilane; trifunctional alkoxysilanes (c=3) such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, 1H,1H,2H,2H-perfluorooctyltriethoxysilane; difunctional alkoxysilanes (c=2) such as dimethyldimethoxysilane, diphenyldimethoxysilane, methylphenyldimethoxysilane; monofunctional alkoxysilanes (c=1) such as trimethylmethoxysilane. For improving the film strength, preferred are tri and tetrafunctional alkoxysilanes; and for improving the flexibility and the film-formability, preferred are mono and difunctional alkoxysilanes.

A silicone-based hard-coating agent comprising essentially of such a coupling agent may also be used herein. Also usable herein are commercially-available hard-coating agents such as KP-85, X-40-9740, X-40-2239 (all from Shin-etsu Silicone); and AY-42-440, AY42-441, AY49-208 (all from Toray Dow-Corning).

Preferably, a compound having at least two silicon atoms of the following formula (V) is added to the protective layer 7 for increasing the strength of the layer.

$$B—(Si(R^3)_{(3-d)}Q_d)_2 \quad (V)$$

wherein B represents a divalent organic group; $R^3$ represents a hydrogen atom, an alkyl group, or a substituted or unsubstituted aryl group; Q represents a hydrolyzable group; and d indicates an integer of from 1 to 3.

More concretely, preferred examples of the compound of formula (V) are the following compounds (V-1) to (V-16). In the Table, Me indicates a methyl group, Et indicates an ethyl group, and Pr indicates a propyl group.

TABLE 25

| | |
|---|---|
| V-1 | $(MeO)_3Si—(CH_2)_2—Si(OMe)_3$ |
| V-2 | $(MeO)_2MeSi—(CH_2)_2—SiMe(OMe)_2$ |
| V-3 | $(MeO)_2MeSi—(CH_2)_6—SiMe(OMe)_2$ |
| V-4 | $(MeO)_3Si—(CH_2)_6—Si(OMe)_3$ |
| V-5 | $(EtO)_3Si—(CH_2)_6—Si(OEt)_3$ |
| V-6 | $(MeO)_2MeSi—(CH_2)_{10}—SiMe(OMe)_2$ |
| V-7 | $(MeO)_3Si—(CH_2)_3—NH—(CH_2)_3—Si(OMe)_3$ |
| V-8 | $(MeO)_3Si—(CH_2)_3—NH—(CH_2)_2—NH—(CH_2)_3—Si(OMe)_3$ |
| V-9 | 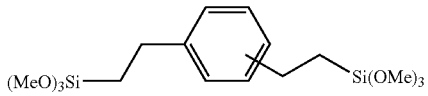 |
| V-10 | 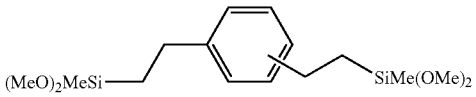 |
| V-11 | 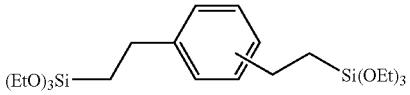 |

TABLE 25-continued

| | |
|---|---|
| V-12 | 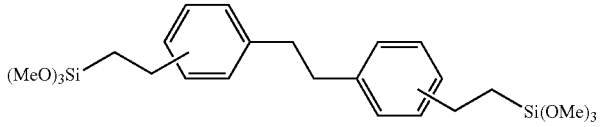 |
| V-13 | 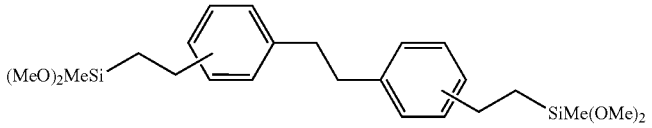 |
| V-14 | 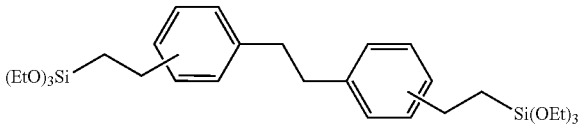 |
| V-15 | $(MeO)_3SiC_3H_6$—O—$CH_2CH\{$—O—$C_3H_6Si(OMe)_3\}$—$CH_2\{$—O—$C_3H_6Si(OMe)_3\}$ |
| V-16 | $(MeO)_3SiC_2H_4$—$SiMe_2$—O—$SiMe_2$—O—$SiMe_2$—$C_2H_4Si(OMe)_3$ |

If desired, a cyclic compound having repetitive structural units of the following formula (VI) or its derivative may be added to the protective layer 7 for pot life prolongation, control of film properties, torque reduction, and film surface uniformity improvement.

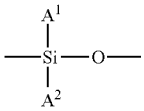

(VI)

wherein $A^1$ and $A^2$ each independently represent a monovalent organic group.

The cyclic compound having repetitive structural units of formula (VI) includes commercially-available cyclic siloxanes. Concretely, they are cyclic dimethylcyclosiloxanes such as hexamethylcyclotrisiloxane, octamethylcyclotetrasiloxane, decamethylcyclopentasiloxane, dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, 1,3,5,7,9-pentamethyl-1,3,5,7,9-pentaphenylcyclopentasiloxane; cyclic phenylcyclosiloxanes such as hexaphenylcyclotrisiloxane; fluorine atom-containing cyclosiloxanes such as 3-(3,3,3-trifluoropropyl)methylcyclotrisiloxane; methylhydrosiloxane mixtures, pentamethylcyclopentasiloxane; hydrosilyl group-containing cyclosiloxanes such as phenylhydrocyclosiloxane; vinyl group-containing cyclosiloxanes such as pentavinylpentamethylcyclopentasiloxane. One or more such cyclic siloxane compounds may be used herein either singly or as combined.

Conductive particles may be added to the protective layer 7 for reducing the residual potential of the layer. The conductive particles include metals, metal oxides, and carbon black Of those, preferred are metals and metal oxides. The metals include aluminium, zinc, copper, chromium, nickel, silver and stainless; and plastic particles coated with such metal through vapor deposition. The metal oxides include zinc oxide, titanium oxide, tin oxide, antimony oxide, indium oxide, bismuth oxide, tin-doped indium oxide, antimony or tantalum-doped tin oxide, antimony-doped zirconium oxide. One or more of these may be used herein either singly or as combined. When two or more of them are combined, they may be merely mixed or may be formed into solid solution or fused melt. Preferably, the mean particle size of the conductive particles is at most 0.3 μm, more preferably at most 0.1 μm in view of the transparency of the protective layer 7.

Various other particles may be added to the layer for controlling the pollutant deposition resistance, the lubricity and the hardness of the surface of the electrophotographic photoreceptor. One or more different types of such particles may be used herein either singly or as combined.

One example of the additional particles is silicon atom-containing particles. The silicon atom-containing particles are those containing a silicon atom as the constitutive element. Concretely, they are colloidal silica and silicone particles. Preferably, the colloidal silica for the silicon atom-containing particles has a mean particle size of from 1 to 100 nm, more preferably from 10 to 30 nm. It may be an acid or alkaline aqueous dispersion, or a dispersion in an organic solvent such as alcohol, ketone or ester. Ordinary commercial products of such colloidal silica are usable herein. Though not specifically defined, the solid content of the colloidal silica in the protective layer is preferably from 0.1 to 50% by weight, more preferably from 0.1 to 30% by weight based on the total solid content of the protective layer 7 in view of the film-formability, the electric properties and the strength of the layer.

The silicone particles of the silicon atom-containing particles are spherical particles preferably having a mean particle size of from 1 to 500 nm, more preferably from 10 to 100 nm, and they are selected from silicon resin particles, silicon rubber particles, and silica particles surface-treated with silicone. Ordinary commercial products of such silicone particles are usable herein.

Silicone particles are chemically-inactive fine particles of good dispersibility in resin. Since their amount necessary for giving sufficient properties may be small, they may well improve the surface condition of the electrophotographic photoreceptor not interfering with the crosslinking reaction in the surface layer of the photoreceptor. Specifically, the particles may be uniformly trapped in a strong crosslinked structure, and they may improve the surface lubricity and water-repellency of the electrophotographic photoreceptor, whereby the photoreceptor may keep good abrasion resistance and pollutant deposition resistance for a long period of time. The content of the silicone particles in the protective layer 7 is preferably from 0.1 to 30% by weight, more preferably from 0.5 to 10% by weight based on the total solid content of the protective layer 7.

Examples of other particles are fluorine-containing particles of ethylene tetrafluoride, ethylene trifluoride, propylene hexafluoride, vinyl fluoride or vinylidene fluoride; resin particles of a comonomer of fluororesin and hydroxyl group-having monomer, as in Preprint for 8th Polymer Material Forum Meeting, p. 89; and semiconductive metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO, MgO. For the same purpose, oil such as silicone oil may also be added to the layer.

The silicone oil includes, for example, ordinary silicone oils such as dimethylpolysiloxane, diphenylpolysiloxane, phenylmethylsiloxane; and reactive silicone oils such as amino-modified polysiloxanes, epoxy-modified polysiloxanes, carboxyl-modified polysiloxanes, carbinol-modified polysiloxanes, methacryl-modified polysiloxanes, mercapto-modified polysiloxanes, phenol-modified polysiloxanes. These may be previously added to the protective layer-forming coating liquid, or may be applied to the constructed photoreceptor by dipping the photoreceptor in such silicone oil under reduced pressure or increased pressure.

Also if desired, other additives such as plasticizer, surface modifier, antioxidant and light deterioration inhibitor may be added to the layer. The plasticizer includes, for example, biphenyl, chlorobiphenyl, terphenyl, dibutyl phthalate, diethylene glycol phthalate, dioctyl phthalate, triphenyl phosphate, methylnaphthalene, benzophenone, chloroparaffin, polypropylene, polystyrene, various fluorohydrocarbons. An antioxidant having a partial structure of hindered phenol, hindered amine, thioether or phosphite may be added to the protective layer 7, and it is effective for improving the potential stability and the image quality in environmental fluctuation.

The antioxidant includes the following compounds. For example, they are hindered phenol-type compounds such as Sumilizer BHT-R, Sumilizer MDP-S, Sumilizer BBM-S, Sumilizer WX-R, Sumilizer NW, Sumilizer BP-76, Sumilizer BP-101, Sumilizer GA-80, Sumilizer GM, Sumilizer Gs (all from Sumitomo Chemical), Irganox 1010, Irganox 1035, Irganox 1076, Irganox 1098, Irganox 1135, Irganox 1141, Irganox 1222, Irganox 1330, Irganox 1425WL, Irganox 1520L, Irganox 245, Irganox 259, Irganox 3114, Irganox 3790, Irganox 5057, Irganox 565 (all from Ciba Speciality Chemicals), Adekastab AO-20, Adekastab AO-30, Adekastab AO-40, Adekastab AO-50, Adekastab AO-60, Adekastab AO-70, Adekastab AO-80, Adekastab AO-330 (all from Asahi Denka); hindered amine-type compounds such as Sanol LS2626, Sanol LS765, Sanol LS770, Sanol LS744 (all from Sankyo Lifetec), Tinuvin 144, Tinuvin 622LD (both from Ciba Specialty Chemicals), Mark LA57, Mark LA67, Mark LA62, Mark A68, Mark LA63 (all from Asahi Denka), Sumilizer TPS (from Sumitomo Chemical); thioether-type compounds such as Sumilizer TP-D (from Sumitomo Chemical); phosphite-type compounds such as Mark 2112, Mark PEP·8, Mark PE+·24G, Mark PEP·36, Mark 329K, Mark HP·10 (all by Asahi Denka). In particular, hindered phenol-type and hindered amine-type antioxidants are preferred. These may be modified with a substituent such as an alkoxysilyl group crosslinkable with a material that forms a crosslinked film.

An insulating resin may be added to the protective layer 7 in a desired proportion The insulating resin includes, for example, polyvinylbutyral resins, polyarylate resins (e.g., bisphenol A/phthalic acid polycondensates), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, polyvinylpyrrolidone resins. The insulating resin is effective for preventing coating failures such as adhesion insufficiency to the carrier transport layer 6, thermal shrinkage of the layer 7 and the coating repellency in forming the layer 7.

The protective layer 7 may be formed by the use of the protective layer-forming coating liquid that contains the above-mentioned various constitutive materials. Specifically, the protective layer-forming coating liquid is applied onto the carrier transport layer 6, and cured thereon to form the protective layer 7.

When phenolic resin, melamine resin or benzoguanamine resin is used as the crosslinkable resin, the catalyst used for producing the resin is removed. Preferably, for this, the resin is dissolved in a suitable solvent such as methanol, ethanol, toluene or ethyl acetate, and washed with water or re-precipitated with a bad solvent, or the resin is processed with an ion-exchange resin or an inorganic solid.

The ion-exchange resin includes, for example, cation-exchange resins such as Amberlite 15, Amberlite 200C, Amberlite 15E (all from Rohm & Haas), Dowex NVC-1-H, Dowex 88, Dowex HCR-W2 (all from Dow Chemical), Levazitte SPC-108, Levazitte SPC-118 (both from Bayer), Diaion RCP-150H (from Mitsubishi Chemical), Sumikaion KC-470, Duolite C26-C, Duolite C-433, Duolite 464 (all from Sumitomo Chemical), Nafion-H (from DuPont); and anion-exchange resins such as Amberlite IRA-400, Amberlite IRA-45 (both from Rohm & Haas).

The inorganic solid includes inorganic solids with a proton acid group-containing group bonded to the surface such as $Zr(O_3PCH_2CH_2SO_3H)_2$, $Th(O_3PCH_2CH_2COOH)_2$; polyorganosiloxanes having a proton acid group such as polyorganosiloxanes having a sulfonic acid group; heteropolyacids such as cobalt-tungstic acid, phosphorus-molybdic acid; isopolyacids such as niobic acid, tantalic acid, molybdic acid; single metal oxides such as silica gel, alumina, chromia, zirconia, CaO, MgO; composite metal oxides such as silica-alumina, silica-magnesia, silica-zirconia, zeolite; clay minerals such as acid clay, active clay, montmorillonite, kaolinite; metal sulfates such as $LiSO_4$, $MgSO_4$; metal phosphates such as zirconia phosphate, lanthanum phosphate; metal nitrates such as $LiNO_3$, $Mn(NO_3)_2$; inorganic solids with an amino group-containing group bonded to the surface, such as a solid obtained through reaction of silica gel with aminopropyltriethoxysilane; and amino group-containing polyorganosiloxanes such as amino-modified silicone resins.

If desired, a solvent may be used in the protective layer-forming coating liquid. The solvent includes, for example, alcohols such as methanol, ethanol, propanol, butanol; ketones such as acetone, methyl ethyl ketone; ethers such as tetrahydrofuran, diethyl ether, dioxane. Apart from these, any other various solvents may also be used. For employing an ordinary dipping method generally used in producing electrophotographic photoreceptors, preferred are alcohol solvents, ketone solvents and their mixed solvents. Also preferably, the solvents have a boiling point of from 50 to 150° C. Desired solvents may be mixed in any desired manner for use herein. The amount of the solvent for use herein may be suitably determined, but if too small, then the coating liquid may readily form deposit. Preferably, therefore, the solvent amount is from 0.5 to 30 parts by weight, more preferably from 1 to 20 parts by weight relative to 1 part by weight of the total solid content in the protective layer-forming coating liquid.

For crosslinking, a curing catalyst may be used in the protective layer-forming coating liquid. Preferred examples of the curing catalyst are mentioned. They are a photo-acid generator, for example, bissulfonyldiazomethanes such as bis(isopropylsulfonyl)diazomethane; bissulfonylmethanes such as methylsulfonyl-p-toluenesulfonylmethane; sulfonylcarbonyldiazomethanes such as cyclohexylsulfonylcyclohexylcarbonyldiazomethane; sulfonylcarbonylalkanes such as 2-methyl-2-(4-methylphenylsulfonyl)propiophenone; nitrobenzyl sulfonates such as 2-nitrobenzyl p-toluenesulfonate; alkyl and aryl sulfonates such as pyrogallol trismethanesulfonate; benzoin sulfonates such as benzoin tosylate; N-sulfonyloxyimides such as N-(trifluoromethylsulfonyloxy)phthalimide; pyridones such as (4-fluorobenzenesulfonyloxy)-3,4,6-trimethyl-2-pyridone; sulfonates such as 2,2,2-trifluoro-1-trifluoromethyl-1-(3-vinylphenyl)-ethyl 4-chlorobenzenesulfonate; onium salts such as triphenylsulfonium methanesulfonate, diphenyliodonium trifluoromethanesulfonate; as well as compounds prepared through neutralization of a proton acid or a Lewis acid with a Lewis base, mixtures of Lewis acid and trialkyl phosphate, sulfonates, phosphates, onium compounds, and anhydrous carboxylic acid compounds.

The compounds prepared through neutralization of a proton acid or a Lewis acid with a Lewis base are, for example, those prepared by neutralizing halogenocarboxylic acids, sulfonic acids, sulfuric monoesters, phosphoric mono or diesters, polyphosphates or boric mono or diesters with various amines such as ammonia, monoethylamine, triethylamine, pyridine, piperidine, aniline, morpholine, cyclohexylamine, n-butylamine, monoethanolamine, diethanolamine, triethanolamine, or with trialkyl phosphine, triaryl phosphine, trialkyl phosphite, triaryl phosphite; and commercial products of acid-base block catalysts such as Neicure 2500X, 4167, X-47-110, 3525, 5225 (King Industries' trade names). The compounds prepared through neutralization of a Lewis acid with a Lewis base are, for example, those prepared by neutralizing a Lewis acid such as $BF_3$, $FeCl_3$, $SnCl_4$, $AlCl_3$ or $ZnCl_2$ with any of the above-mentioned Lewis bases.

Examples of the onium compound are triphenylsulfonium methanesulfonate, diphenyliodonium trifluoromethanesulfonate.

Examples of the anhydrous carboxylic acid compound are acetic anhydride, propionic anhydride, butyric anhydride, isobutyric anhydride, lauric anhydride, oleic anhydride, stearic anhydride, n-caproic anhydride, n-caprylic anhydride, n-capric anhydride, palmitic anhydride, myristic anhydride, trichloroacetic anhydride, dichloroacetic anhydride, monochloroacetic anhydride, trifluoroacetic anhydride, heptafluorobutyric anhydride.

Examples of the Lewis acid are metal halides such as boron trifluoride, aluminium trichloride, titanous chloride, titanic chloride, ferrous chloride, ferric chloride, zinc chloride, zinc bromide, stannous chloride, stannic chloride, stannous bromide, stannic bromide; organic metal compounds such as trialkylboron, trialkylaluminium, dialkyl-halogenoaluminium, monoalkyl-halogenoaluminium, tetraalkyltin; metal chelate compounds such as diisopropxyethyl acetatoaluminium, tris(ethylacetacetato)aluminium, tris(acetylacetonato)aluminium, diisopropoxy-bis(ethylacetacetato)titanium, diisopropxy-bis(acetylacetonato)titanium, tetrakis(n-propylacetacetato)zirconium, tetrakis(acetylacetonato) zirconium, tetrakis(ethylacetacetato)zirconium, dibutyl-bis (acetylacetonato)tin, tris(acetylacetonato)iron, tris (acetylacetonato)rhodium, bis(acetylacetonato)zinc, tris (acetylacetonato)cobalt; metal soaps such as dibutyltin dilaurate, dioctyltin maleate, magnesium naphthenate, calcium naphthenate, manganese naphthenate, iron naphthenate, cobalt naphthenate, copper naphthenate, zinc naphthenate, zirconium naphthenate, lead naphthenate, calcium octylate, manganese octylate, iron octylate, cobalt octylate, zinc octylate, zirconium octylate, tin octylate, lead octylate, zinc octylate, magnesium stearate, aluminium stearate, calcium stearate, cobalt stearate, zinc stearate, lead stearate. One or more of these may be used herein either singly or as combined.

Though not specifically defined, the amount of the catalyst to be used is preferably from 0.1 to 20 parts by weight, more preferably from 0.3 to 10 parts by weight relative to 100 parts by weight of the total solid content in the protective layer-forming coating liquid.

If desired, any of epoxy-containing compounds such as polyglycidyl methacrylate, glycidyl bisphenols, phenol-epoxy resins, as well as terephthalic acid, maleic acid, pyromellitic acid, biphenyltetracarboxylic acid or their anhydrides may be added to the layer for controlling the film properties such as the hardness, the adhesiveness and the flexibility of the layer. The amount of the additive may be from 0.05 to 1 part by weight, preferably from 0.1 to 0.7 parts by weight relative to 1 part by weight of the compound of formula (I)

For applying the protective layer-forming coating liquid onto the carrier transport layer 6, employable is any ordinary method such as a blade coating method, a Meyer bar coating method, a spraying method, a dipping method, a bead coating method, an air knife coating method or a curtain coating method. After applied, the coating film is dried to form the protective layer 7.

In forming the layer, when the necessary film thickness could not be obtained in single coating, then the coating operation may be repeated plural times to obtain the necessary film thickness. In such repeated coating, heating may be effected after every coating but may be effected only once after the final coating.

When the protective layer 7 is formed of a resin having a crosslinked structure, the resin is preferably crosslinked at a curing temperature of from 100° C. to 170° C., more preferably from 100 to 160° C. The curing time is preferably from 30 minutes to 2 hours, more preferably from 30 minutes to 1 hour. The heating temperature may be stepwise varied.

For the crosslinking reaction, preferred is a gas atmosphere inert to oxidation, such as nitrogen, helium or argon, as it prevents the electric properties of the film from being worsened. When the crosslinking reaction is effected in such an inert gas atmosphere, then the curing temperature may be higher than in an air atmosphere. Preferably, the curing temperature is from 100 to 180° C., more preferably from 110 to 160° C. The curing time is preferably from 30 minutes to 2 hours, more preferably from 30 minutes to 1 hour.

Preferably, the thickness of the protective layer is from 0.5 to 15 μm, more preferably from 1 to 10 μm, even more preferably from 1 to 5 μm.

Preferably, the oxygen transmission coefficient at 25° C. of the protective layer is at most $4\times10^{12}$ fm/s·Pa, more preferably at most $3.5\times10^{12}$ fm/s·Pa, even more preferably at most $3\times10^{12}$ fm/s·Pa.

The oxygen transmission coefficient is a criterion that indicates the easiness of oxygen gas transmission through the layer, but on the other hand, it may be considered as a characteristic factor substitutive for the physical porosity of the layer. When the type of the gas that passes through the layer varies, then the absolute value of the gas transmittance of the layer may vary. In any case, however, there is almost no inversion in the level of gas transmission between the layers tested. Accordingly, the gas transmission coefficient may be interpreted as a criterion that indicates the easiness of ordinary gas transmission through a layer.

Oxidation-degraded substances that are problematic in point of their adhesion to the surface of a long-life photoreceptor may form as follows: For example, NOx or ozone gas penetrates into the photosensitive layer of a photoreceptor, and a part of the layer is chemically degraded to give such oxidation-degraded substances. Accordingly, when gas transmission occurs more hardly through the outermost surface layer of a photoreceptor, or that is, when the oxygen transmission coefficient of the outermost surface layer thereof is smaller, then oxidation-degraded substances form more hardly on the layer and therefore the photoreceptor of the type is more advantageous for high-quality image formation and for long-life operation. On the other hand, when oxidation-degraded substances have formed and when they are kept adhering to the outermost surface of an electrophotographic photoreceptor, then they may have some negative influences on the quality of the image formed by the use of the photoreceptor. Accordingly, such oxidation-degraded substances must be removed by any method of using a cleaning blade or a brush. In order to stabilize the function of such a cleaning member for a long period of time, it is effective to apply a lubricant such as metal soap, higher alcohol, wax or silicone oil to the member.

In this embodiment, the outermost surface layer that contains the crosslinked structure-having resin of the invention may be, for example, the carrier transport layer 6 of the electrophotographic photoreceptor of FIG. 1.

When the photosensitive layer has a single-layered structure, the single-layered photosensitive layer is formed to contain a carrier generation material and a binder resin. The carrier generation material may be the same as that used in the carrier generation layer of the function-separated photosensitive layer; and the binder resin may be the same as that used in the carrier generation layer and the carrier transport layer of the function-separated photosensitive layer. The content of the carrier generation material to be in the single-layered photosensitive layer is preferably from 10 to 80% by weight, more preferably from 20 to 50% by weight based on the total solid content of the single-layered photosensitive layer. For improving the photoelectric properties thereof, the single-layered photosensitive layer may contain a carrier transport material or a carrier transport polymer material added thereto. The amount of the material is preferably from 5 to 50% by weight based on the total solid content of the single-layered photosensitive layer. The solvent for the coating liquid and the coating method for the single-layered photosensitive layer may be the same as those mentioned hereinabove. Preferably, the thickness of the single-layered photosensitive layer is from 5 to 50 μm or so, more preferably from 10 to 40 μm or so.

When the single-layered photosensitive layer 3 is the outermost surface layer of the electrophotographic photoreceptor 1 as in FIG. 4, then the layer 3 may be formed by the use of a coating liquid that contains a carrier generation material, a carrier transport material, a compound having a structure of formula (I) or its derivative, and optionally other materials, in the same manner as the protective layer 7 of the electrophotographic photoreceptor 1 of FIG. 2.

(Image-Forming Apparatus)

The image-forming apparatus of the invention comprises the electrophotographic photoreceptor of the invention, a charging device that charges the electrophotographic photoreceptor, an exposing device that exposes the charged electrophotographic photoreceptor to light to form an electrostatic latent image thereon, a developing device that develops the electrostatic latent image to form a toner image, and a transfer device that transfers the toner image onto a transfer medium.

The image-forming apparatus of the invention may have a photoreceptor unit comprising at least the electrophotographic photoreceptor; and a developing unit comprising at least the developing device, wherein the photoreceptor unit and the developing unit are separated from each other.

Preferably, the image-forming apparatus of the invention further comprises a blade cleaner as a cleaning device that removes a remaining toner on the electrophotographic photoreceptor after the transfer step.

Also preferably, in the image-forming apparatus of the invention, the electrophotographic photoreceptor is fixed to the body of the apparatus and the blade cleaner is detachably fixed thereto.

Also preferably, in the image-forming apparatus of the invention, the electrophotographic photoreceptor is fixed to the body of the apparatus and the charging device is detachably fixed thereto.

Also preferably, the image-forming apparatus of the invention further comprises a fibrous member fittable to the electrophotographic photoreceptor.

Also preferably, the image-forming apparatus of the invention further comprises an intermediate transfer medium.

Also preferably, the image-forming apparatus of the invention is a tandem system that comprises plural image-forming units in which the units each comprise the electrophotographic photoreceptor having a diameter of at most 30 mm, the charging device, the exposing device, the developing device and the transfer device.

The image-forming apparatus may comprises a plurality of image-forming units each of which comprises: the electrophotographic photoreceptor; the charging device; the exposing device; and the developing device, wherein the transfer device comprises an intermediate transfer medium that primarily transfers the toner image formed on the electrophotographic photoreceptor and secondarily transfers the primarily-transferred image onto the transfer medium, and wherein said plurality of image-forming units are located on the intermediate transfer medium.

Also preferably, in the image-forming apparatus of the invention, the exposing device is a multi-beam surface-emitting laser.

Also preferably, in the image-forming apparatus of the invention, the developing device is for development with a toner having a mean sphericity coefficient of from 100 to 150 and a volume-average particle size of from 3 to 12 μm.

Also preferably, the image-forming apparatus of the invention is driven while a lubricant substance is fed to the electrophotographic photoreceptor.

The image-forming apparatus of the invention may have a lubricant supplying device the supplies a lubricant to the electrophotographic photoreceptor.

Figure 6:
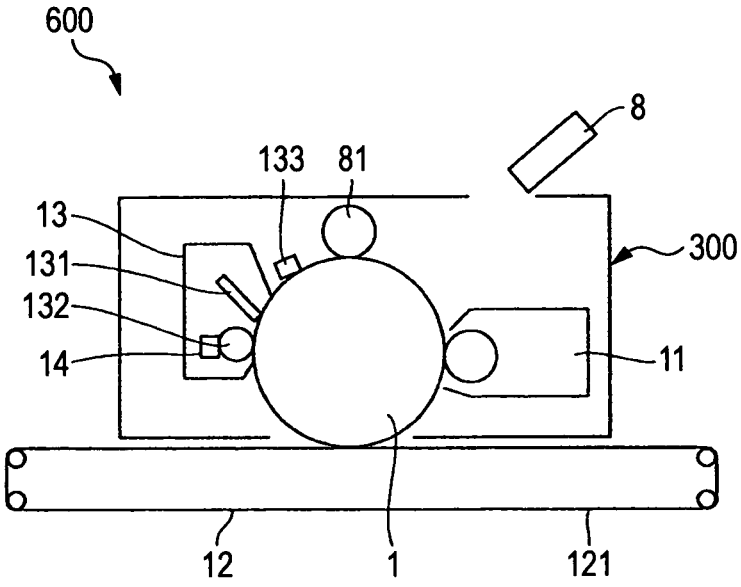
FIG. 6 is a schematic cross-sectional view showing one preferred embodiment of the image-forming apparatus of the invention.

FIG. 6 is a schematic view showing one preferred embodiment of the image-forming apparatus of the invention. The image-forming apparatus 600 of FIG. 6 comprises a process cartridge 300 serving as an image-forming unit and an intermediate transfer belt 12 serving as a transfer device 121 for transferring the image on the electrophotographic photoreceptor 1 developed by the photoreceptor 11. The process cartridge 300 comprises an electrophotographic photoreceptor 1, a charging device 81 for charging the electrophotographic photoreceptor 1 in a contact mode, an exposing device 8 for exposing the charged electrophotographic photoreceptor 1 to light, a developing device 11 for developing the exposed part of the photoreceptor 1 by the exposing device 8, and a cleaning device that comprises a fibrous member (roll) 132, a cleaning blade 131 and a fibrous member (tooth brush-like member) 133. The process cartridge 300 is kept detachable from the body of the image-forming apparatus that comprises any other constitutive parts not shown, and this constitutes the image-forming apparatus along with the body of the electrophotographic apparatus. Reference number 14 denotes lubricant.

The charging device 81 is for charging the electrophotographic photoreceptor 1 in a contact mode. The developing device 11 is for developing the electrostatic latent image on the electrophotographic photoreceptor 1 to form a toner image.

The toner used in the developing device 11 is described below. Preferably, the toner has a mean sphericity coefficient ($ML^2/A$) of from 100 to 150, more preferably from 100 to 140. Also preferably, the toner has a volume-average particle size of from 2 to 12 μm, more preferably from 3 to 12 μm, even more preferably from 3 to 9 μm. Using the toner that satisfies the mean sphericity coefficient and the volume-average particle size ensures good developability and transferability and gives high-quality images.

So far as it satisfies the mean sphericity coefficient and the volume-average particle size as above, the toner is not specifically defined in point of its production method. For example, the toner for use herein may be produced according to a kneading and grinding method of kneading a binder resin, a colorant and a lubricant and optionally an antistatic agent, then grinding the mixture and classifying it; a method of further processing the particles obtained according to the kneading and grinding method, by applying mechanical shock or thermal energy thereto to change their shape; an emulsion polymerization aggregation method of mixing a dispersion that is formed through emulsion polymerization of a polymerizing monomer for a binder resin, with a colorant and a lubricant and optionally an antistatic agent, and aggregating and fusing it under heat to obtain toner particles; a suspension polymerization method of suspending a solution of a polymerizing monomer for a binder resin, and a colorant and a lubricant, and optionally an antistatic agent, in an aqueous solvent and polymerizing it; or a solution suspension method of suspending a solution of a binder resin, a colorant and a lubricant and optionally an antistatic agent, in an aqueous solvent and granulating it.

In addition, any other known method is also employable herein, for example, a method of producing core/shell toner particles that comprises adhering aggregated particles to the core toner particles obtained according to the method as above, and heating and fusing them to give toner particles having a core/shell structure. For producing the toner for use herein, especially preferred are the suspension polymerization method, the emulsion polymerization aggregation method and the solution suspension method in which the toner particles are produced in an aqueous solvent, since the methods facilitate sphericity control and particle size distribution control; and more preferred is the emulsion polymerization aggregation method.

The toner base particles comprise a binder resin, a colorant and a lubricant, and optionally contain silica and an antistatic agent.

The binder resin for the toner base particles includes homopolymers and copolymers of styrenes such as styrene, chlorostyrene; monoolefins such as ethylene, propylene, butylene, isobutylene; vinyl esters such as vinyl acetate, vinyl propionate, vinyl benzoate, vinyl butyrate; α-methylene-aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate; vinyl ethers such as vinyl methyl ether, vinyl ethyl ether, vinyl butyl ether; vinyl ketones such as vinyl methyl ketone, vinyl hexyl ketone, vinyl isopropenyl ketone; and polyester resins formed through copolymerization of dicarboxylic acids and diols.

Typical examples of the binder resin are polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, polyester resins. In addition, polyurethane, epoxy resins, silicone resins, polyamides, modified rosins, and paraffin wax are also usable as the binder resin.

Typical examples of the colorant are magnetic powders such as magnetite, ferrite; and carbon black, aniline blue, calyl blue, chrome yellow, ultramarine blue, DuPont oil red, quinoline yellow, methylene blue chloride, phthalocyanine blue, malachite green oxalate, lamp black, rose bengal, C.I. Pigment Red 48:1, C.I, Pigment Red 122, C.I. Pigment Red 57:1, C.I. Pigment Yellow 97, C.I. Pigment Yellow 17, C.I. Pigment Blue 15:1, C.I. Pigment Blue 15:3.

Typical examples of the lubricant are low-molecular polyethylene, low-molecular polypropylene, Fischer-Tropsch wax, montan wax, carnauba wax, rice wax, candelilla wax.

The antistatic agent may be any known one, for which, for example, usable are azo-type metal complex compounds, salicylate metal complex compounds, and polar group-having resin-type antistatic agents. When the toner is produced according to a wet process, then it is desirable to use hardly water-soluble materials from the viewpoint of ionic strength control and reduction in waste pollution. The toner may be either a magnetic toner that contains a magnetic material or a non-magnetic toner not containing a magnetic material.

The toner for use in the developing device 11 may be produced by mixing the toner base particles and the external additives mentioned above, in a Henschel mixer or a V blender. When the toner base particles are produced in a wet process, then the external additives may be added thereto also in a wet process.

Lubricant particles may be added to the toner for use in the developing device 11. For the lubricant particles, herein usable are solid lubricants such as graphite, molybdenum disulfide, talc, fatty acids, metal salts of fatty acids; low-molecular-weight polyolefins such as polypropylene, polyethylene, polybutene; silicones having a softening point under heat; fatty acid amides such as oleamide, erucamide, ricinoleamide, stearamide; vegetable waxes such as carnauba wax, rice wax, candelilla wax, haze wax, jojoba oil; animal waxes such as bees wax; mineral petroleum waxes such as montan wax, ozokerite wax, ceresine, paraffin wax, microcrystalline wax, Fisher-Tropsch wax; and their modified derivatives. One or more these may be used herein either singly or as combined. Preferably, the lubricant particles have a mean particle size of from 0.1 to 10 μm. The substances having the above-mentioned chemical structure may be ground and dressed into particles having a uniform particle size. The amount of the lubricant particles to be added to the toner is preferably from 0.05 to 2.0% by weight, more preferably from 0.1 to 1.5% by weight.

Inorganic particles, organic particles, or composite particles prepared by adhering inorganic particles to organic particles may be added to the toner for use in the developing device 11, for the purpose of removing sticky substances or degraded substances from the surface of the electrophotographic photoreceptor.

For the inorganic particles, preferably used are various inorganic oxides, nitrides and borides such as silica, alumina, titania, zirconia, barium titanate, aluminium titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, boron nitride.

The inorganic particles may be processed with a titanium coupling agent such as tetrabutyl titanate, tetraoctyl titanate, isopropyltriisostearyl titanate, iropropyltridecyl benenesulfonyltitanate, bis(dioctylpyrophosphate)oxyacetate titanate; or a silane coupling agent such as γ-(2-aminoethyl)aminopropyltrimethoxysilane, γ-(2-aminoethyl) aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, p-methylphenyltrimethoxysilane. Those processed for hydrophobication with silicone oil or a higher fatty acid metal salt such as aluminium stearate, zinc stearate or calcium stearate are also preferably used herein.

The organic particles include styrene resin particles, styrene-acrylic resin particles, polyester particles, urethane particles.

Preferably, the mean particle size of the additive particles is from 5 nm to 1000 nm, more preferably from 5 nm to 800 nm, even more preferably from 5 nm to 700 nm. If the mean particle size thereof is smaller than the lowermost limit, then the abrasive capability of the particles may be poor; but if larger than the uppermost limit, then the particles may scratch the surface of the electrophotographic photoreceptor. Preferably, the total amount of the above-mentioned additive particles and the lubricant particles is at least 0.6% by weight.

Regarding other inorganic oxides to be added to the toner, it is desirable that small-size inorganic oxide particles having a primary particle size of at most 40 nm are added thereto for powdery flowability and charge control and those larger than the former are added for stickiness reduction and charge control. For such inorganic oxide particles, any known ones may be used. For these, preferred is a combination of silica and titanium oxide for precision charge control. Surface treatment of the small-size inorganic particles increases the dispersibility of the particles, and the resulting particles are more effective for enhancing the powdery flowability of toner. In addition, carbonates such as calcium carbonate and magnesium carbonate, as well as inorganic minerals such as hydrotalcite are also preferred for use in the toner for the purpose of removing discharged substances.

For its use, the electrophotographic color toner is mixed with a carrier. The carrier includes iron powder, glass beads, ferrite powder, nickel powder, and those coated with resin. The blend ratio of the toner and the carrier may be suitably defined.

The cleaning device 13 comprises a fibrous member (roll) 132 and a cleaning blade 131.

In the illustrated embodiment, the cleaning device 13 comprises both a fibrous member 132 and a cleaning blade 131. However, the cleaning device for use in the invention may have any one of these. The fibrous member 132 is a roll, but it may also be a tooth brush-like member. The fibrous member 132 may be fixed to the body of the cleaning device, or may be rotatably supported by the body, or may be supported by it in such a manner that it can oscillate in the axial direction of the photoreceptor. The fibrous member 132 may be formed of a cloth of polyester, nylon, acryl, or a cloth of ultrafine fibers such as Tracy (by Toray), or may have a brush-like structure formed by planting resin fibers of nylon, acryl, polyolefin, polyester or the like on a substrate or a carpet. The fibrous member 132 as above may be conductive as containing a conductive powder or an ion-conductive agent therein, or may be so designed that every constitutive fiber has a conductive layer formed inside or outside it. The conductive fibrous member of the type is preferably so designed that its constitutive fibers have a resistance of from $10^2$ to $10^9\Omega$. Also preferably, the thickness of the constitutive fibers of the fibrous member 132 is at most 30 d (denier), more preferably at most 20 d; and the fiber density of the member is preferably at least 20,000/inch$^2$, more preferably at least 30,000/inch$^2$.

Comprising the cleaning blade and the cleaning brush, the cleaning device 13 is required to remove the adhered substances (e.g., discharged substances) from the surface of the photoreceptor. For satisfying the object for a long period of time and for stabilizing the function of the cleaning members, it is desirable that a lubricant substance (lubricant component) such as metal soap, higher alcohol, wax or silicone oil is applied to the cleaning members.

For example, when the fibrous member 132 is a roll, then it is desirable that the roll member is contacted with a lubricant substance such as metal soap or wax and the lubricant component is supplied to the surface of the electrophotographic photoreceptor. The cleaning blade 131 may be an ordinary rubber blade. When the cleaning blade 131 is such an ordinary rubber blade, it is especially effective to supply a lubricant component to the surface of the electrophotographic photoreceptor for the purpose of preventing the blade from being cracked or worn.

The exposing device 8 may be any one capable of exposing the charged electrophotographic photoreceptor 1 to light so as to form an electrostatic latent image thereon. The light source of the exposing device 8 is preferably a multi-beam surface-emitting laser.

The transfer device 12 may be any one capable of transferring the toner image formed on the electrophotographic photoreceptor onto a transfer medium (intermediate transfer medium, recording medium). For the intermediate transfer medium, herein usable is a belt of polyimide, polyamidimide, polycarbonate, polyarylate, polyester or rubber (intermediate transfer belt). Apart from such a belt, a drum may also be used for the intermediate transfer medium. A direct transfer-type image-forming apparatus does not have such an intermediate transfer medium, and the electrophotographic photoreceptor of the invention is favorable to the image-forming apparatus of that type. The reason is as follows: In a direct transfer-type image-forming apparatus, paper dust or talc released by printing paper may often adhere to the electrophotographic photoreceptor and image defects caused by the deposit may often occur. However, since the electrophotographic photoreceptor of the invention has good cleanability, removal of paper dust and talc from it is easy. Accordingly, even in a direct transfer-type image-forming apparatus, the photoreceptor of the invention enables stable image formation.

Figure 7:
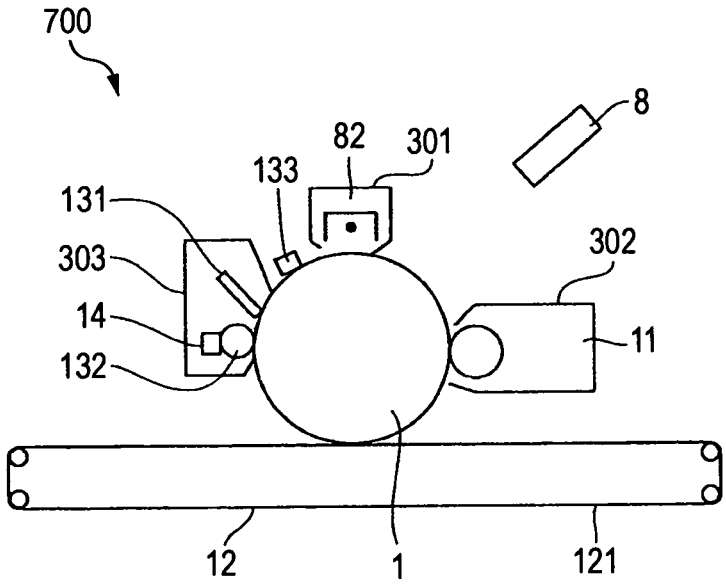
FIG. 7 is a schematic cross-sectional view showing another preferred embodiment of the image-forming apparatus of the invention.

FIG. 7 is a schematic view showing another embodiment of the image-forming apparatus of the invention. In the image-forming apparatus 700 of FIG. 7, the electrophotographic photoreceptor 1 is fixed to the body of the image-forming apparatus, and a charger cartridge 301, a developer cartridge 302 and a cleaner cartridge 303 are fitted thereto independently of each other. The charger cartridge 301 is equipped with a corona discharging-type charging unit 82.

Since the electrophotographic photoreceptor of the invention has good abrasion resistance, it may be unnecessary to set it in a cartridge. Accordingly, different from the charger cartridge 301, the developer cartridge 302 and the cleaner cartridge 303, in which the charging device, the developing device and the cleaning device are fixed to the respective bodies by screwing, calking, bonding or welding, the electrophotographic photoreceptor may be detachably fitted to the body of the image-forming apparatus by leading or extrusion, and the apparatus cost per one print with it may be reduced. Two or more of these devices may be integrated and set in one cartridge, and the cartridge may be detachably fitted to the body of the image-forming apparatus, and with it, the apparatus cost per one print may also be reduced.

Figure 8:
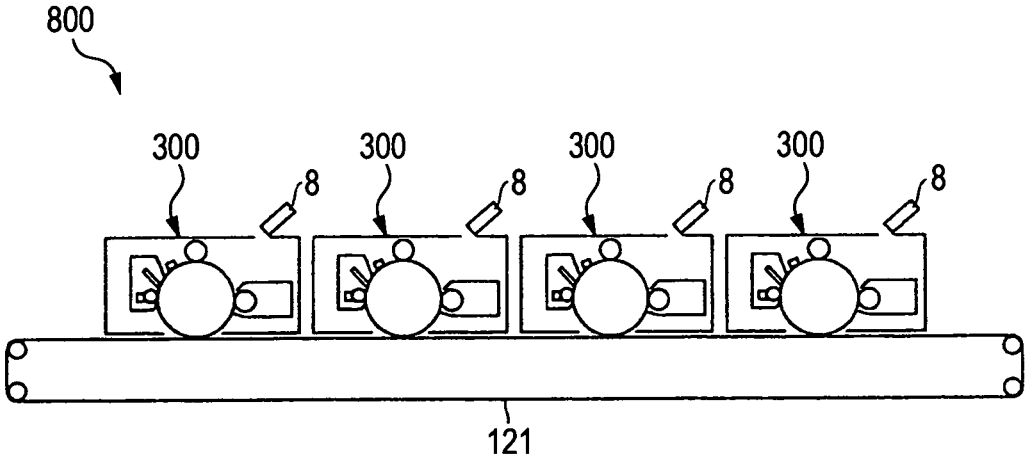
FIG. 8 is a schematic cross-sectional view showing still another preferred embodiment of the image-forming apparatus of the invention.

FIG. 8 is a schematic view showing still another embodiment of the image-forming apparatus of the invention. The image-forming apparatus 800 is a tandem-type full-color image-forming apparatus equipped with four process cartridges 300. The image-forming apparatus 800 is so designed that four process cartridges 300 are disposed in parallel to each other on an intermediate transfer medium 121 and one electrophotographic photoreceptor is used for one color. Except that it is a tandem-system apparatus, the image-forming apparatus 800 has the same constitution as that of the image-forming apparatus 600.

In the tandem-type image-forming apparatus 800, the electrophotographic photoreceptors differ from each other in point of the degree of abrasion thereof depending on the ratio of the respective color toners used, and therefore the electrophotographic photoreceptors may also differ from each other in point of the electric properties thereof With that, the toner developability may gradually change from the original stage and the color tone of the printed image may also change, and, as a result, stable images could not be obtained. In particular, since downsized image-forming apparatus is desired these days, the electrophotographic photoreceptor to be in such a downsized apparatus tends is also desired to be downsized, and when a photoreceptor having a size of 30 mmϕ or smaller is used, then the problem as above is remarkable. In that condition, when the electrophotographic photoreceptor is used in such a down-sized image-forming apparatus and even when its diameter is 30 mmϕ or smaller, the surface of the photoreceptor may be prevented from being worn. Accordingly, the electrophotographic photoreceptor of the invention is especially effective in a tandem-type image-forming apparatus.

Figure 9:
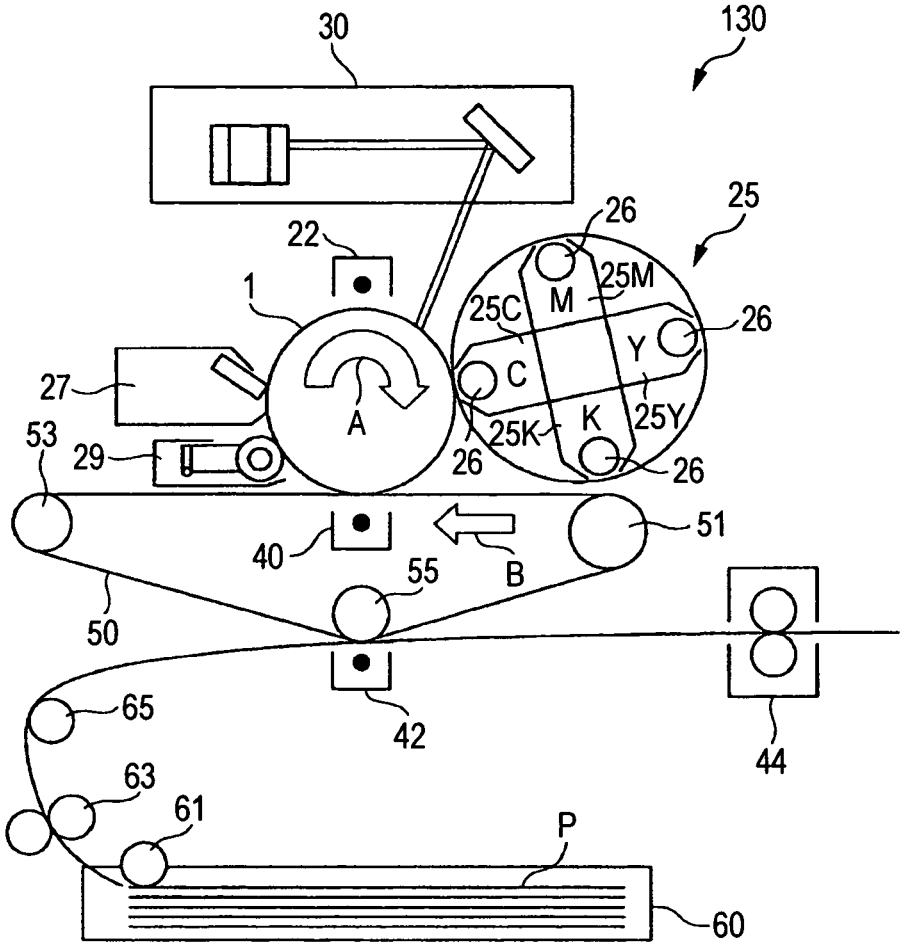
FIG. 9 is a schematic cross-sectional view showing still another preferred embodiment of the image-forming apparatus of the invention.

FIG. 9 is a schematic view showing still another embodiment of the image-forming apparatus of the invention. The image-forming apparatus 130 of FIG. 9 is a four-cycle image-forming apparatus in which plural color toner images are formed with one electrophotographic photoreceptor. The image-forming apparatus 130 is equipped with a photoreceptor drum 1, which is rotated in the direction of the arrow A in the drawing at a predetermined revolution speed by a driving device (not shown), and above the photoreceptor drum 1, a charging device 22 is provided which charges the outer peripheral surface of the photoreceptor drum 1.

Above the charging device 22, an exposing device 30 is disposed which comprises a surface-emitting laser array as an exposure light source. The exposing device 30 modulates the plural laser beams emitted by the light source in accordance with the image to be formed while deflecting them in the main scanning direction, and scan them on the outer peripheral surface of the photoreceptor drum 1 in the direction parallel to the axial line of the photoreceptor drum 1. As a result, an electrostatic latent image is formed on the outer peripheral surface of the charged photoreceptor drum 1.

On the side of the photoreceptor drum 1, disposed is a developing device 25. The developing device 25 has a roller housing rotatably fitted to the drum. Inside the housing, four chambers are formed, and the chambers separately have developing units 25Y, 25M, 25C and 25K. The developing units 25Y, 25M, 25C and 25K each are equipped with a developing roller 26, and they each contain the respective Y(yellow), M(magenta), C(cyan) and K(black) toners.

Full color image formation in the image-forming apparatus 130 is attained while the photoreceptor drum 1 rotates 4 times. Specifically, while the photoreceptor drum 1 rotates 4 times, the charging device 22 charges the outer peripheral surface of the photoreceptor drum 1, and the exposing device 20 scans the laser beams modulated in accordance with any of the image data of Y, M, C and K that indicate the color image to be formed, on the outer peripheral surface of the photoreceptor drum 1. At every rotation of the photoreceptor drum 1, the image data for the modulation of the laser beams are changed, and the operation is repeated four times. The developing device 25 is driven as follows: While the developing roller 26 of any of the developing units 25Y, 25M, 25C and 25K is kept in contact with the outer peripheral surface of the photoreceptor drum 1, the developing unit that is in contact with the outer peripheral surface of the drum is driven so as to develop the electrostatic latent image formed on the outer peripheral surface of the photoreceptor drum 1 in a specific color, whereby a toner image of the specific color is formed on the outer peripheral surface of the photoreceptor drum 1. At every rotation of the photoreceptor drum 1, the housing of the developing device is so rotated that the developing unit for the development of the electrostatic latent image may be changed. Accordingly, at every rotation of the photoreceptor drum 1, any one of Y(yellow), M(magenta), C(cyan) and K(black) toner images is successively formed on the outer peripheral surface of the photoreceptor drum 1, overlapping with the underlying image; and after four rotations of the photoreceptor drum 1, a full-color toner image is thus formed on the outer peripheral surface of the photoreceptor drum 1.

Nearly below the photoreceptor drum 1, an endless intermediate transfer belt 50 is disposed. The intermediate transfer belt 50 is hung to run around rollers 51, 53 and 55, and its outer peripheral surface is kept in contact with the outer peripheral surface of the photoreceptor drum 1. The rollers 51, 53 and 55 rotate, receiving a driving power from motors (not shown), and they rotate the transfer intermediate belt 50 in the direction of the arrow B in FIG. 9.

On the opposite side of the photoreceptor drum 1 via the intermediate transfer belt 50 therebetween, a transfer device 40 is disposed. The transfer device 40 is for transferring the toner image formed on the outer peripheral surface of the photoreceptor drum 1 onto the image-forming surface of the intermediate transfer belt 50.

On the opposite side of the developing device 25 via the photoreceptor drum 1 therebetween, a lubricant-feeding device 29 and a cleaning device 27 are disposed while kept in contact with the outer surface of the photoreceptor drum 1. When the toner image formed on the outer peripheral surface of the photoreceptor drum 1 is transferred onto the intermediate transfer belt 50, then a lubricant is fed to the outer peripheral surface of the photoreceptor drum 1 from the lubricant-feeding device 29, and the region of the outer peripheral surface of the drum having carried the toner image is cleaned by the cleaning device 27.

Below the intermediate transfer belt 50, a tray 60 is disposed, and a large number of sheets of copying paper P, as a recording material, are piled up in the tray 60. On the left oblique upper side of the tray 60, a take-up roller 61 is disposed, and a pair of rollers 63 and a roller 65 are disposed in that order downstream the traveling direction of the paper P from the take-up roller 61. The recording paper on the uppermost position in the pile thereof is taken out of the tray 60 at every rotation of the take-up roller 61, and is then conveyed by the pair rollers 63 and the roller 65.

On the opposite side of the roller 55 via the intermediate transfer belt 50 therebetween, a transfer device 42 is disposed. The copying paper P conveyed by the pair rollers 63 and the roller 65 is led between the intermediate transfer belt 50 and the transfer device 42, and the toner image formed on the image-forming surface of the intermediate transfer belt 50 is thus transferred onto the paper P by the transfer device 42. On the side downstream the traveling direction of the paper P from the transfer device 42, a fixing device with a pair of fixing rollers therein is disposed, in which the copying paper P with the toner image transferred thereon is fused and fixed thereon by the fixing device 44, and then this is led out of the image-forming apparatus 130 and put on a paper tray (not shown).

(Coating Solution Comprising a Charge-Transporting compound of the Invention)

An embodiment of the use of the charge-transporting compound of the invention represented by the general formula (I-A) as a protective layer for electrophotographic photoreceptor has been already described. Embodiments of the coating solution comprising the charge-transporting compound of the invention and the formation of a functional layer by the coating solution will be described hereinafter.

The coating solution according to the present embodiment is formed by a compound represented by the general formula (I-A), a binder resin and an organic solvent. The compounds represented by the general formula (I-A) may be used singly or in combination of two or more thereof.

From the standpoint of prolongation of pot life of coating solution, a compound of the general formula (I-A) wherein $R^1$, $R^2$ and $R^3$ each independently represent an organic group represented by —$CH^2$—$R^4$ (in which $R_4$ represents a hydrogen atom, halogen atom or $C_1$-$C_{17}$ organic group) is preferably used.

Examples of the binder resin employable herein include thermoplastic resins such as polyester resin, polycarbonate resin, polyarylate resin, acrylic resin and methacrylic resin, and thermosetting resins such as phenolic resin, thermosetting acrylic resin, thermosetting silicon resin, epoxy resin, melamine resin, urethane resin, polyimide resin and polybenzimidazole resin.

Examples of the organic solvent employable herein include ordinary organic solvents such as aromatic hydrocarbon (e.g., benzene, toluene, xylene, chlorobenzene), ketone (e.g., acetone, 2-butanone), halogenated aliphatic hydrocarbon (e.g., methylene chloride, chloroform, ethylene chloride) and cyclic or straight-chain ether (e.g., tetrahydrofurane, ethyl ether). These organic solvents may be used singly or in combination of two or more thereof.

The aforementioned coating solution may contain a electron-transporting compound or a charge-transporting compound other than the compound represented by the general formula (I-A) to control the electrical properties of the resulting coating solution. Examples of the electron-transporting compound employable herein include quinone-based compounds such as p-benzoquinone, chloranyl, bromanyl and anthraquinone, fluorenone compounds such as tetracyanoquinodimethane-based compound and 2,4,7-trinitrofluorenone, xanthone-based compounds, benzophenone-based compounds, cyanovinyl-based compounds and ethylene-based compounds. Examples of the charge-transporting compound other than the compound represented by the general formula (I-A) include triarylamine-based compounds, benzidine-based compounds, arylalkane-based compounds, aryl-substituted ethylene-based compounds, stilbene-based compounds, anthracene-based compounds, and hydrazone-based compounds.

The mixing proportion (by weight) of charge-transporting compound to binder resin in the coating solution is preferably from 10:1 to 1:5.

As a method for forming a functional layer from the aforementioned coating solution there may be used a method which comprises spreading the coating solution over the surface of the material to be coated, and then heating the coated material to a predetermined temperature. Examples of the spreading method employable herein include blade coating method, wire bar coating method, spray coating method, dip coating method, bead coating method, air knife coating method, curtain coating method, and spin coating method.

In the case where the coating solution according to the present embodiment comprises a thermoplastic resin as a binder resin, the thermoplastic resin and the charge-transporting compound of the invention are fairly dispersed in the coating solution to become compatible with each other. The resulting functional layer can be uniform. Therefore, crystal precipitation or coat layer roughening due to defective film formation can be sufficiently prevented. Further, a functional layer having excellent electrical properties can be formed. Accordingly, the coating solution having a thermoplastic resin incorporated therein as a binder resin can be used for various optical functional elements (e.g., organic electroluminescence element, memory element, wavelength conversion element) but is more effectively used to form the charge-transporting layer of electrophotographic photoreceptor in particular. The temperature to which the coat layer is heated is preferably from 60° C. to 200° C., more preferably from 100° C. to 150° C.

In the case where the coating solution according to the present embodiment comprises a thermosetting resin incorporated therein as a binder resin, when a functional layer is formed by the coating solution, the charge-transporting compound of the invention can undergo decarboxylation at room temperature under weak acid conditions. The charge-transporting compound and the thermosetting can be fairly compatibilized with each other to react with each other while suppressing undesired side reactions and can be sufficiently connected to polar groups which can be carrier traps. Thus, a functional layer which can satisfy both the requirements for mechanical strength and electrical properties can be formed. Accordingly, the coating solution having a thermosetting resin incorporated therein as a binder resin can be used for various optical functional elements (e.g., organic electroluminescence element, memory element, wavelength conversion element) but is more effectively used to form the protective layer of electrophotographic photoreceptor in particular. In the present embodiment, as the acidifying compound there may be used a phenol, hydrochloric acid, acetic acid, sulfonic acid, toluenesulfonic acid, phosphoric acid, silica gel, Lewis acid, acidic ion exchange resin or the like. Thus, the acidifying compound of the invention is not specifically limited. The temperature to which the coat layer is heated is properly predetermined depending on the curing temperature of the resin used and the kind of the solvent used.

The reason why the coating solution according to the invention is preferably used to form the protective layer of electrophotographic photoreceptor is also as follows. In general, in the case where an outermost layer of photosensitive layer is provided, it is often practiced to use an alcohol-based or ketone-based solvent so that the underlying photosensitive layer cannot be attacked as much as possible. However, the related art charge-transporting material can be insufficiently dissolved in these solvents and thus can difficultly form a good crosslinked film. On the contrary, in accordance with the coating solution of the invention, the charge-transporting compound according to the invention can be fairly dissolved in alcohol-based or ketone-based solvents and thus can form a coating solution excellent in film-forming properties, making it assured that an outermost layer excellent in electrical properties and mechanical strength can be formed while suppressing the effect on the underlying layer. In this arrangement, the resulting electrophotographic photoreceptor can be provided with a high image quality and a prolonged life to a higher extent.

As the compound to be used in combination with a thermosetting resin there is preferably a compound of the general formula (I-A) wherein the sum of n1, n2 and n3 is 2 or more. In this arrangement, a rigider film can be easily obtained.

The coating solution according to the present embodiment preferably comprises a phenolic resin incorporated therein as a thermosetting resin. As the phenolic resin there may be used one to be incorporated in the protective layer 7 of the aforementioned electrophotographic photoreceptor 1. In this case, it is thought that some of the carboxylic groups in the charge-transporting compound partly reacts with the hydroxyl group in the phenolic resin and leaves from the charge-transporting compound in the coating solution. The charge-transporting compound thus reacted is ether-bonded to the hydroxyl group in the phenolic resin. In this manner, the phenolic resin contained in the coating solution has the charge-transporting compound of the invention complexed therewith (prepolymerization). This prepolymerization makes it possible to enhance the storage stability of the coating solution containing a phenolic resin and reduce the amount of reaction condensation water to be produced during the heat curing of the coating solution. Thus, the resulting cured film can be provided with enhanced surface properties. This prepolymerization also allows enhancement of uniformity in coat layer, dense heat curing leading to enhancement of cured film and elimination of unreacted terminals leading to enhancement of electrical properties to greater advantage.

From the standpoint of acceleration of the aforementioned prepolymerization, the coating solution is preferably heated to a range of from room temperature to 100° C. with stirring for 1 to 24 hours. From the same standpoint of view as mentioned above, the coating solution is preferably subjected to ultrasonic treatment or reacted in the presence of an acid catalyst. As the acid catalyst there is preferably used an organic sulfonic acid, organic sulfonate, phenol or the like.

In the aforementioned coating solution, the mixing proportion (by weight) of the charge-transporting compound of the invention to the phenolic resin is preferably from 10:1 to 1:5.

Referring to the order of steps of preparing the coating solution, the mixing of the charge-transporting compound of the invention and the phenolic resin is preferably first effected and then followed by the addition of the organic solvent because the reaction of the charge-transporting compound with the phenolic resin can easily proceed.

The temperature to which the aforementioned coating solution is heated is preferably from 60° C. to 200° C., more preferably from 100° C. to 170° C.

EXAMPLES

The invention is described in more detail with reference to the following Examples, to which, however, the invention is not limited.

<Synthesis of Charge-Transporting Compound>

Example A-1

Figure 10:
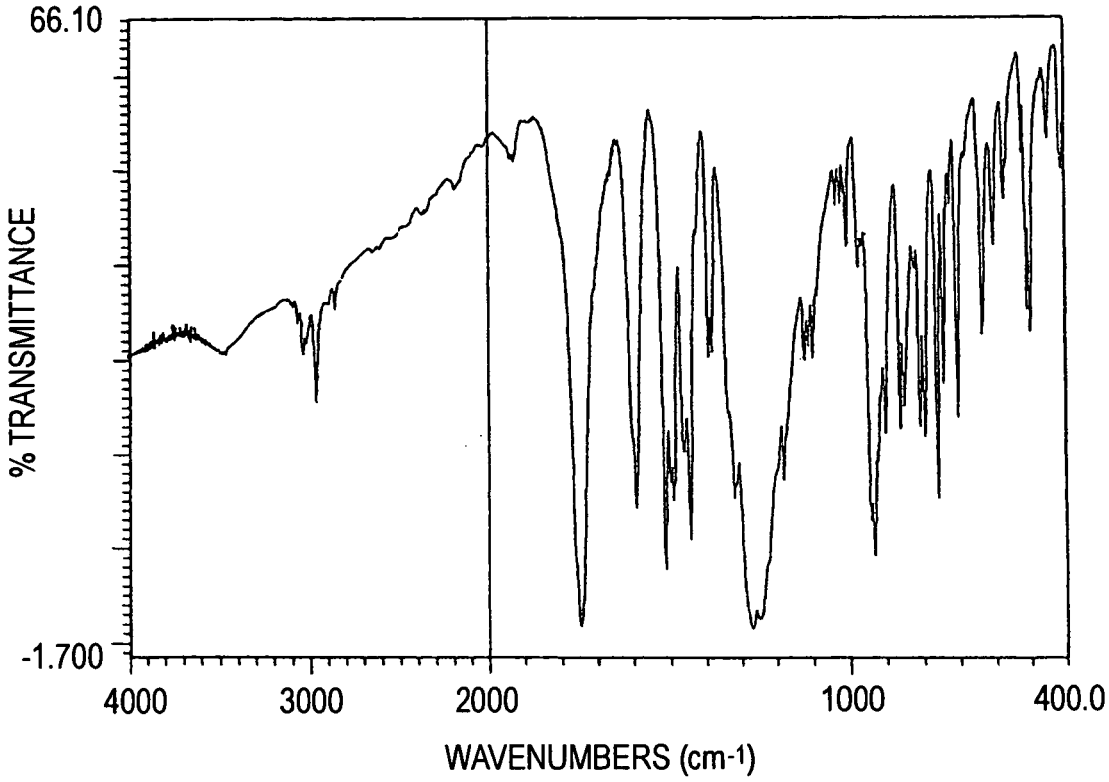
FIG. 10 is a diagram illustrating IR spectrum of the charge-transporting compound obtained in Example A-1.

100 g of 4,4'-bishydroxymethyltriphenylamine is dissolved in 300 ml of toluene. To the solution is then added 65 g of pyridine. The mixture is then thoroughly stirred over a 15° C. water bath. Subsequently, to the mixture is slowly added dropwise 78 g of methyl chloroformate in 4.5 hours. After the termination of dropwise addition, the mixture is then thoroughly stirred for 12 hours. The reaction solution is then put into a separating funnel where it is washed with 500 ml of saturated saline solution four times and then with 500 ml of distilled water four times. The solvent is then distilled off the toluene phase. The residue is then recrystallized from isopropanol to obtain 133 g of a desired charge-transporting compound as "Exemplary Compound 118" represented by the following general formula. IR spectrum of the compound thus obtained is shown in FIG. 10.

Exemplary Compound 118

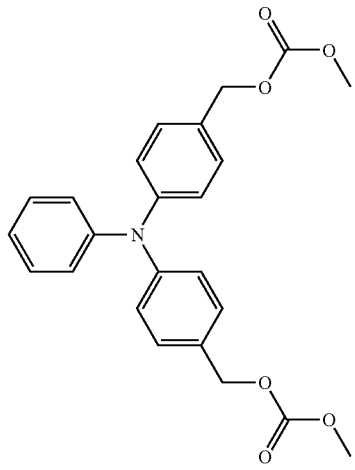

Example A-2

Figure 11:
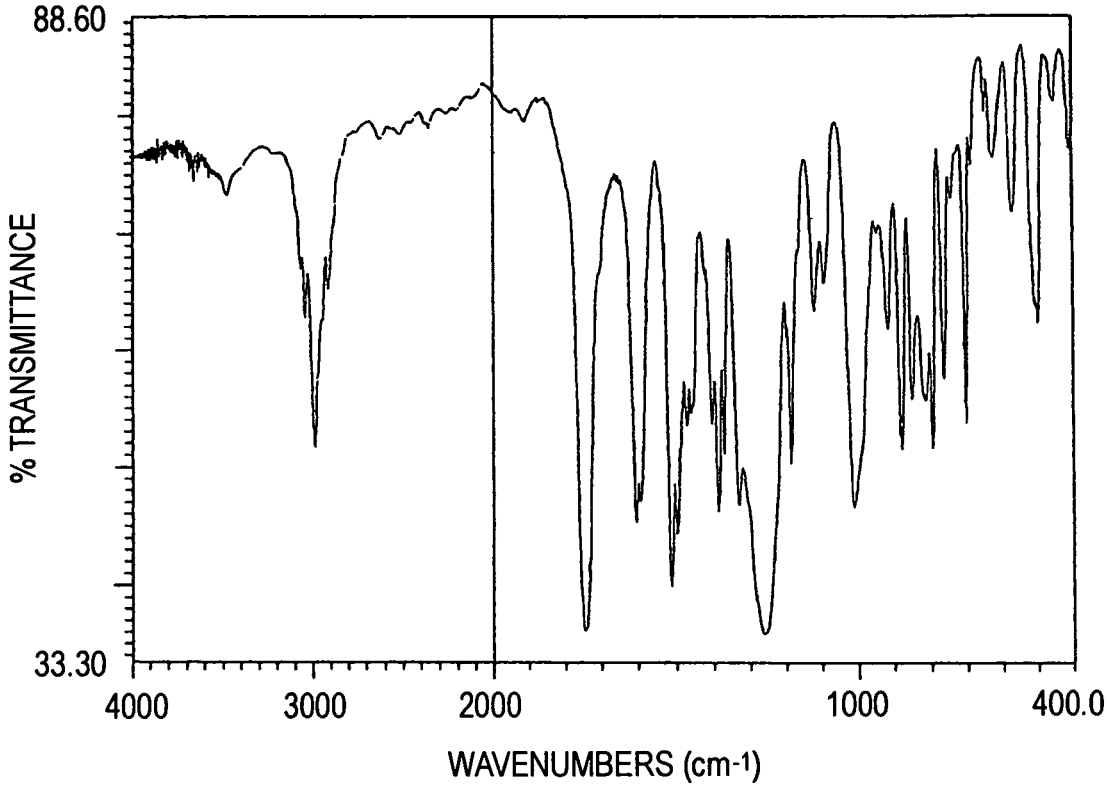
FIG. 11 is a diagram illustrating IR spectrum of the charge-transporting compound obtained in Example A-2.

The procedure of Example A-1 is followed except that 83 g of ethyl chloroformate is used instead of 78 g of methyl chloroformate. As a result, 146 g of a charge-transporting compound as "Exemplary Compound 119" represented by the following general formula is obtained. IR spectrum of the compound thus obtained is shown in FIG. 11.

Exemplary Compound 119

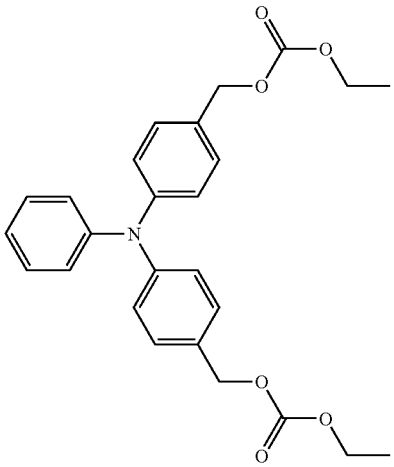

Example A-3

Figure 12:
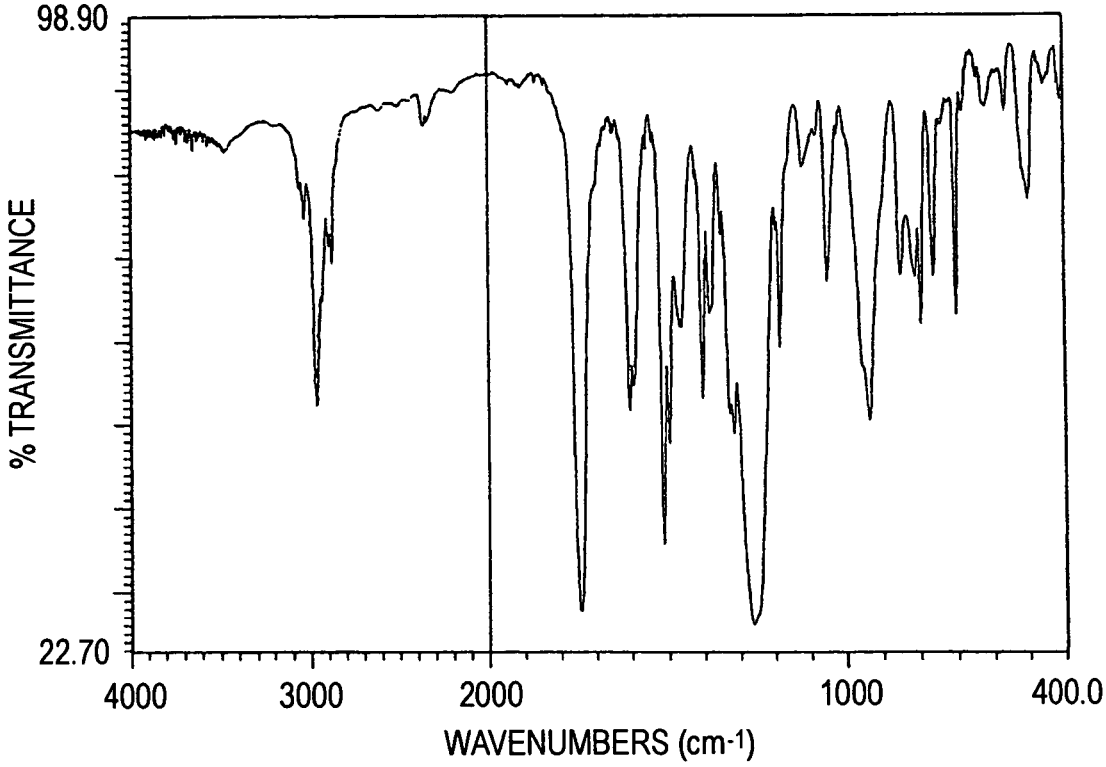
FIG. 12 is a diagram illustrating IR spectrum of the charge-transporting compound obtained in Example A-3.

The procedure of Example A-1 is followed except that 88 g of propyl chloroformate is used instead of 78 g of methyl chloroformate. As a result, 141 g of a charge-transporting compound as "Exemplary Compound 120" represented by the following general formula is obtained. IR spectrum of the compound thus obtained is shown in FIG. 12.

Exemplary Compound 120

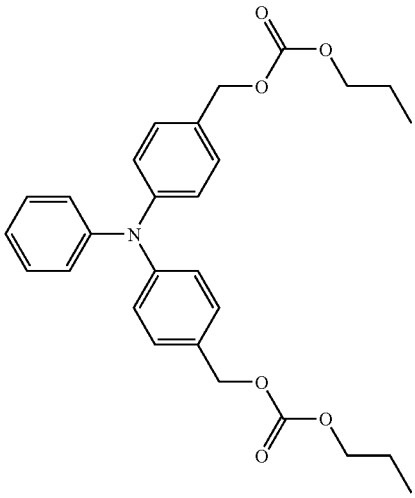

Example A-4

Figure 13:
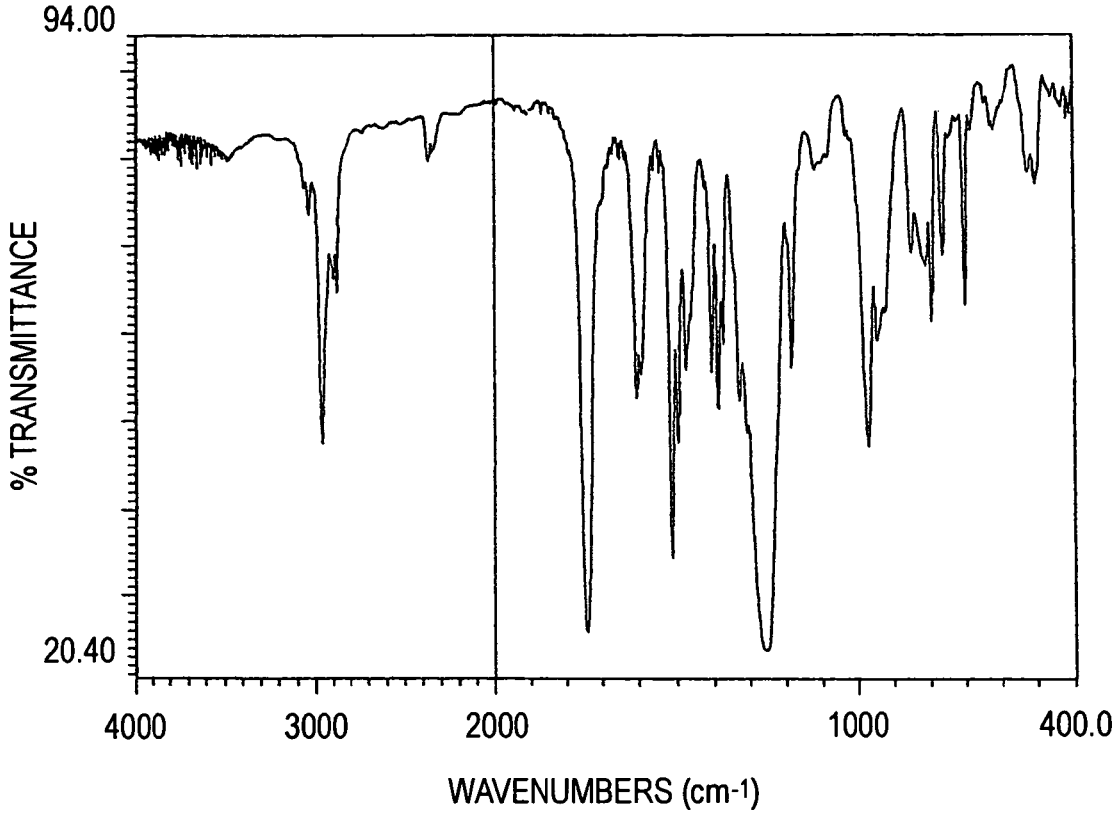
FIG. 13 is a diagram illustrating IR spectrum of the charge-transporting compound obtained in Example A-4.

The procedure of Example A-1 is followed except that 94 g of isobutyl chloroformate is used instead of 78 g of methyl chloroformate. As a result, 148 g of a charge-transporting compound as "Exemplary Compound 122" represented by the following general formula is obtained. IR spectrum of the compound thus obtained is shown in FIG. 13.

Exemplary Compound 122

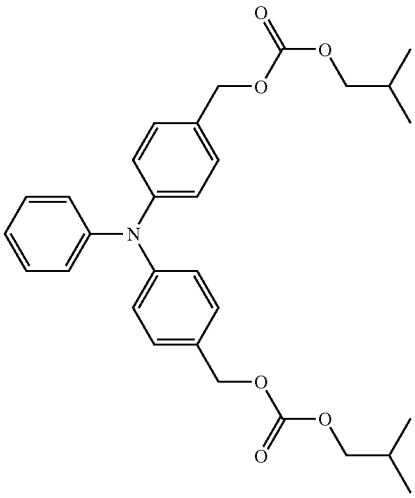

Example A-5

Figure 14:
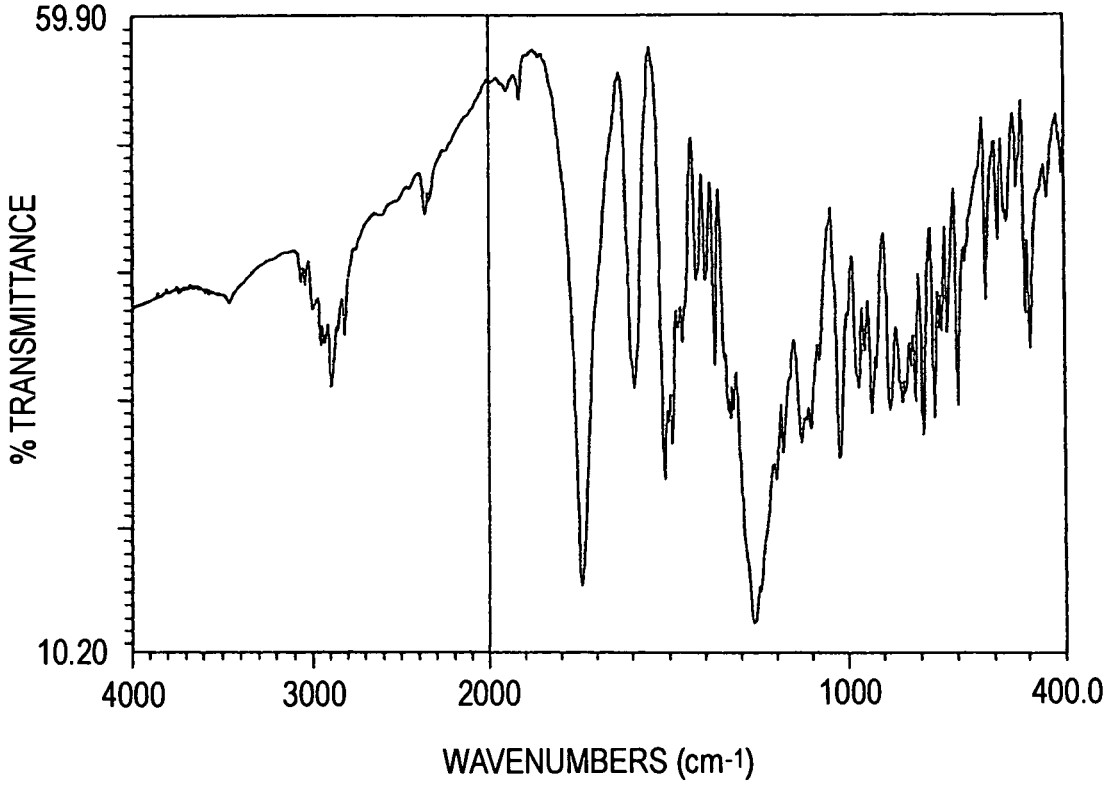
FIG. 14 is a diagram illustrating IR spectrum of the charge-transporting compound obtained in Example A-5.

The procedure of Example A-1 is followed except that 113 g of 2-methoxyester chloroformate is used instead of 78 g of methyl chloroformate. As a result, 145 g of a charge-transporting compound as "Exemplary Compound 123" represented by the following general formula is obtained. IR spectrum of the compound thus obtained is shown in FIG. 14.

Exemplary Compound 123

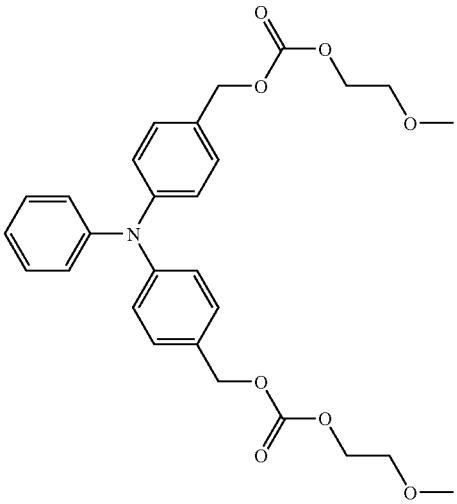

Example A-6

Figure 15:
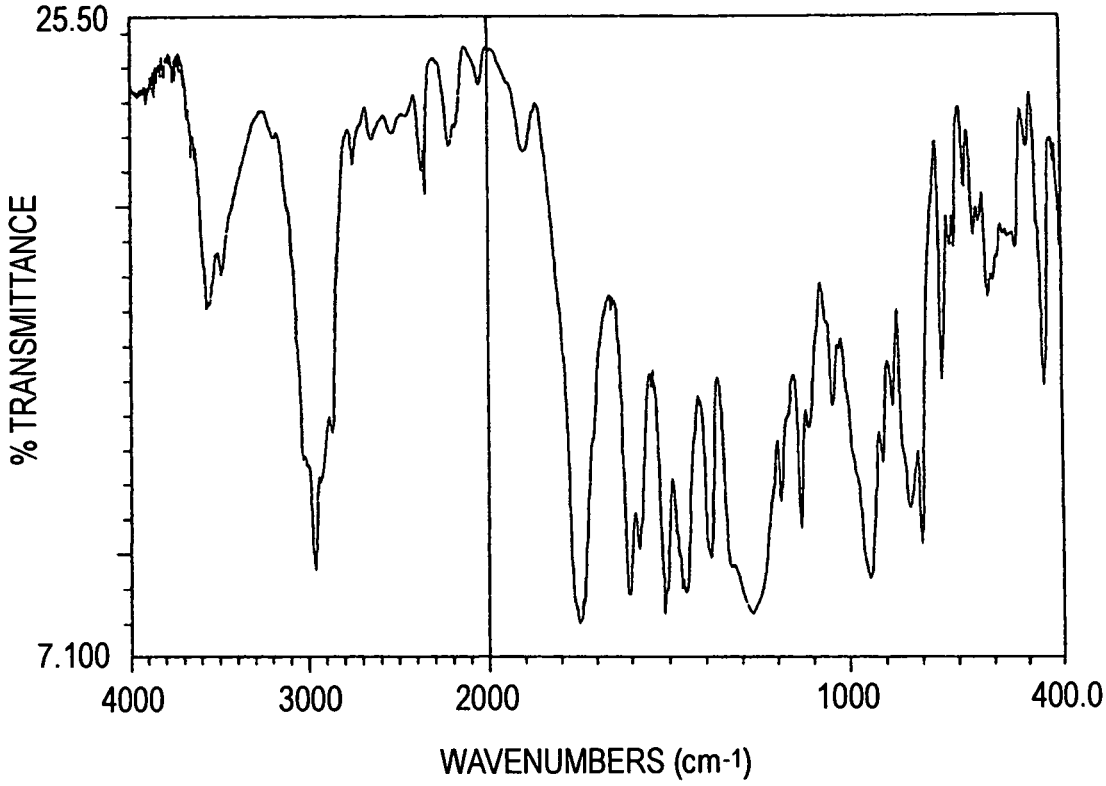
FIG. 15 is a diagram illustrating IR spectrum of the charge-transporting compound obtained in Example A-6.

20 g of tri(3-methyl-4-hydroxymethyl)triphenyl amine is dissolved in 300 ml of tetrahydrofurane. To the solution is then added 21 g of pyridine. The mixture is then thoroughly stirred over a 15° C. water bath. Subsequently, to the mixture is slowly added dropwise 20 g of methyl chloroformate in 4 hours. The mixture is then stirred for 4 hours. Subsequently, to the mixture is added dropwise 5 g of methyl chloroformate in 30 minutes to complete the reaction. The reaction solution is then put into a separating funnel where 500 ml of toluene is then added thereto. The mixture is then thoroughly washed with distilled water. The solvent is then distilled off the toluene phase to obtain 32 g of a desired charge-transporting compound as "Exemplary Compound 217" represented by the following general formula. IR spectrum of the compound thus obtained is shown in FIG. 15.

Exemplary Compound 217

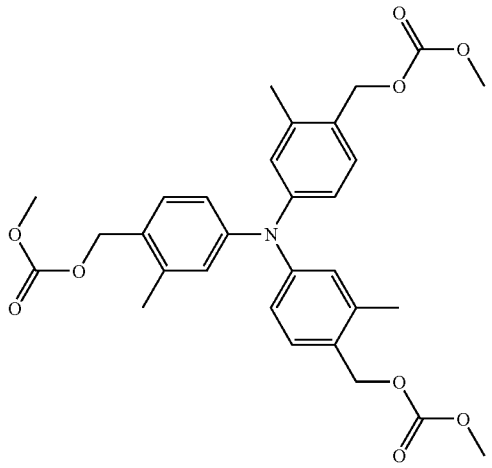

<Preparation of Cured Film>

The charge-transporting compounds obtained in Examples (A-1) to (A-6) are each used to prepare cured films. For comparison, charge-transporting compounds represented by the following general formulae (CT-1) to (CT-8) are each used to prepare cured films.

Example 1 of Preparation of Cured Film 50 g of phenol, 90 g of 37% by weight formaldehyde, 1.0 g of zinc acetate and 1.0 g of triethylamine are mixed. The mixture is then heated to 80° C. with stirring for 4 hours. After the termination of reaction to the mixture is then added 100 ml of n-butanol. The solvent is then distilled off the solution by a rotary evaporator. To 80 g of the residual resin is then added 30 ml of n-butanol to prepare a phenol resin solution. To 10 g of the phenol resin solution thus obtained are then added 15 g of the charge-transporting compound synthesized in Example A-1, 5 ml of methanol and 40 ml of n-butanol. The mixture is then heated to 50° C. with stirring to undergo reaction for 2 hours until bubbles disappeared. The reaction solution is then returned to room temperature. To the reaction solution is then 40 mg of dodecylbenzenesulfonic acid to prepare a coating solution for forming a charge-transporting cured film.

The coating solution thus obtained is spread over a glass sheet using a wire bar, and then heated and dried at 140° C. for 1 hour to prepare a cured film to a thickness of about 3 μm.

Examples 2 to 6 of Preparation of Cured Film

The procedure of Example 1 of preparation of cured film is followed except that the charge-transporting compounds synthesized in Examples (A-2) to (A-6) are used instead of the charge-transporting compound synthesized in Example (A-1), respectively, to prepare coating solutions from which cured films are then prepared.

Example 7 of Preparation of Cured Film

The procedure of Example 1 of preparation of cured film is followed except that a phenolic resin solution obtained by dissolving 80 g of a resol type phenolic resin (PL-2215, produced by Gunei Chemical Industry Co., Ltd.) in 20 g of n-butanol is used instead of the phenolic resin solution synthesized in Example 1 of preparation of cured film to prepare a coating solution from which a cured film is then prepared.

Example 8 of Preparation of Cured Film

The procedure of Example 1 of preparation of cured film is followed except that a phenolic resin solution obtained by dissolving 80 g of a resol type phenolic resin (PL-2215, produced by Gunei Chemical Industry Co., Ltd.) in 20 g of n-butanol is used instead of the phenolic resin solution synthesized in Example 1 of preparation of cured film and the charge-transporting compound synthesized in Example (A-6) is used instead of the charge-transporting compound synthesized in Example (A-1) to prepare a coating solution from which a cured film is then prepared.

Example 9 of Preparation of Cured Film

The procedure of Example 1 of preparation of cured film is followed except that a phenolic resin solution obtained by dissolving 70 g of a resol type phenolic resin (PR-51904, produced by SUMITOMO BAKELITE Co., Ltd.) in 20 g of n-butanol is used instead of the phenolic resin solution synthesized in Example 1 of preparation of cured film to prepare a coating solution from which a cured film is then prepared.

Example 10 of Preparation of Cured Film

The procedure of Example 1 of preparation of cured film is followed except that a charge-transporting compound represented by the following general formula (CT-1) is used instead of the charge-transporting compound synthesized in Example (A-1) to prepare a coating solution from which a cured film is then prepared.

(CT-1)

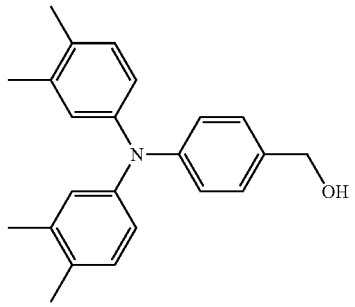

Example 11 of Preparation of Cured Film

A coating solution is prepared in the same manner as in Example 1 of preparation of cured film except that a charge-transporting compound represented by the following general formula (CT-2) is used instead of the charge-transporting compound synthesized in Example (A-1). Spreading of the coating solution thus obtained is attempted. However, since the coating solution is divided into two layers, no cured film is prepared.

(CT-2)

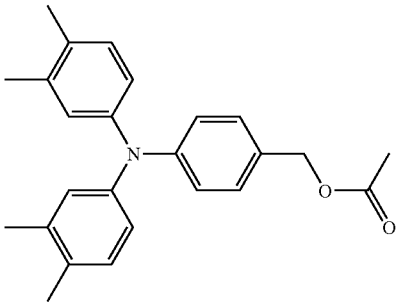

Example 12 of Preparation of Cured Film

A coating solution is prepared in the same manner as in Example 1 of preparation of cured film except that a charge-transporting compound represented by the following general formula (CT-3) is used instead of the charge-transporting compound synthesized in Example (A-1). The coating solution thus obtained is then used to prepare a cured film.

(CT-3)

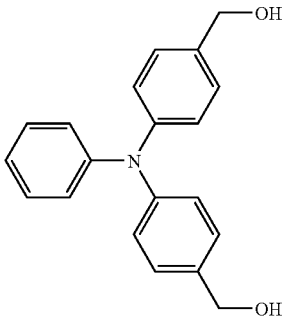

Example 13 of Preparation of Cured Film

A coating solution is prepared in the same manner as in Example 1 of preparation of cured film except that a charge-transporting compound represented by the following general formula (CT-4) is used instead of the charge-transporting compound synthesized in Example (A-1). The coating solution thus obtained is then used to prepare a cured film.

(CT-4)

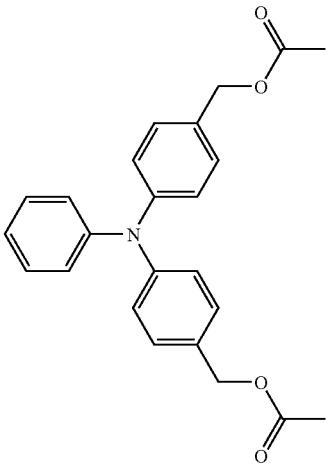

Example 14 of Preparation of Cured Film

A coating solution is prepared in the same manner as in Example 1 of preparation of cured film except that a charge-transporting compound represented by the following general formula (CT-5) is used instead of the charge-transporting compound synthesized in Example (A-1). When allowed to stand, the coating solution thus obtained is then divided into two layers. Therefore, the coating solution is spread while being heated to prepare a cured film.

(CT-5)

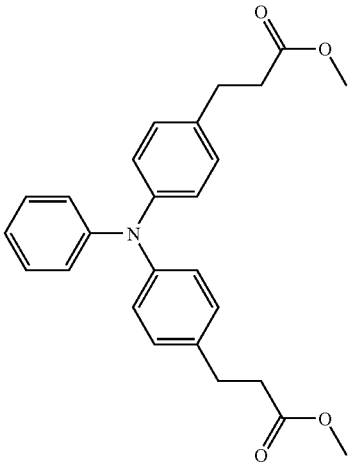

Example 15 of Preparation of Cured Film

A coating solution is prepared in the same manner as in Example 1 of preparation of cured film except that a charge-transporting compound represented by the following general formula (CT-6) is used instead of the charge-transporting compound synthesized in Example (A-1). Spreading of the coating solution thus obtained is attempted. However, since the coating solution is divided into two layers, no cured film is prepared.

(CT-6)

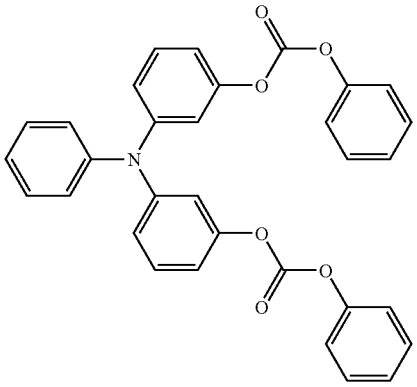

Example 16 of Preparation of Cured Film

In an attempt to prepare a cured film, the procedure of Example 1 of preparation of cured film is followed except that a charge-transporting compound represented by the following general formula (CT-7) is used instead of the charge-transporting compound synthesized in Example (A-1). However, the charge-transporting compound is not completely dissolved in the solvent, making it impossible to prepare the desired coating solution.

(CT-7)

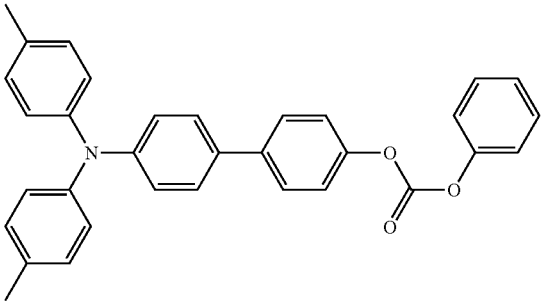

Example 17 of Preparation of Cured Film

In an attempt to prepare a cured film, the procedure of Example 1 of preparation of cured film is followed except that a charge-transporting compound represented by the following general formula (CT-8) is used instead of the charge-transporting compound synthesized in Example (A-1).

However, the charge-transporting compound is not completely dissolved in the solvent, making it impossible to prepare the desired coating solution.

(CT-8)

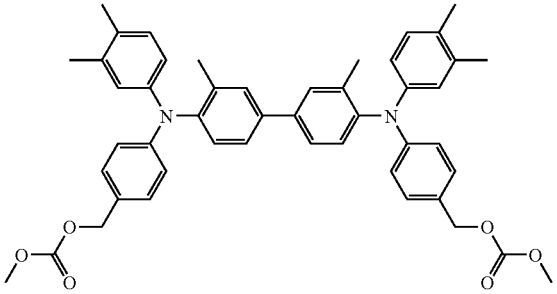

The cured films obtained in Examples 1 to 10 and 12 to 14 of preparation of cured film are each then visually observed for surface conditions to evaluate film-forming properties thereof The cured films thus formed are each then measured for pencil hardness (according to JIS K5400). The results are set forth in Table 26.

TABLE 26

| Preparation Example | Visually observed surface conditions | Pencil hardness |
|---|---|---|
| Example 1 of preparation of cured film | No problem | 5H |
| Example 2 of preparation of cured film | No problem | 5H |
| Example 3 of preparation of cured film | No problem | 6H |
| Example 4 of preparation of cured film | No problem | 5H |
| Example 5 of preparation of cured film | No problem | 5H |
| Example 6 of preparation of cured film | No problem | 5H |
| Example 7 of preparation of cured film | No problem | 6H |
| Example 8 of preparation of cured film | No problem | 5H |
| Example 9 of preparation of cured film | No problem | 5H |
| Example 10 of preparation of cured film | No problem | 2H |
| Example 11 of preparation of cured film | Unable to prepare | — |
| Example 12 of preparation of cured film | No problem | 3H |
| Example 13 of preparation of cured film | Surface roughness | 1H |
| Example 14 of preparation of cured film | Surface roughness | 1H |
| Example 15 of preparation of cured film | Unable to prepare | — |
| Example 16 of preparation of cured film | Unable to prepare | — |

<Preparation 1 of Electrophotographic Photoreceptor>

Examples (B-1) to (B-8); Comparative Examples (B-1) to (B-4)

The charge-transporting compounds obtained in Examples (A-1) to (A-8) and the charge-transporting compounds of the general formulae (CT-1) and (CT-3) to (CT-5) are subjected to the following processing to prepare electrophotographic photoreceptors.

Example B-1

(Preparation of Base Photoreceptor)

170 parts by weight of n-butyl alcohol having 4 parts by weight of a polyvinyl butyral resin (S-LEC BM-S, produced by SEKISUI CHEMICAL CO., LTD.) dissolved therein are mixed with 30 parts by weight of an organic zirconium compound (acetyl acetone zirconium butyrate) and 3 parts by weight of an organic silane compound (γ-aminopropyl trimethoxysilane) with stirring to obtain a coating solution for forming an undercoat layer. The coating solution thus obtained is spread over a honed aluminum substrate having a diameter of 30 mm by a dip coating method, and then cured at 140° C. for 1 hour to form an undercoat layer to a thickness of 1.4 μm.

Subsequently, 15 parts by weight of gallium phthalocyanine chloride having diffraction peak at least at a Bragg angle (2θ±0.2°) of 7.4°, 16.6°, 25.5° and 28.3° on X-ray diffraction spectrum using CuKα ray, 10 parts by weight of a vinyl chloride-vinyl acetate copolymer resin (VMCH, produced by Nippon Unicar Company Limited) as a binder resin and 300 parts by weight of n-butyl acetate are mixed, and then subjected to dispersion with 1 mmφ glass beads using a sandmill for 3 hours to obtain a coating solution for forming a charge-transporting layer. The coating solution thus obtained is spread over the aforementioned undercoat layer by a dip coating method, and then heated and dried at 110° C. for 18 minutes to form a charge-generating layer to a thickness of 0.2 μm.

Subsequently, 4 parts by weight of N,N'-diphenyl-N,N'-bis(3-methylphenyl)-[1,1']biphenyl-4,4'-diamine and 6 parts by weight of a bisphenol Z polycarbonate resin (viscosity-average molecular weight: 40,000) are thoroughly dissolved in 80 parts by weight of chlorobenzene to prepare a coating solution for forming a charge-transporting layer. The coating solution thus obtained is spread over the aforementioned charge-generating layer by a dip coating method, and then heated and dried at 135° C. for 40 minutes to form a charge-transporting layer to a thickness of 21 μm. As a result, a base photoreceptor is obtained.

A coating solution prepared in the same manner as in Example 1 of preparation of cured film is spread over the base photoreceptor thus prepared, and then heated in the same manner as in Example 1 of preparation of cured film to prepare a protective layer. As a result, an electrophotographic photoreceptor of Example B-1 is obtained.

Examples (B-2) to (B-9)

Base photoreceptors are prepared in the same manner as in Example B-1. Coating solutions prepared in the same manner as in Examples 2 to 9 of preparation of cured film are spread over the respective base photoreceptor, and then heated in the same manner as in Examples 2 to 9 of preparation of cured film to form protective layers. As a result, electrophotographic photoreceptors of Examples (B-2) to (B-9) are obtained.

Comparative Examples (B-1) to (B-4)

Base photoreceptors are prepared in the same manner as in Example B-1. Coating solutions prepared in the same manner as in Examples 10, 12, 13 and 14 of preparation of cured film are spread over the respective base photoreceptor, and then heated in the same manner as in Examples 10, 12, 13 and 14 of preparation of cured film to form protective layers. As a result, electrophotographic photoreceptors of Comparative Examples (B-1) to (B-4) are obtained.

<Test for Evaluation of Properties of Electrophotographic Photoreceptors>

Figure 16:
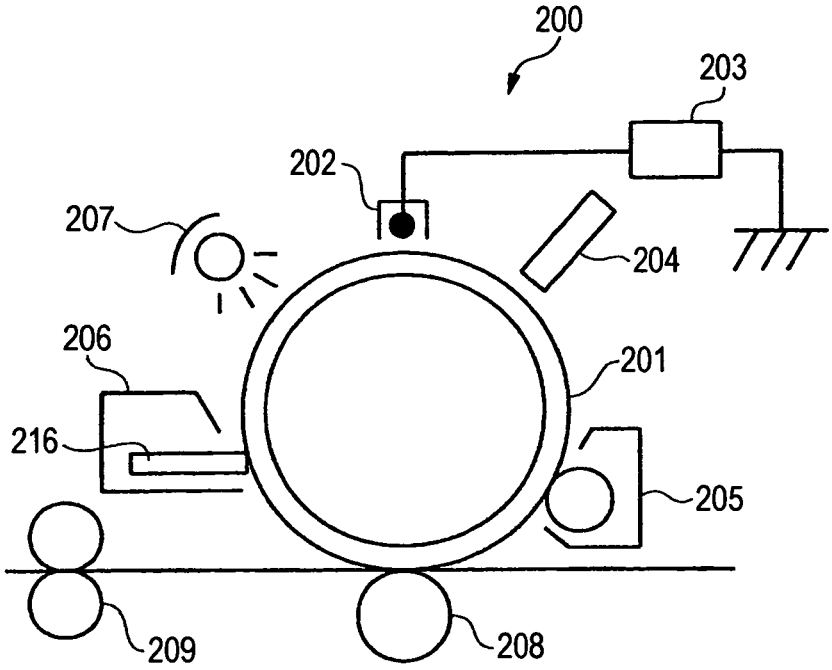
FIG. 16 is a schematic diagram illustrating the configuration of the image-forming apparatus used in the test for evaluation of properties of electrophotographic photoreceptor.

The photoreceptors of Examples (B-1) to (B-8) and Comparative Examples (B-1) to (B-4) are each incorporated in a laser printer scanner having a configuration as shown in FIG. 16 (remodeled version of XP-15, produced by Fuji Xerox Co., Ltd.) as a photoreceptor to prepare an image-forming apparatus. An image-forming apparatus 200 shown in FIG. 16 comprises an electrophotographic photoreceptor 201, a charging unit 202 connected to a power supply 203, an exposure unit 204, a developing unit 205, a cleaning unit 206, a discharge unit 207, a transferring unit 208, and a fixing unit 209. The charging unit 202 is a scorotron charging unit. The cleaning unit 206 comprises a cleaning blade 216. These image-forming apparatus are each then evaluated for properties of photoreceptor (initial electrical properties and environmental stability) in the following manners.

(Evaluation of Initial Electrical Properties)

The electrophotographic photoreceptors are each measured for surface potential [V] developed when charged using a scorotron charging unit having a grid voltage of 700 V under ordinary temperature and humidity conditions (20° C.-40% RH). The electrophotographic photoreceptors which had been charged are each allowed to stand for 1 second, irradiated with light at a dose of 50 mJ/m$^2$ so that they are discharged, and then measured for residual voltage [V]. The lower the residual potential is, the less is evaluated the occurrence of fogging in the electrophotographic photoreceptor. The results are set forth in Table 27.

(Evaluation of Environmental Stability)

The aforementioned procedure is effected under two different conditions, i.e., high temperature and humidity conditions (28° C.-85% RH) and low temperature and humidity conditions (10° C.-15% RH). The samples are each then measured for residual potential after exposure (residual potential under high temperature and humidity conditions: A (V); residual potential under low temperature and humidity conditions: B (V)). The difference between the two residual potential values |B−A| is then determined as change ΔV (V). The smaller the change ΔV is, the higher is evaluated the stability of the electrophotographic photoreceptor against the change of working atmosphere. The results are set forth in Table 27.

TABLE 27

| | Charge-transporting compound | Surface potential (V) | Residual potential (V) | A (V) | B (V) | Change ΔV (V) |
|---|---|---|---|---|---|---|
| Example B-1 | Example A-1 | −693 | −28 | −20 | −49 | 29 |
| Example B-2 | Example A-2 | −681 | −30 | −21 | −51 | 30 |
| Example B-3 | Example A-3 | −690 | −31 | −21 | −54 | 33 |
| Example B-4 | Example A-4 | −700 | −26 | −20 | −52 | 32 |
| Example B-5 | Example A-5 | −694 | −25 | −19 | −48 | 29 |
| Example B-6 | Example A-6 | −688 | −26 | −20 | −49 | 29 |
| Example B-7 | Example A-1 | −695 | −29 | −22 | −55 | 33 |
| Example B-8 | Example A-1 | −688 | −26 | −18 | −56 | 38 |
| Example B-9 | Example A-1 | −680 | −28 | −20 | −52 | 32 |
| Comparative Example B-1 | (CT-1) | −701 | −31 | −20 | −106 | 86 |
| Comparative Example B-2 | (CT-3) | −695 | −32 | −21 | −110 | 89 |
| Comparative Example B-3 | (CT-4) | −689 | −27 | −21 | −80 | 59 |
| Comparative Example B-4 | (CT-5) | −691 | −29 | −20 | −88 | 68 |

As can be seen in the results of Tables 26 and 27, the charge-transporting compounds of Examples (A-1) to (A-6) according to the invention can easily form a good cured film and, when used as a constituent of the functional layer (protective layer) for photoreceptor, can provide a photoreceptor having little environmental change and good electrical properties.

<Preparation 2 of Electrophotographic Photoreceptor>

(Photoreceptor 1)

A 30-mmϕ cylindrical aluminium substrate is prepared. The cylindrical aluminium substrate is polished with a centerless polishing device to thereby have a surface roughness Rz=0.55 μm. Thus processed for centerless polishing, the cylindrical aluminium substrate is washed as follows: This is degreased, then etched with an aqueous 2 weight. % sodium hydroxide solution for 1 minutes, neutralized and washed with pure water. Next, the aluminium substrate is subjected to anodic oxidation with a 10 weight. % sulfuric acid solution (current density, 1.0 A/dm$^2$) to thereby form an oxide film on its surface. After washed with water, this is dipped in a 1 weight. % nickel acetate solution at 80° C. for 15 minutes for sealing the anodic oxide film. Further, this is washed with pure water and dried. The process gave an aluminium substrate with a 6.5-μm anoxic oxide film formed on its surface.

Next, 1 part by weight of chlorogallium phthalocyanine, which has strong diffraction peaks at a Bragg angle (2θ±0.2°) of 7.4°, 16.6°, 25.5° and 28.3° in the X-ray diffraction spectrum thereof, 1 part by weight of polyvinylbutyral (S-LEC BM-S, by SEKISUI CHEMICAL CO., LTD.) and 100 parts by weight of n-butyl acetate are mixed, and processed and dispersed in a paint shaker along with glass beads therein for 1 hour to prepare a carrier generation layer-forming coating dispersion. The coating liquid is applied to the aluminium substrate prepared in the above by dipping the substrate in the liquid, and dried under heat at 11° C. for 8 minutes to form a carrier generation layer having a thickness of about 0.15 μm on the substrate.

Next, 2.5 parts by weight of a benzidine compound of the following formula (VII), and 3 parts by weight of a polymer compound having structural units of the following formula (VIII) (having a viscosity-average molecular weight of 39,000) are dissolved in a mixed solvent of 6 parts by weight of chlorobenzene and 14 parts by weight of tetrahydrofuran to prepare a carrier transport layer-forming solution.

(VII)

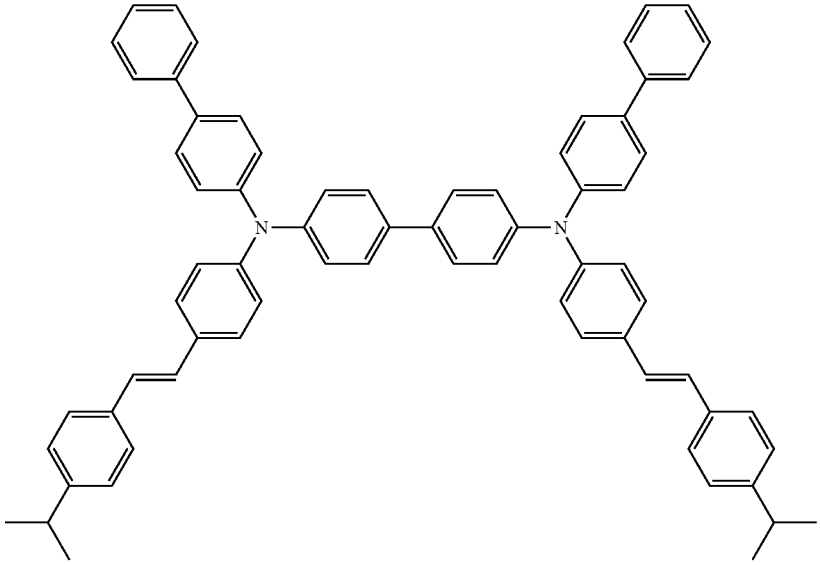

(VIII)

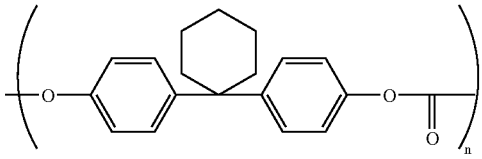

The coating solution is applied onto the carrier generation layer by dipping the substrate in the solution, and heated at 110° C. for 60 minutes to thereby form thereon a carrier transport layer having a thickness of 20 μm. Thus fabricated, the photoreceptor is referred to as "photoreceptor 1".

(Photoreceptor 2)

A honed, 30-mmϕ cylindrical aluminium substrate is prepared. Next, 100 parts by weight of a zirconium compound (trade name, Orgatix ZC540 by Matsumoto Chemical Industry Co., Ltd), 10 parts by weight of a silane compound (trade name, A1100 by Nippon Unicar Co., Ltd), 400 parts by weight of isopropanol and 200 parts by weight of butanol are mixed to prepare an undercoat layer-forming liquid. The coating liquid is applied to the aluminium substrate by dipping the substrate therein, and dried under heat at 150° C. for 10 minutes to form an undercoat layer having a thickness of 0.1 μm on the substrate.

Next, 1 part by weight of hydroxygallium phthalocyanine, which has strong diffraction peaks at a Bragg angle (2θ±0.2°) of 7.5°, 9.9°, 12.5°, 16.3°, 18.6°, 25.1° and 28.3° in diffraction spectrum thereof, 1 part by weight of polyvinylbutyral (Eslec BM-S, by Sekisui Chemical) and 100 parts by weight of n-butyl acetate are mixed, and processed and dispersed in a paint shaker along with glass beads therein for 1 hour to prepare a carrier generation layer-forming coating dispersion. The coating liquid is applied onto the undercoat layer formed on the substrate by dipping the substrate in the liquid, and dried under heat at 110° C. for 10 minutes to form thereon a carrier generation layer having a thickness of about 0.15 μm.

Next, 3 parts by weight of a carrier transport material of the following formula (IX), 3 parts by weight of a polymer compound having structural units of formula (VII) (having a viscosity-average molecular weight of 39,000) and 20 parts by weight of chlorobenzene are mixed to prepare a carrier transport layer-forming liquid.

(IX)

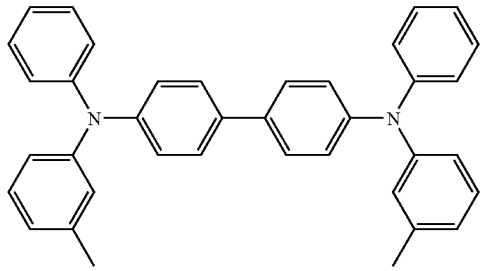

The coating liquid is applied onto the carrier generation layer by dipping the substrate in the liquid, and heated at 110° C. for 60 minutes to thereby form thereon a carrier transport layer having a thickness of 20 μm. Thus fabricated, the photoreceptor is referred to as "photoreceptor 2".

(Photoreceptor 3)

100 parts by weight of zinc oxide (TAYCA CORPORATION's trial product, having a mean particle size of 70 nm and a specific surface area of 16 $m^2/g$) and 500 parts by weight of toluene are stirred and mixed, and 1.5 parts by weight of a silane coupling agent (trade name, KBM603 by Shin-Etsu Chemical Co., Ltd) is added thereto and stirred for 2 hours. Then, toluene is evaporated away under reduced pressure, and this is baked at 150° C. for 2 hours.

60 parts by weight of the surface-treated zinc oxide, 15 parts by weight of a curing agent, blocked isocyanate (trade name, Sumidur 3175 by Sumitomo Bayer Urethane), 15 parts by weight of a butyral resin (trade name, S-LEC BM-1 by Sekisui Chemical Co., Ltd) and 85 parts by weight of methyl ethyl ketone are mixed to prepare a mixture. 38 parts by weight of the resulting mixture is mixed with 25 parts by weight of methyl ethyl ketone, and dispersed in a sand mill along with 1-mmϕ glass beads therein for 2 hours to prepare a dispersion. To the resulting dispersion, added are 0.005 parts by weight of a catalyst, dioctyltin dilaurate, and 0.01 parts by weight of silicone oil (trade name, SH29PA by Dow Corning Toray Silicone Co., Ltd) to prepare an undercoat layer-forming coating liquid. The coating liquid is applied onto a 84-mmϕ cylindrical aluminium substrate by dipping the substrate in the liquid, and dried under heat at 160° C. for 100 minutes to form an undercoat layer having a thickness of 20 μm on the substrate.

Next, 1 part by weight of hydroxygallium phthalocyanine, which has strong diffraction peaks at a Bragg angle (2θ±0.2°) of 7.5°, 9.9°, 12.50, 16.3°, 18.6°, 25.1° and 28.3° in X-ray diffraction spectrum thereof, 1 part by weight of polyvinylbutyral (S-LEC BM-S, by Sekisui Chemical Co., Ltd) and 100 parts by weight of n-butyl acetate are mixed, and processed and dispersed in a paint shaker along with glass beads therein for 1 hour to prepare a carrier generation layer-forming coating dispersion. The coating liquid is applied onto the undercoat layer formed on the substrate by dipping the substrate in the liquid, and dried under heat at 110° C. for 10 minutes to form thereon a carrier generation layer having a thickness of about 0.15 μm.

Next, 3 parts by weight of a carrier transport material of the following formula (X), 3 parts by weight of a polymer compound having structural units of the following formula (XI) (having a viscosity-average molecular weight of 46,000) and 20 parts by weight of chlorobenzene are mixed to prepare a carrier transport layer-forming liquid.

(X)

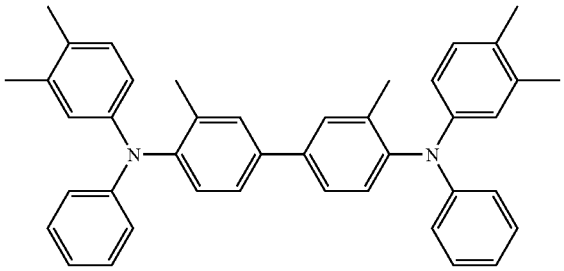

(XI)

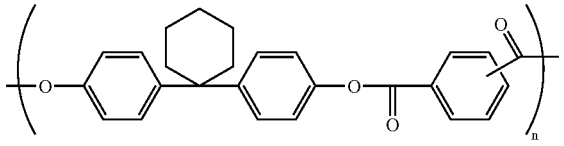

The coating liquid is applied onto the carrier generation layer by dipping the substrate in the liquid, and heated at 110° C. for 60 minutes to thereby form thereon a carrier transport layer having a thickness of 20 μm. Thus fabricated, the photoreceptor is referred to as "photoreceptor 3".

<Preparation of Developer>

A toner and a carrier are first prepared, and they are used to prepare a developer. In the following description, the particle size distribution of the toner and the composite particles is determined by the use of Multisizer (by Nikkaki) having an aperture diameter of 100 μm. The mean sphericity coefficient $ML^2/A$ of the toner and the composite particles is meant to indicate the value calculated according to the following formula. A true sphere has $ML^2/A=100$.

$$ML^2/A=(\text{maximum length})^2\times\pi\times100/(\text{area}\times4).$$

For the determination of mean sphericity coefficient, a projected image of toner is taken into an image analyzer (LUZEX (III), produced by NIRECO Corporation) from an optical microscope. The toner is then measured for diameter of circle having the same area as that of particle. The various particles are subjected to calculation of maximum length and area by the aforementioned equation. The value of 100 particles are then averaged.

(Production of Toner)

A toner is produced as follows: A dispersion of resin particles, a colorant dispersion and a lubricant dispersion are prepared, and these are used to produce toner base particles. Next, these are sued to produce a toner.

(Dispersion of Resin Particles)

370 parts by weight of styrene, 30 parts by weight of n-butyl acrylate, 8 parts by weight of acrylic acid, 24 parts by weight of dodecanethiol, and 4 parts by weight of carbon tetrabromide are mixed and dissolved. The resulting solution is added to a mixture of 6 parts by weight of a nonionic surfactant (Nonipol 400 by Sanyo Chemical Industry, Ltd), 10 parts by weight of an anionic surfactant (Neogen S C by Daiichi Kogyo Seiyaku Co., Ltd.) and 550 parts by weight of ion-exchanged water in a flask, and polymerized in a mode of emulsion polymerization. Then, with gradually stirring for 10 minutes, 50 parts by weight of ion-exchanged water with 4 parts by weight of ammonium persulfate dissolved therein is put into it. After purged with nitrogen, this is heated in an oil bath with stirring until the contents of the flask became up to 70° C., and then emulsion polymerization is further continued for 5 hours as it is. As a result, a dispersion of resin particles is obtained in which the resin particles had a volume mean particle size of 150 nm, Tg of 57° C., and a weight-average molecular weight (Mw) of 11200. The solid concentration of the dispersion is 40% by weight.

(Colorant Dispersion (1))

60 parts by weight of carbon black (Mogul L by Cabot Corporation), 6 parts by weight of a nonionic surfactant (Nonipol 400 by Sanyo Chemical Industry, Ltd), and 240 parts by weight of ion-exchanged water are mixed and dissolved. The resulting mixture is stirred in a homogenizer (Ultratalax T50 by IKA LABORTECHNIK) for 10 minutes, and then dispersed in an ultimizer to give a colorant dispersion (1) in which the colorant (carbon black) particles had a volume mean particle size of 250 nm.

(Colorant Dispersion (2))

60 parts by weight of a cyan pigment (B15:3), 5 parts by weight of a nonionic surfactant (Nonipol 400 by Sanyo Chemical Industry. Ltd), and 240 parts by weight of ion-exchanged water are mixed and dissolved. The resulting mixture is stirred in a homogenizer (Ultratalax T50 by IKA LABORTECHNIK) for 10 minutes, and then dispersed in an ultimizer to give a colorant dispersion (2) in which the colorant (cyan pigment) particles had a volume mean particle size of 250 nm.

(Colorant Dispersion (3))

60 parts by weight of a magenta pigment (R122), 5 parts by weight of a nonionic surfactant (Nonipol 400 by Sanyo Chemical Industry. Ltd), and 240 parts by weight of ion-exchanged water are mixed and dissolved. The resulting mixture is stirred in a homogenizer (Ultratalax T50 by IKA LABORTECHNIK) for 10 minutes, and then dispersed in an ultimizer to give a colorant dispersion (3) in which the colorant (magenta pigment) particles had a volume mean particle size of 250 nm.

(Colorant Dispersion (4))

90 parts by weight of an yellow pigment (Y180), 5 parts by weight of a nonionic surfactant (Nonipol 400 by Sanyo Chemical Industry. Ltd), and 240 parts by weight of ion-exchanged water are mixed and dissolved. The resulting mixture is stirred in a homogenizer (Ultratalax T50 by IKA LABORTECHNIK) for 10 minutes, and then dispersed in an ultimizer to give a colorant dispersion (4) in which the colorant (magenta pigment) particles had a volume mean particle size of 250 nm.

(Lubricant Dispersion)

100 parts by weight of paraffin wax (HNP0190 by Nippon Seiro Co., Ltd, having a melting point of 85° C.), 5 parts by weight of a cationic surfactant (Sunnysol B50 by Kao Corporation) and 240 parts by weight of ion-exchanged water are mixed, and dispersed in a rounded stainless steel flask by the use of a homogenizer (Ultratalax T50 by IKA LABORTECHNIK) for 1 minutes. This is further dispersed by the use of a jet homogenizer to give a lubricant dispersion in which the lubricant particles had a volume mean particle size of 550 nm.

(Toner Base Particles K1)

235 parts by weight of the resin dispersion, 30 parts by weight of the colorant dispersion (1), 40 parts by weight of the lubricant dispersion, 0.5 parts by weight of polyaluminium hydroxide (Paho 2S by Asada Chemical), and 600 parts by weight of ion-exchanged water are mixed, and dispersed in a rounded stainless steel flask by the use of a homogenizer (Ultratalax T50 by IKA LABORTECHNIK). This is heated up to 45° C. in a heating oil bath with stirring the contents of the flask. After this is kept at 45° C. for 25 minutes, the presence of aggregated particles having a volume mean particle size D50v of 4.5 μm is confirmed. The temperature of the heating oil bath is further elevated, and the flask in the bath is kept at 58° C. for 1 hour, whereupon the volume mean particle size D50v of the particles became 5.3 μm. Next, 26 parts of the resin dispersion is added to the dispersion of the aggregated particles, and then this is kept in the heating oil bath at 50° C. for 30 minutes. 1 N sodium hydroxide is added to the dispersion of the aggregated particles so as to make the dispersion have a pH of 7.0, and then the stainless flask is closed. This is heated up to 80° C. with stirring by the use of a magnetic seal, and kept as such for 4 hours. After cooled, the toner base particles are filtered out and washed five times with ion-exchanged water. After freeze-dried, this is toner base particles K1. The toner base particles K1 had a volume mean particle size D50v of 5.9 μm and a mean sphericity coefficient $ML^2/A$ of 134.

(Toner Base Particles C1)

Toner base particles C1 are prepared in the same manner as that for the toner base particles K1, for which, however, the colorant dispersion (2) is used in place of the colorant dispersion (1). The toner base particles C1 had a volume mean particle size D50v of 5.7 μm and a mean sphericity coefficient $ML^2/A$ of 130.

(Toner Base Particles M1)

Toner base particles M1 are prepared in the same manner as that for the toner base particles K1, for which, however, the colorant dispersion (3) is used in place of the colorant dispersion (1). The toner base particles M1 had a volume mean particle size D50v of 5.5 μm and a mean sphericity coefficient $ML^2/A$ of 135.

(Toner Base Particles Y1)

Toner base particles Y1 are prepared in the same manner as that for the toner base particles K1, for which, however, the colorant dispersion (4) is used in place of the colorant dispersion (1). The toner base particles Y1 had a volume mean particle size D50v of 5.8 μm and a mean sphericity coefficient $ML^2/A$ of 133.

100 parts by weight of each of the toner base particles K-1, C1, M1 and Y1 are mixed with 1 part by weight of rutile-type titanium oxide (having a volume mean particle size of 20 nm, processed with n-decyltrimethoxysilane), 2 parts by weight of silica (having a volume mean particle size of 40 nm, processed with silicone oil, prepared according to a vapor-phase oxidation process), 1 part by weight of cerium oxide (having a volume mean particle size of 0.7 μm), and 0.3 parts by weight of higher fatty acid alcohol (higher fatty acid alcohol having a molecular weight of 700, zinc stearate and calcium carbonate (having a mean particle size of 0.1 μm) are mixed in a ratio by weight of 5:1:1, and ground with a jet mill into particles having a mean particle size of 8.0 μm), in a 5-liter Henschel mixer at a peripheral speed of 30 m/sec for 15 minutes. Next, this is screened through a 45 μm-mesh sieve to remove coarse particles, and a tone 1 is thus obtained.

(Carrier)

15 parts by weight of toluene, 2 parts by weight of styrene/methacrylate copolymer (component ratio, 90/10) and 0.2 parts by weight of carbon black (R330 by Cabot Corporation) are stirred and dispersed in a stirrer for 20 minutes to prepare a coating liquid. The coating liquid and 100 parts by weight of ferrite (having a mean particle size of 50 μm) are put into a vacuum degassing kneader, and stirred at 60° C. for 30 minutes. Then, this is degassed with further heating under reduced pressure, and its contents are dried to give a carrier. The carrier had a volume-intrinsic resistivity value of $10^{10}$ Ωcm in an applied electric field of 10000 V/cm.

100 parts by weight of the carrier is added to 5 parts by weight of the toner, and stirred in a V-blender at 40 rpm for 20 minutes. Next, this is screened through a 212 μm-mesh sieve to obtain a developer.

Example 1

5.5 parts by weight of compound (I-10) mentioned above, 7 parts by weight of a resol-type phenolic resin (trade name, PL-2215 by Gun-ei Chemical Industry Co., Ltd), and 0.03 parts by weight of methylphenylpolysiloxane are mixed and dissolved in 15 parts by weight of isopropanol and 5 parts by weight of methyl ethyl ketone to prepare a protective layer-forming coating liquid. The coating liquid is applied onto the carrier transport layer of the photoreceptor 1 by dipping the photoreceptor therein. Next, the coating film is dried under heat at 130° C. for 40 minutes, and a protective layer having a thickness of 3 μm is thus formed. Thus fabricated, this is a photoreceptor of Example 1, PR-1.

On the other hand, the protective layer-forming coating liquid is stored in a closed container at room temperature (20° C.). After 1 month, it did not cause precipitation and viscosity increase. This means that the coating liquid has no problem in its use in fabricating photoreceptors. Further, the oxygen transmission coefficient ($\times 10^{11}$ fm/s·Pa) at 25° C. of the protective layer formed from the protective layer-forming coating liquid is determined as follows: Under the same condition as that in fabricating the photoreceptor, the protective layer-forming coating liquid is applied onto an aluminium plate to form a protective layer thereon having the same thickness as that in the photoreceptor. Also under the same condition as that in fabricating the photoreceptor, this is dried to prepare a sample. The coating layer is then peeled from the aluminium plate, and its oxygen transmission coefficient at 25° C. is determined by the use of a gas transmittance analyzer (MC-3, by Toyo Seiki Seisaku-Sho. Ltd). The result is given in Table 28.

Example 2

A protective layer is formed in the same manner as in Example 1, for which, however, the condition for drying the protective layer-forming coating liquid is 150° C. in a nitrogen atmosphere for 1 hour. A photoreceptor of Example 2, PR-2 is thus fabricated. Also in the same manner as in Example 1, the oxygen transmission coefficient of the layer is determined, and its result is given in Table 28.

Example 3

A protective layer is formed in the same manner as in Example 1, for which, however, 0.2 parts by weight of Nacure 2500x (trade name of King industry INC) is added as a catalyst to the protective layer-forming coating liquid. A photoreceptor of Example 3, PR-3 is thus fabricated. Also in the same manner as in Example 1, the oxygen transmission coefficient of the layer is determined, and its result is given in Table 28.

Example 4

A protective layer is formed in the same manner as in Example 3, for which, however, compound (I-13) is used in place of compound (I-10). A photoreceptor of Example 4, PR-4 is thus fabricated. In the same manner as in Example 1, the oxygen transmission coefficient of the layer is determined, and its result is given in Table 28.

Example 5

A protective layer is formed in the same manner as in Example 3, for which, however, compound (I-9) is used in place of compound (I-10). A photoreceptor of Example 5, PR-5 is thus fabricated. In the same manner as in Example 1, the oxygen transmission coefficient of the layer is determined, and its result is given in Table 28.

Example 6

6 parts by weight of compound (I-9) mentioned above, 7 parts by weight of a resol-type phenolic resin (trade name, PL-4852 by Gun-ei Chemical Industry Co., Ltd), 0.5 parts by weight of butyral resin, 0.5 parts by weight of bisglycidylbisphenol A, 0.5 parts by weight of biphenyltetracarboxylic acid, 0.03 parts by weight of methylphenylpolysiloxane, and 0.2 parts by weight of Sanol LS2626 (by SANKYO LIFETECH CO., LTD) serving as a catalyst are mixed and dissolved in 15 parts by weight of isopropanol and 5 parts by weight of methyl ethyl ketone to prepare a protective layer-forming coating liquid. The coating liquid is applied onto the carrier transport layer of the photoreceptor 1 by dipping the photoreceptor therein. Next, the coating film is dried under heat at 130° C. for 40 minutes, and a protective layer having a thickness of 3 μm is thus formed. Thus fabricated, this is a photoreceptor of Example 6, PR-6. In the same manner as in Example 1, the oxygen transmission coefficient of the layer is determined, and its result is given in Table 28.

Example 7

A protective layer is formed in the same manner as in Example 1, for which, however, the protective layer-forming coating liquid is prepared by further adding thereto 0.2 parts by weight of fluorine-containing particles (Rublon L-2, by Daikin Industries, Ltd), 0:01 parts by weight of GF-300 (by TOAGOSEI Co., Ltd.) serving as a dispersing agent for particulate fluorine-containing surface active agent, and 50 parts by weight of media, 1-mmϕ glass beads, and dispersing them in a paint shaker for 1 hour. A photoreceptor of Example 7, PR-7 is thus fabricated. Also in the same manner as in Example 1, the oxygen transmission coefficient of the layer is determined, and its result is given in Table 28.

Example 8

A protective layer is formed in the same manner as in Example 6, for which, however, methylated melamine resin (NIKALAC MW-30, by Sanwa Chemical Co., Ltd.) is used in place of the resol-type phenolic resin. A photoreceptor of Example 8, PR-8 is thus fabricated. In the same manner as in Example 1, the oxygen transmission coefficient of the layer is determined, and its result is given in Table 28.

Example 9

A protective layer is formed in the same manner as in Example 6, for which, however, benzoguanamine resin (NI- KALAC BL-60, by Sanwa Chemical Co., Ltd.) is used in place of the resol-type phenolic resin. A photoreceptor of Example 9, PR-9 is thus fabricated. In the same manner as in Example 1, the oxygen transmission coefficient of the layer is determined, and its result is given in Table 28.

Example 10

A protective layer is formed in the same manner as in Example 3, for which, however, compound (I-3) is used in place of compound (I-10). A photoreceptor of Example 10, PR-10 is thus fabricated. In the same manner as in Example 1, the oxygen transmission coefficient of the layer is determined, and its result is given in Table 28.

Example 11

6 parts by weight of compound (I-3) mentioned above, 7 parts by weight of a blocked isocyanate resin (JA-925, by Jujo Chemical Co., Ltd.), 0.5 parts by weight of butyral resin, 0.05 parts by weight of dibutyltin dilaurate, and 0.2 parts by weight of Sanol LS2626 (by SANKYO LIFETECH CO., LTD) serving as a catalyst are mixed and dissolved in 15 parts by weight of isopropanol and 5 parts by weight of methyl ethyl ketone to prepare a protective layer-forming coating liquid. The coating liquid is applied onto the carrier transport layer of the photoreceptor 1 by dipping the photoreceptor therein. Next, the coating film is dried under heat at 130° C. for 40 minutes, and a protective layer having a thickness of 3 μm is thus formed. Thus fabricated, this is a photoreceptor of Example 11, PR-11. In the same manner as in Example 1, the oxygen transmission coefficient of the layer is determined, and its result is given in Table 28.

Examples 12 to 14

A protective layer is formed in the same manner as in Examples 1 to 3, for which, however, the non-protected photoreceptor 2 is used in place of the non-protected photoreceptor 1. Thus fabricated, these are photoreceptors of Examples 12 to 14, PR-12 to PR-14, respectively. In the same manner as in Example 1, the oxygen transmission coefficient of the layer is determined, and its result is given in Table 28.

Examples 15 to 22

A protective layer is formed in the same manner as in Examples 4 to 11, for which, however, the non-protected photoreceptor 3 is used in place of the non-protected photoreceptor 1. Thus fabricated, these are photoreceptors of Examples 15 to 22, PR-15 to PR-22, respectively. In the same manner as in Example 1, the oxygen transmission coefficient of the layer is determined, and its result is given in Table 29.

Comparative Example 1

A protective layer is formed in the same manner as in Example 1, for which, however, a compound of the following formula (C-1) is used in place of compound (I-10). A photoreceptor of Comparative Example 1, RPR-1 is thus fabricated.

(C-1)

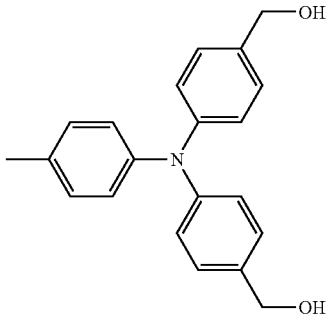

When stored in a closed container at room temperature (20° C.), the protective layer-forming coating liquid formed precipitate in 2 days, and it could not be used for forming a protective layer. In the same manner as in Example 1, the oxygen transmission coefficient of the layer is determined, and its result is given in Table 28.

Comparative Example 2

A protective layer is formed in the same manner as in Comparative Example 1, for which, however, the drying condition for the protective layer-forming coating liquid is 150° C. in a nitrogen atmosphere for 1 hour. A photoreceptor of Comparative Example 2, RPR-2 is thus fabricated. In the same manner as in Example 1, the oxygen transmission coefficient of the layer is determined, and its result is given in Table 28.

Comparative Example 3

A protective layer is formed in the same manner as in Example 1, for which, however, a compound of the following formula (C-3) is used in place of compound (I-10). A photoreceptor of Comparative Example 3, RPR-3 is thus fabricated. In the same manner as in Example 1, the oxygen transmission coefficient of the layer is determined, and its result is given in Table 28.

(C-3)

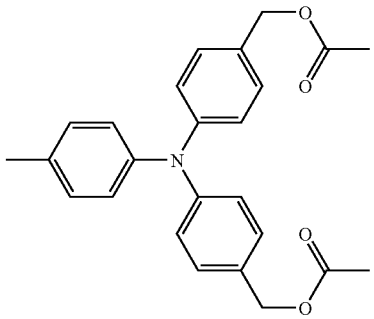

Comparative Example 4

A protective layer is formed in the same manner as in Example 1, for which, however, a compound of the following formula (C-4) is used in place of compound (I-10). A photoreceptor of Comparative Example 4, RPR-4 is thus fabricated. In the same manner as in Example 1, the oxygen transmission coefficient of the layer is determined, and its result is given in Table 28.

(C-4)

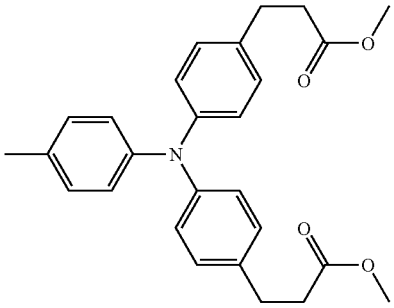

Comparative Examples 5 to 8

A protective layer is formed in the same manner as in Comparative Examples 1 to 4, for which, however, the non-protected photoreceptor 2 is used in place of the non-protected photoreceptor 1. Thus fabricated, these are photoreceptors of Comparative Examples 5 to 8, RPR-5 to PR-8, respectively. In the same manner as in Example 1, the oxygen transmission coefficient of the layer is determined, and its result is given in Table 28.

Comparative Example 9

A protective layer is formed in the same manner as in Example 15, for which, however, a compound of the following formula (C-5) is used in place of compound (I-13). A photoreceptor of Comparative Example 9, RPR-9 is thus fabricated. In the same manner as in Example 1, the oxygen transmission coefficient of the layer is determined, and its result is given in Table 29.

(C-5)

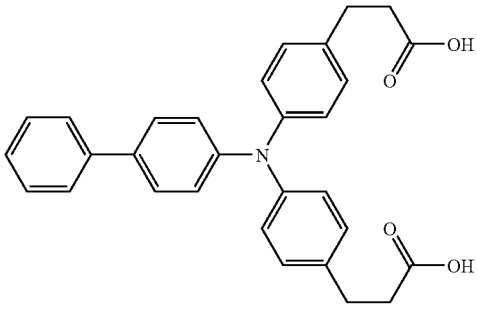

Comparative Example 10

A protective layer is formed in the same manner as in Example 15, for which, however, a compound of the following formula (C-6) is used in place of compound (I-13). A photoreceptor of Comparative Example 10, RPR-10 is thus fabricated. In the same manner as in Example 1, the oxygen transmission coefficient of the layer is determined, and its result is given in Table 29.

(C-6)

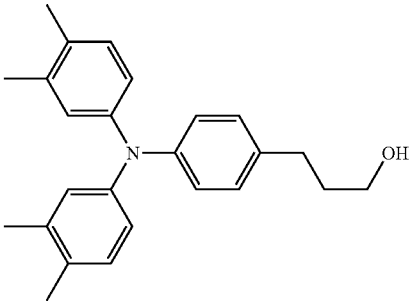

Examples 23 to 37, and Comparative Examples 11 to 16, and 18

The photoreceptors PR-1 to PR-14, and RPR-1 to RPR-8 are separately fitted to an image processor (DocuCentre Color 400CP Model, produced by Fuji Xerox Co., Ltd.), and tested for image formation using the developer prepared hereinabove. The image formation test is as follows:

<Image Formation Test>

Using the image processor (DocuCentre Color 400 CP Model, produced by Fuji Xerox Co., Ltd.) with any of the photoreceptors of Examples 23 to 37, and Comparative Examples 11 to 16, and 18, an image formation test for 10,000 copies is carried out in a low-temperature low-humidity environment (10° C., 20% RH). Next, an image formation test for 10,000 copies is carried out in a high-temperature high-humidity environment (28° C., 75% RH). After the tests, the photoreceptors are checked for deposit, cleanability, abrasion and image quality. The results are given in Table 28.

The photoreceptors are visually checked for deposit and evaluated as follows: "A" means good, as having no deposit; "B" means average, as having some but a little deposit (in at most about 30% of the entire surface); and "C" means not good, as having much deposit. The cleanability is evaluated as follows: "A" means good; "B" means average, as having some streaks or the like image defects (in at most about 10% of the entire image area); and "C" means not good, as having many image defects in a broad range. The abrasion is determined as follows: The abraded amount of the photoreceptor is measured, and the abrasion is per 1000 cycles (nm/kcycle). The image quality is evaluated as follows. 20,000 prints in all for one photoreceptor are visually checked. "A" means good; and for others that gave some image defects, the concrete results are shown in the following Tables.

In Table 28, the surface potential (VL) of the photoreceptor is also shown. The surface potential (VL) is determined as follows: Each photoreceptor is charged at −700 V at room temperature and ordinary humidity (20° C., 50% RH), and exposed to 780-nm flash light of 4.8 mJ/m$^2$. After 50 msec, the thus-exposed photoreceptor is monitored for the surface potential (VL) thereof.

TABLE 28

| Example | Photoreceptor | 25° C. Oxygen Transmission Coefficient ($\times 10^{11}$ fm/s · Pa) | VL | Deposit on Photoreceptor | Cleanability | Abrasion (mm/kcycle) | Image Quality |
|---|---|---|---|---|---|---|---|
| Example 23 | PR-1 | 22 | −120 | A | A | 1.5 | A |
| Example 24 | PR-2 | 25 | −130 | A | A | 1.7 | A |
| Example 25 | PR-3 | 24 | −120 | A | A | 1.5 | A |
| Example 26 | PR-4 | 25 | −120 | A | A | 2.1 | A |
| Example 27 | PR-5 | 27 | −150 | A | A | 1.2 | A |
| Example 28 | PR-6 | 28 | −160 | A | A | 1.3 | A |
| Example 29 | PR-7 | 29 | −150 | A | A | 1.6 | A |
| Example 30 | PR-8 | 33 | −170 | A | A | 1.9 | A |
| Example 31 | PR-9 | 35 | −125 | A | A | 2.6 | A |
| Example 32 | PR-10 | 26 | −120 | A | A | 2.4 | A |
| Example 33 | PR-11 | 35 | −155 | A | A | 2.5 | A |
| Example 34 | PR-12 | 21 | −160 | A | A | 2.2 | A |
| Example 35 | PR-13 | 21 | −140 | A | A | 2.0 | A |
| Example 36 | PR-14 | 23 | −135 | A | A | 2.4 | A |
| Comparative Example 11 | RPR-1 | 40 | −200 | B | B | 3.3 | streaky defects found; thin and low density image |
| Comparative Example 12 | RPR-2 | 45 | −205 | B | B | 3.6 | streaky defects found; thin and low density image |
| Comparative Example 13 | RPR-3 | 45 | −180 | B | B | 4.0 | streaky defects found; thin and low density image |
| Comparative Example 14 | RPR-4 | 43 | −190 | B | B | 4.2 | streaky defects found; thin and low density image |
| Comparative Example 15 | RPR-5 | 41 | −195 | B | B | 3.2 | streaky defects found; thin and low density image |
| Comparative Example 16 | RPR-6 | 44 | −190 | B | B | 3.5 | streaky defects found; thin and low density image |
| Example 37 | RPR-7 | 49 | −180 | B | B | 4.1 | streaky defects found; thin and low density image |
| Comparative Example 18 | RPR-8 | 50 | −95 | B | B | 4.0 | streaky defects found; thin and low density image |

Examples 40 to 47, and Comparative Examples 19 to 20

The photoreceptors PR-15 to PR-22, and RPR-9 and RPR-10 are separately fitted to an image processor (DocuCentre Color 500 Model, produced by Fuji Xerox Co., Ltd.), in which the exposing device is modified to a multi-beam surface-emitting laser (oscillation wavelength, 780 nm), and tested for image formation using the developer prepared hereinabove. The image formation test is as follows:

<Image Formation Test>

Using the image processor (DocuCentre Color 500 Model, produced by Fuji Xerox Co., Ltd.) with any of the photoreceptors of Examples 40 to 47 and Comparative Examples 19 and 20, an image formation test for 10,000 copies is carried out in a low-temperature low-humidity environment (10° C., 20% RH). Next, an image formation test for 10,000 copies is carried out in a high-temperature high-humidity environment (28° C., 75% RH). After the tests, the photoreceptors are checked for deposit, cleanability, abrasion and image quality based on the same standards as above. The results are given in Table 29. In addition, the data of the surface potential (VL) determined in the same manner as above are also shown in the Table.

TABLE 29

| Example | Photoreceptor | 25° C. Oxygen Transmission Coefficient ($\times 10^{11}$ fm/s · Pa) | VL | Deposit on Photoreceptor | Cleanability | Abrasion (mm/kcycle) | Image Quality |
|---|---|---|---|---|---|---|---|
| Example 40 | PR-15 | 26 | −80 | A | A | 1.0 | A |
| Example 41 | PR-16 | 28 | −90 | A | A | 1.1 | A |
| Example 42 | PR-17 | 28 | −100 | A | A | 0.9 | A |
| Example 43 | PR-18 | 29 | −70 | A | A | 1.1 | A |
| Example 44 | PR-19 | 35 | −100 | A | A | 1.2 | A |
| Example 45 | PR-20 | 34 | −85 | A | A | 0.9 | A |
| Example 46 | PR-21 | 22 | −90 | A | A | 1.4 | A |
| Example 47 | PR-22 | 23 | −100 | A | A | 1.3 | A |
| Comparative Example 19 | RPR-9 | 40 | −150 | B | B | 2.0 | streaky defects found; thin and low density image |
| Comparative Example 20 | RPR-10 | 44 | −160 | B | B | 1.9 | streaky defects found; thin and low density image |

As can be seen in Tables 28 and 29, the photoreceptors PR-1 to PR-22 are sufficiently excellent in electrical properties and abrasion resistance. The image-forming apparatus comprising the photoreceptors PR-1 to PR-22 each show no contamination on the surface of the photoreceptor even after prolonged use, demonstrating that these photoreceptors can be kept fairly cleanable and thus can form an excellent image.

Accordingly, the invention can realize an electrophotographic photoreceptor sufficiently excellent in electrical properties, abrasion resistance and anti-adhesion properties that allows high image quality and prolonged life and an image-forming apparatus and a process cartridge which can stably form a high quality image over an extended period of time.

In accordance with the invention, an electrophotographic photoreceptor which is sufficiently excellent in electrical properties, abrasion resistance and anti-adhesion properties and can provide a high image quality and a prolonged life and a process cartridge and an image-forming apparatus comprising same can be provided. In accordance with the invention, a charge-transporting compound which, when applied to an electrophotographic photoreceptor, can provide the electrophotographic photoreceptor with a high image quality and a prolonged life can be provided.

The entire disclosure of Japanese Patent Application No. 2005-092880 filed on Mar. 28, 2005 including specification, claims, drawings and abstract is incorporated herein by reference in its entirely.

The entire disclosure of Japanese Patent Application No. 2005-296813 filed on Oct. 11, 2005 including specification, claims, drawings and abstract is incorporated herein by reference in its entirely.

The entire disclosure of Japanese Patent Application No. 2006-000848 filed on Jan. 5, 2006 including specification, claims, drawings and abstract is incorporated herein by reference in its entirely.

What is claimed is:

1. An electrophotographic photoreceptor comprising:

a conductive support;

a photosensitive layer comprising a charge generating layer and a charge transporting layer; and a functional layer over said photosensitive layer that serves as a protective layer, the functional layer comprises a curable resin and at least one of: a first compound represented by formula (I); and a second compound derived from the first compound:

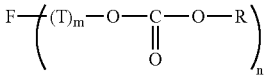

(I)

wherein F represents a hole-transporting, n-valent organic group;

R independently represents $—CH_2—R^4$ or $—(CH_2)_r—O—R^5$, where $R^4$ represents a $C_1$-$C_{17}$ organic group, $R^5$ represents a $C_1$-$C_6$ hydrocarbon group, and r represents an integer from 1-12;

T represents an alkylene group;

m indicates 1; and n indicates an integer of from 1 to 4, wherein the functional layer has a cross-linked structure formed by a crosslinking reaction between the curable resin and at least one of the first compound represented by formula (I) and the second compound derived from the first compound.

2. The electrophotographic photoreceptor as claimed in claim 1, wherein the first compound is represented by formula (II):

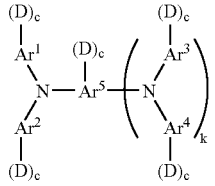

(II)

wherein $Ar^1$ to $Ar^4$ may be the same or different, each representing a substituted or unsubstituted aryl group;

$Ar^5$ represents a substituted or unsubstituted aryl or arylene group;

each c independently indicates 0 or 1;

k indicates 0 or 1;

D represents a monovalent organic group represented by formula (III); and the sum of c is from 1 to 4:

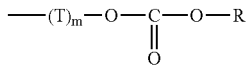

(III)

wherein R independently represents $—CH_2—R^4$ or $—(CH_2)_r—O—R^5$, where $R^4$ represents a $C_1$-$C_{17}$ organic group, $R^5$ represents a $C_1$-$C_6$ hydrocarbon group, and r represents an integer from 1-12;

T represents an alkylene group; and m indicates 1.

3. The electrophotographic photoreceptor as claimed in claim 1, wherein the functional layer is on the side of the photosensitive layer remotest from the conductive support.

4. The electrophotographic photoreceptor as claimed in claim 1, wherein the curable resin is at least one selected from a group consisting of phenolic resin, melamine resin, benzoguanamine resin, siloxane resin and urethane resin.

5. The electrophotographic photoreceptor as claimed in claim 1, wherein the functional layer further comprises a material comprising a fluorine element or a silicon element.

6. The electrophotographic photoreceptor as claimed in claim 1, wherein the functional layer further comprises at least one or more antioxidants.

7. The electrophotographic photoreceptor as claimed in claim 1, wherein the functional layer further comprises at least one or more types of fine particles.

8. The electrophotographic photoreceptor as claimed in claim 1, wherein the functional layer has an oxygen transmission coefficient at 25° C. of $4\times10^{12}$ fm/s·Pa or less.

9. The electrophotographic photoreceptor as claimed in claim 1, wherein a charge-transporting material in the photosensitive layer is different from the first compound represented by formula (I) in the functional layer.

10. The electrophotographic photoreceptor as claimed in claim 1, wherein a charge-transporting material in the photosensitive layer is selected from the group consisting of compounds (IV-1), (IV-2), and (IV-3):

(IV-1)

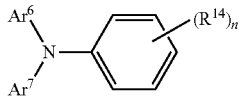

wherein:

$R^{14}$ represents a hydrogen atom or a methyl group;

n indicates 1 or 2;

$Ar^6$ and $Ar^7$ each independently represent a substituted or unsubstituted aryl group, $—C_6H_4—C(R^{18})=C(R^{19})(R^{20})$ or $—C_6H_4—CH=CH—CH=C(Ar)_2$, and the substituent for these is a halogen atom, an alkyl group having from 1 to 5 carbon atoms, an alkoxy group having from 1 to 5 carbon atoms, or a substituted amino group substituted with an alkyl group having from 1 to 3 carbon atoms;

$R^{18}$, $R^{19}$ and $R^{20}$ each independently represent a hydrogen atom, a substituted or unsubstituted alkyl group, or a substituted or unsubstituted aryl group; and Ar represents a substituted or unsubstituted aryl group;

(IV-2)

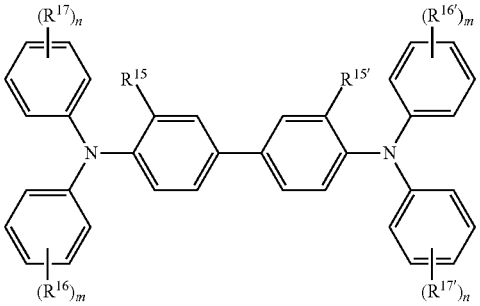

wherein:

$R^{15}$ and $R^{15'}$ each independently represent a hydrogen atom, a halogen atom, an alkyl group having from 1 to 5 carbon atoms, or an alkoxy group having from 1 to 5 carbon atoms;

$R^{16}$, $R^{16'}$, $R^{17}$ and $R^{17'}$ each independently represent a halogen atom, an alkyl group having from 1 to 5 carbon atoms, an alkoxy group having from 1 to 5 carbon atoms, an amino group substituted with an alkyl group having 1 or 2 carbon atoms, a substituted or unsubstituted aryl group, $—C_6H_4—C(R^{18})=C(R^{19})R^{20})$ or $—C_6H_4—CH=CH—CH=C(Ar)_2$;

$R^{18}$, $R^{19}$ and $R^{20}$ each independently represent a hydrogen atom, a substituted or unsubstituted alkyl group, or a substituted or unsubstituted aryl group;

Ar represents a substituted or unsubstituted aryl group;

and m and n each independently indicate an integer of from 0 to 2;

(IV-3)

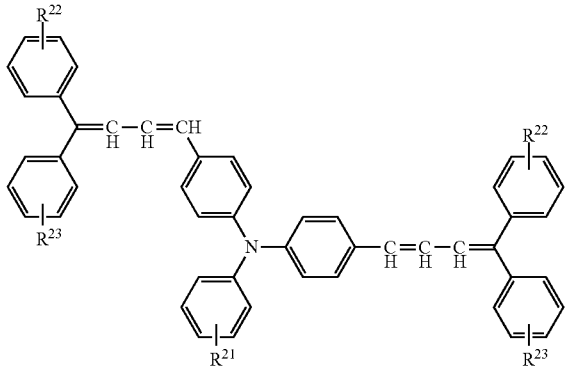

wherein:

$R^{21}$ represents a hydrogen atom, an alkyl group having from 1 to 5 carbon atoms, an alkoxy group having from 1 to 5 carbon atoms, a substituted or unsubstituted aryl group, or $—CH=CH—CH=C(Ar)_2$;

Ar represents a substituted or unsubstituted aryl group;

$R^{22}$ and $R^{23}$ each independently represent a hydrogen atom, a halogen atom, an alkyl group having from 1 to 5 carbon atoms, an alkoxy group having from 1 to 5 carbon atoms, an amino group substituted with an alkyl group having 1 or 2 carbon atoms, or a substituted or unsubstituted aryl group.

11. The electrophotographic photoreceptor as claimed in claim 1, wherein the curable resin is a silicone resin.

12. The electrophotographic photoreceptor according to claim 1, wherein T represents a methylene, ethylene, or propylene group.

13. An image-forming apparatus comprising:

an electrophotographic photoreceptor comprising: a conductive support; a photosensitive layer comprising a charge generating layer and a charge transporting layer; and a functional layer over said photosensitive layer that serves as a protective layer, the functional layer comprises a curable resin and at least one of: a first compound represented by formula (I); and a second compound derived from the first compound;

a charging device that charges the electrophotographic photoreceptor;

an exposing device that exposes the charged electrophotographic photoreceptor to light to form an electrostatic latent image thereon;

a developing device that develops the electrostatic latent image to form a toner image; and a transfer device that transfers the toner image onto a transfer medium, (I-A)

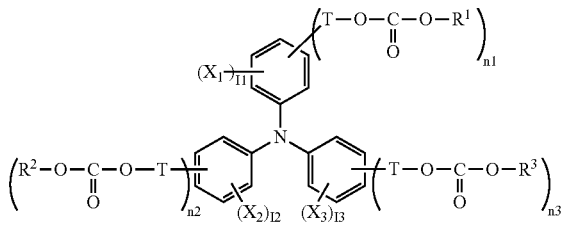

wherein F represents a hole-transporting, n-valent organic group;

R independently represents —$CH_2$—$R^4$ or —$(CH_2)_r$—O—$R^5$, where $R^4$ represents a $C_1$-$C_{17}$ organic group, $R^5$ represents a $C_1$-$C_6$ hydrocarbon group, and r represents an integer from 1-12;

T represents an alkylene group;

m indicates 1; and n indicates an integer of from 1 to 4, wherein the functional layer has a cross-linked structure formed by a crosslinking reaction between the curable resin and at least one of the first compound represented by formula (I) and the second compound derived from the first compound.

14. The image-forming apparatus as claimed in claim 13, comprising:

a photoreceptor unit comprising at least the electrophotographic photoreceptor; and a developing unit comprising at least the developing device, wherein the photoreceptor unit and the developing unit are separated from each other.

15. The image-forming apparatus as claimed in claim 13, further comprising a blade cleaner as a cleaning device that removes a remaining toner on the electrophotographic photoreceptor after a transfer step.

16. The image-forming apparatus as claimed in claim 15, wherein the electrophotographic photoreceptor is fixed to the image-forming apparatus and the blade cleaner is detachably fixed to the image-forming apparatus.

17. The image-forming apparatus as claimed in claim 13, wherein the electrophotographic photoreceptor is fixed to the image-forming apparatus and the charging device is detachably fixed to the image-forming apparatus.

18. The image-forming apparatus as claimed in claim 13, further comprising a fibrous member fittable to the electrophotographic photoreceptor.

19. The image-forming apparatus as claimed in claim 13, comprising a plurality of image-forming units each of which comprises: the electrophotographic photoreceptor; the charging device; the exposing device; and the developing device, wherein the transfer device comprises an intermediate transfer medium that primarily transfers the toner image formed on the electrophotographic photoreceptor and secondarily transfers the primarily-transferred image onto the transfer medium, and wherein said plurality of image-forming units are located on the intermediate transfer medium.

20. The image-forming apparatus as claimed in claim 13, wherein the exposing device is a multi-beam surface-emitting laser.

21. The image-forming apparatus as claimed in claim 13, further comprising:

a lubricant supplying device the supplies a lubricant to the electrophotographic photoreceptor.

22. A process cartridge comprising:

an electrophotographic photoreceptor comprising: a conductive support; a photosensitive layer comprising a charge generating layer and a charge transporting layer; and a functional layer over said photosensitive layer that serves as a protective layer, the functional layer comprises a curable resin and at least one of: a first compound represented by formula (I); and a second compound derived from the first compound; and at least one selected from: a charging device that charges the electrophotographic photoreceptor; a developing device that develops an electrostatic latent image formed through exposing the charged electrophotographic photoreceptor to form a toner image; and a cleaning device that removes a toner that remains on the electrophotographic photoreceptor after transfer,

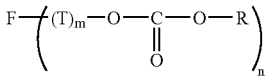

(I)

wherein F represents a hole-transporting, n-valent organic group;

R independently represents —$CH_2$—$R^4$ or —$(CH_2)_r$—O—$R^5$, where $R^4$ represents a $C_1$-$C_{17}$ organic group, $R^5$ represents a $C_1$-$C_6$ hydrocarbon group, and r represents an integer from 1-12;

T represents an alkylene group;

m indicates 1; and n indicates an integer of from 1 to 4, wherein the functional layer has a cross-linked structure formed by a crosslinking reaction between the curable resin and at least one of the first compound represented by formula (I) and the second compound derived from the first compound.

23. An electrophotographic photoreceptor comprising:

a conductive support;

a photosensitive layer comprising a charge generating layer and a charge transporting layer; and a functional layer over said photosensitive layer that serves as a protective layer, wherein the functional layer comprises a curable resin and at least one of: a first compound represented by formula (I), and a second compound derived from the first compound:

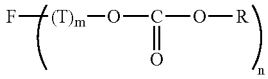

(I)

wherein F represents a hole-transporting, n-valent organic group;

R independently represents —$CH_2$—$R^4$ or —$(CH_2)_r$—O—$R^5$, where $R^4$ represents a $C_1$-$C_{17}$ organic group, $R^5$ represents a $C_1$-$C_6$ hydrocarbon group, and r represents an integer from 1-12;

T represents an alkylene group;

m indicates 1; and n indicates an integer of from 1 to 4; and the functional layer has a cross-linked structure comprising the at least one of the first compound represented by the formula (I) and the second compound derived from the first compound, and the curable resin bonded to the at least one of a first compound represented by the formula (I) and the second compound derived from the first compound.

* * * * *